US010913073B2

(12) United States Patent
John et al.

(10) Patent No.: US 10,913,073 B2
(45) Date of Patent: Feb. 9, 2021

(54) ELECTROSTATIC ENHANCEMENT OF INLET PARTICLE SEPARATORS FOR ENGINES

(71) Applicant: Lynntech, Inc., College Station, TX (US)

(72) Inventors: Sanil John, College Station, TX (US); Dennis R. Gifford, Bryan, TX (US); Seth Cocking, College Station, TX (US); Jady Samuel Stevens, Bryan, TX (US); Michael William Martin, Hearne, TX (US); Geoffrey Duncan Hitchens, Allen, TX (US); David Battaglia, College Station, TX (US)

(73) Assignee: Lynntech, Inc., College Station, TX (US)

( * ) Notice: Subject to any disclaimer, the term of this patent is extended or adjusted under 35 U.S.C. 154(b) by 337 days.

(21) Appl. No.: 15/865,413

(22) Filed: Jan. 9, 2018

(65) Prior Publication Data

US 2018/0193848 A1 Jul. 12, 2018

Related U.S. Application Data

(60) Provisional application No. 62/444,051, filed on Jan. 9, 2017.

(51) Int. Cl.
*B03C 3/38* (2006.01)
*B03C 3/43* (2006.01)
(Continued)

(52) U.S. Cl.
CPC ..... *B03C 3/383* (2013.01); *B03C 3/0175* (2013.01); *B03C 3/025* (2013.01); *B03C 3/06* (2013.01);
(Continued)

(58) Field of Classification Search
CPC combination set(s) only.
See application file for complete search history.

(56) References Cited

U.S. PATENT DOCUMENTS 2,598,925 A * 6/1952 Linder ..... G21H 1/02 331/94.1
3,755,122 A * 8/1973 Melcher ..... B03C 3/66 204/554
(Continued)

OTHER PUBLICATIONS

Barone, D., et al. "Fluid Dynamics of an Inertial Particle Separator," 52nd Aerospace Sciences Meeting, National Harbor, Maryland, Jan. 13-17, 2014.
(Continued)

*Primary Examiner* — Christopher P Jones
*Assistant Examiner* — Sonji Turner
(74) *Attorney, Agent, or Firm* — Edwin S. Flores; Chalker Flores, LLP

(57) ABSTRACT

The present invention includes a device, a system, and a method for enhancing a particle separation efficiency, including a particle charging device adapted to impart predominately unipolar charging on a plurality of particles in a fluid stream, e.g. a gas stream; wherein the particle charging device is positioned upstream from and adapted to provide the plurality of particles charged by the particle charging device to a particle deflection device capable of separating the particles charged by the particle charging device from a core fluid flow that is substantially free of dust particles.

25 Claims, 39 Drawing Sheets

(51) Int. Cl.

| | |
|---|---|
| ***B03C 3/017*** | (2006.01) |
| ***B03C 3/06*** | (2006.01) |
| ***B03C 3/36*** | (2006.01) |
| ***B03C 3/41*** | (2006.01) |
| ***B03C 3/49*** | (2006.01) |
| ***B03C 3/12*** | (2006.01) |
| ***B03C 3/02*** | (2006.01) |

(52) U.S. Cl.
CPC ..... *B03C 3/12* (2013.01); *B03C 3/361* (2013.01); *B03C 3/366* (2013.01); *B03C 3/38* (2013.01); *B03C 3/41* (2013.01); *B03C 3/43* (2013.01); *B03C 3/49* (2013.01); *B03C 2201/04* (2013.01); *B03C 2201/08* (2013.01); *B03C 2201/30* (2013.01)

(56) References Cited

U.S. PATENT DOCUMENTS

| | | | | |
|---|---|---|---|---|
| 3,832,086 | A | 8/1974 | Hull et al. | |
| 4,010,011 | A | 3/1977 | Reif | |
| 4,309,199 | A | 1/1982 | Suzuki | |
| 4,488,885 | A * | 12/1984 | Milde | B03C 3/38 323/903 |
| 4,527,387 | A | 7/1985 | Lastrina et al. | |
| 4,685,942 | A | 8/1987 | Klassen et al. | |
| 5,787,704 | A * | 8/1998 | Cravero | B03C 3/41 60/274 |
| 5,973,904 | A * | 10/1999 | Pui | B05B 5/0533 361/225 |
| 6,004,376 | A * | 12/1999 | Frank | B03C 3/025 95/79 |
| 6,508,052 | B1 | 1/2003 | Snyder et al. | |
| 6,589,314 | B1 * | 7/2003 | Page | B03C 3/011 209/127.4 |
| 7,296,395 | B1 * | 11/2007 | Hartman | B01D 45/04 244/53 B |
| 7,374,593 | B2 * | 5/2008 | Snyder | B01D 45/06 55/306 |
| 7,879,123 | B2 | 2/2011 | Lundquist et al. | |
| 7,927,408 | B2 | 4/2011 | Sheoran et al. | |
| 7,964,021 | B2 * | 6/2011 | Younsi | B03C 3/68 361/227 |
| 8,372,183 | B2 * | 2/2013 | Doucette | B01D 45/04 244/53 B |
| 8,539,775 | B1 * | 9/2013 | Wong | B05B 5/0533 361/225 |
| 2005/0083633 | A1 * | 4/2005 | Riebel | B03C 3/68 361/227 |
| 2013/0327218 | A1 | 12/2013 | Izzi et al. | |
| 2015/0090120 | A1 * | 4/2015 | Au | B03C 3/41 60/274 |
| 2015/0198090 | A1 * | 7/2015 | Howe | B03C 3/38 323/903 |
| 2015/0354461 | A1 | 12/2015 | Meier et al. | |
| 2016/0265435 | A1 | 9/2016 | Snyder | |
| 2017/0138263 | A1 * | 5/2017 | Duge | G21H 1/02 331/94.1 |
| 2018/0200728 | A1 * | 7/2018 | Pourprix | B01D 45/06 55/306 |

OTHER PUBLICATIONS

Barone, D., et al., "Efficiency of an Inertial Particle Separator," Journal of Propulsion and Power, vol. 31, No. 4, Jul.-Aug. 2015, 997-1002.

Barone, D., et al., "Influence of Particle Size on Inertial Particle Separator Efficiency," Powder technology, 318, 2017, 177-185.

Ghanem, A. et al., "Energy efficiency in process industry—High-efficiency vortex (HEV) multifunctional heat exchanger," Renewable Energy, 56, 96-104, Oct. 18, 2012.

Warren, J., et al., "Best Practices for the Mitigation and Control of Foreign Object Damage-Induced High Cycle Fatigue in Gas Turbine Engine Compression System Airfoils", in RTO Technical Report, RTO-TR-AVT-094, Jun. 2005, 212 pp.

Watanabe, T., et al., "Submicorn particle agglomeration by an electrostatic agglomerator," Journal of Electrostatics, 34, 367-383, Jun. 9, 1994.

* cited by examiner

| | CIRCULAR CROSS-SECTION | HONEYCOMB STRUCTURE |
|---|---|---|
| OUTER DIAMETER: 13.18"<br><br>INNER DIAMETER: 6.80" |  |  |
| TUBE DIMENSIONS | Φ1" x 0.03" x 6" | 1" x 0.03" x 6" (CELL) |
| NUMBER OF COMPLETE CELLS + CELLS >50% | 93+0=93 | 72+84=156 |
| OPEN SURFACE AREA | 56 $IN^2$ | 94 $IN^2$ |
| WEIGHT | 9.9 LBS | 3.4 LBS |

FIG. 30B
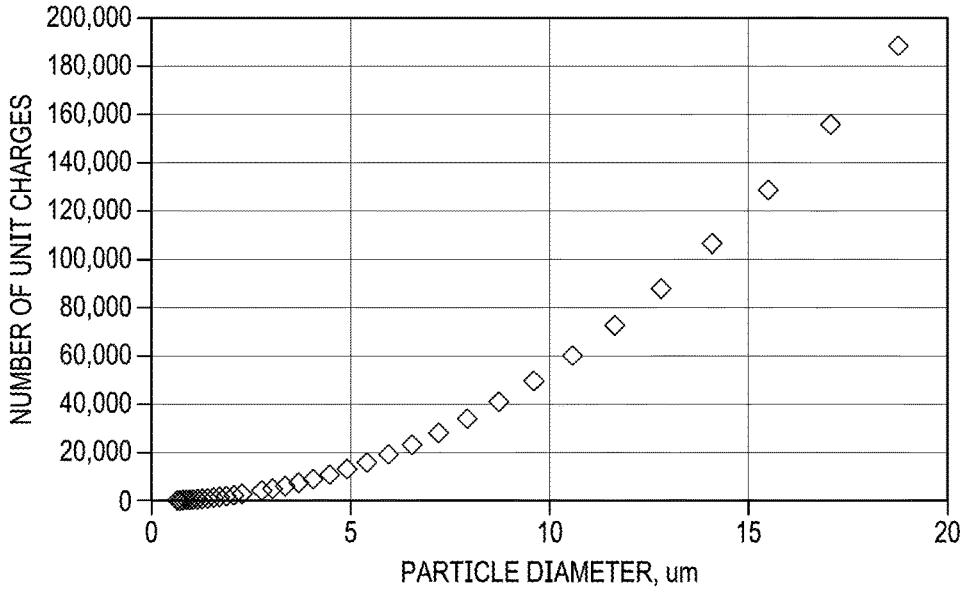
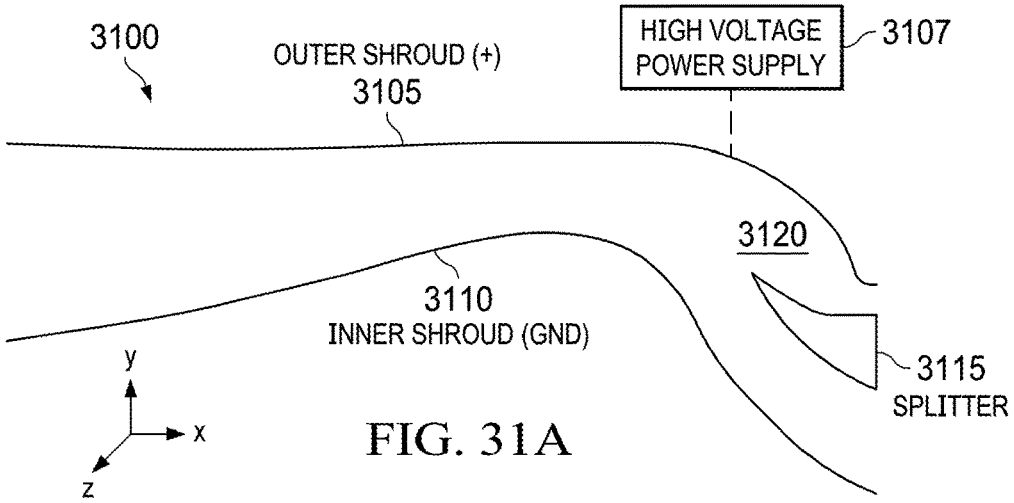
FIG. 31A
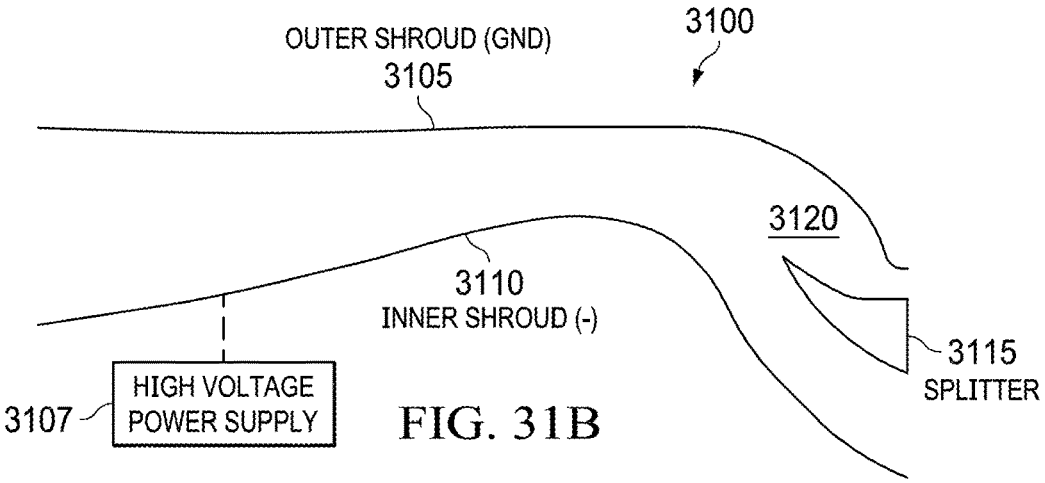
FIG. 31B

ELECTROSTATIC ENHANCEMENT OF INLET PARTICLE SEPARATORS FOR ENGINES

CROSS-REFERENCE TO RELATED APPLICATIONS

This application claims the benefit of U.S. Provisional Application No. 62/444,051 filed Jan. 9, 2017, the entire contents of which are incorporated herein by reference.

STATEMENT OF FEDERALLY FUNDED RESEARCH

This invention was made with government support under Contract No. W911W6-15-C-0011 awarded by U.S. Army Research Development and Engineering Command. The government has certain rights in the invention.

TECHNICAL FIELD OF THE INVENTION

The present invention relates in general to the field of damage to engines by particles, and more particularly, to a novel electrostatic enhancement of inlet particle separators for engines.

BACKGROUND OF THE INVENTION

Without limiting the scope of the invention, its background is described in connection with engine inlets and damage to engines by particles.

Engines such as gas turbine, gasoline, diesel, or hybrid, require a flow of ambient air during operation. Highly powerful engines such as turbine engines in aircraft or engines in high performance vehicles require an extremely large flow of air for combustion of fuel. Aircraft (helicopter, airplane, etc.) flights to and from unprepared airfields expose their engines to ingestion of foreign objects, particularly dust and sand entrained in the surrounding air as frequently stirred up by the aircraft itself. The ingestion of dust causes erosion of turbine engine components such as turbine and compressor blades and blockage of cooling-hole passages. The resulting effects include loss of power, increased fuel consumption and reduced engine life. The dust concentrations encountered during flight in natural environments vary greatly but during extreme conditions of brownout may reach 2.5 g/m$^3$. [Barone, 2014] Typical ingested particle dust sizes range from 0-1,000 μm and the distribution may vary depending on the wind velocity, levels of precipitation, and surrounding vegetation.

Current engine protection systems include inlet particle separators (IPS), e.g., Hull and Nye, U.S. Pat. No. 3,832,086, Lastrina, et al., U.S. Pat. No. 4,527,387, and Klassen et al., U.S. Pat. No. 4,685,942; for vortex tube separators, e.g., Lundquist and Thomas, U.S. Pat. No. 7,879,123; and barrier filters, e.g., Izzi, et al., U.S. Pat. No. 4,527,387, and Klassen et al., U.S. Pat. No. 4,685,942, to limit entry of sand and dust particles. These and related inertial particle separation designs are incorporated into the present invention by reference. The first two systems provide good protection against coarse sand and dust particles but exhibit poor separation efficiency for very fine sand (0-20 μm). Barrier filters have high filtration efficiency but result in increased pressure drop over the period of operation, and therefore, need maintenance at regular intervals. There is a need in the aviation industry to efficiently filter dust particles, especially fine sand (1-80 μm).

Despite not having the highest efficiency among engine protection systems, IPS technology currently provides the most compact and light weight system for foreign object damage mitigation and engine protection that can be tightly integrated with the engine. They are designed and qualified with the engine and are typically compact with acceptable pressure drop (~1%). They have a higher volume flow rate per unit area of intake protection than vortex tube separators, which translates to a lower drag penalty. The IPS separates particles from the intake air flow by changing the direction of motion of the flowing air, in such a way that the particle trajectories cross over the air streamlines, and the particles are concentrated into a smaller air flow called the scavenge flow. The larger air flow called the core flow has a lower concentration of dust particles and it flows from the IPS into the engine. In other words, the IPS splits the intake airflow into core flow and scavenge flow, with the latter containing majority of the dust particles. The separation efficiency can be defined as the mass of dust present in the scavenge flow divided by the mass of dust present in the intake airflow. IPSs are effective against large particles but smaller particles are not amenable to the inertial separation method. For example, the IPS separation efficiency for T700 engine is 91.7% for coarse sands and drops to 64% for fine sands. Typically, overall separation efficiency of IPSs is about 70% for fine particles (1-80 um).

U.S. Pat. No. 4,010,011, issued to Reif, discloses the use of an electrostatic device with an air spinner to treat dust laden engine air flow but with the object of electrostatically enhancing the outward migration of dust particles over the inertial affect produced by the air spinner rather than agglomerating fine dust particles. Prior patents, e.g., Lundquist and Thomas, U.S. Pat. No. 7,879,123 and Snyder and Vittal U.S. Pat. No. 6,508,052, teach the use of multiple particle separator tubes but the claimed enhanced separation is achieved by inertial separation, rather than due to agglomeration by electrostatic means. U.S. Pat. No. 4,309,199, issued to Suzuki, discloses the application of corona discharge and a cyclone separator in a single device to clean air intake of internal combustion engines. In that patent, the goal was to charge and collect the dust particles inside the cyclone separator, which requires periodic cleaning to remove dust particles that act as a dielectric layer on the collecting surface reducing the efficiency of the device.

Recent U.S. Patent Application Publication Nos. 2015/0198090 and 2016/0265435 relate to turbine engine applications describe electrostatic devices or electrostatic generators. In U.S. Patent Application Publication No. 2016/0265435, Snyder, describes the use of electrostatic generators. The present invention ensures that all of the intake air passes through the electrostatic charging stage(s) while incurring minimal pressure loss as is required for turbine engine applications. It is recognized by those experienced in the field of present invention that the electrostatic charging of particles is enhanced by high-electric field, high charge concentration, and low residence time. The present invention ensures that a high electric field is available for charging particles due to the logarithmic enhancement of the electric field. Additionally, a greater charge production is ensured due to the logarithmic enhancement of the electric field, resulting in high concentration of charges.

U.S. Patent Application Publication No. 2015/0198090, filed by Howe et al., describes an electrostatic grid that is disposed adjacent to or extending partially across the air inlet. The grid design is not described to extend along the direction of the flow. This localized implementation may not effectively charge most or all of the particles well dispersed in the airflow. In contrast, in the present invention, the residence time of the dust particles in the electrostatic device can be increased by elongation of the electric field along the direction of the flow.

U.S. Patent Application Publication No. US2015/0354461, filed by Meier et al., describes an arrangement of multiple tubes with circular cross-section to electrostatically charge particles and collect them for cooling arrangement for a gas turbine engine. Our present invention is for charging, agglomeration, and deflection of the charged and agglomerated particles into a secondary flow. The disadvantage of using tubes with circular cross-section is that there are gaps between the edges of the circular cross-section tubes because they cannot be packed efficiently. Hence the area available for flow is considerably reduced resulting in pressure drop that is significant for turbine engine intake applications. The present invention is based on honeycomb structure that has hexagonal cells resulting in better packing, greater flow area, and lower pressure loss than circular cross-section tubes. The honeycomb structure is made of hexagonal cells that share their walls among each other. Therefore the weight of the device consisting of honeycomb structure is also lower than that consisting of tubes with circular cross-section. Minimization of the weight of the device results in lower penalty on turbine engine power.

SUMMARY OF THE INVENTION

The present invention relates to a multi-stage electrostatic enhancement process for improvement of particle separation efficiency of inlet particle separators used in turbine engines. The process includes the following stages: Particle Charging, Agglomeration, and their Deflection and Separation into a preferred flow stream. In the Particle Charging stage, high charge generation is achieve with low pressure drop in intake air flow and low weight penalty. Agglomeration of the charged particles is achieved by the use of electric field or by the use of turbulent mixing features. The separation efficiency of the IPS is greater for larger particles than finer particles, therefore charging and agglomeration of fine particles improves the overall separation efficiency of the IPS. Additional improvement in separation efficiency is achieved by deflection of the charged particles, away from the engine flow path (core flow) into the scavenge flow path by an electric or magnetic field. The multi-stage electrostatic enhancement process can be controlled or modulated in conjunction with a particle sensor installed in the air flow stream. Data generated in laboratory tests demonstrates improvement in the separation efficiency of a small scale IPS.

In one embodiment, the present invention includes a particle deflection system including a particle charging device including: one or more openings adapted to receive particles in a fluid stream and that impart an electrical charge to particles in the one or more openings; a particle agglomeration device in fluid communication with the particle charging device and including one or more mixing surfaces adapted to agglomerate or mix the one or more particles electrically charged by the particle charging device in the fluid stream; and a particle deflection device adapted to separate agglomerated particles in the fluid stream from a core flow that is substantially free of particles.

In another embodiment, the present invention also includes a method for using enhanced separation efficiency of inertial separators, including: unipolarly charging a device to impart predominantly positive or negative charges on particles in a gas stream; agglomerating the charged particles installed downstream to the particle charging device; and generating an electric or magnetic field to deflect the agglomerated or charged particles to enhance their separation into multiple gas streams, wherein particles are removed from the gas stream to enhance the separation efficiency of the inertial separators.

In another embodiment, the invention includes an engine including a particle deflection system upstream from the engine intake, including: a particle charging device including one or more openings adapted to receive particles in a fluid stream and that impart an electrical charge to particles in the one or more openings; a particle agglomeration device in fluid communication with the particle charging device and including one or more mixing surfaces adapted to agglomerate or mix the one or more particles electrically charged by the particle charging device in the fluid stream; and a particle deflection device adapted to separate agglomerated particles in the fluid stream from a core flow that is substantially free of particles.

Yet another embodiment, includes a kit adapted to protect an engine, including: a particle charging device including: one or more openings adapted to receive particles in a fluid stream and that impart an electrical charge to particles in the one or more openings; a particle agglomeration device in fluid communication and downstream from the particle charging device, the particle agglomeration device including one or more mixing surfaces adapted to agglomerate or mix the one or more particles electrically charged by the particle charging device in the fluid stream; and a particle deflection device in fluid communication with and downstream from the particle agglomeration device, the particle deflection device adapted to separate agglomerated particles in the fluid stream from a core flow that is substantially free of particles.

In yet another embodiment, the present invention also includes a system to enhance separation efficiency of inertial separators, including: a device to impart predominantly positive or negative charges (unipolar charging) on particles in a gas stream; a device to promote agglomeration of the charged particles in the gas stream installed downstream to the particle charging device; and a device to generate an electric or magnetic field to deflect the agglomerated or charged particles to enhance their separation into two or more gas streams, wherein particles are removed from the gas stream to enhance the separation efficiency of the inertial separators.

In one embodiment, the present invention includes a system for enhancing a particle separation efficiency including a particle charging device adapted to impart predominately unipolar charging on a plurality of particles in a fluid stream; wherein the particle charging device is positioned upstream from and adapted to provide the plurality of particles charged by the particle charging device to a particle deflection device capable of separating the particles charged by the particle charging device from a core fluid flow that is substantially free of dust particles. In one aspect, the particle charging device is adapted to impart predominately unipolar charging using an electric discharge. In another aspect, the electric discharge is generated between a rod or a wire positioned substantially along the longitudinal axis of a tube and the tube. In another aspect, the tube has a substantially circular cross section or a non-circular cross-section. In another aspect, the electric discharge is generated between a plurality of rods or wires positioned within an annulus. In another aspect, the annulus is partitioned into a plurality of partial-annulus sections, and each partial-annulus section has at least one rod or wire positioned within it. In another aspect, the electric discharge is generated between one or more protrusions and a flat or curved surface. In another aspect, the curved surface is within an annulus. In another aspect, the annulus is partitioned into a plurality of partial-annulus sections, and each partial-annulus section has at least one protrusion positioned within it. In another aspect, the electric discharge is generated between a plurality of protrusions positioned on opposite sides of the annulus. In another aspect, the electric discharge is a corona discharge, a dielectric barrier discharge, a radio-frequency-inductively coupled plasma discharge, an arc discharge, or a gliding arc discharge. In another aspect, the particle charging device is adapted to impart predominately unipolar charging using an ionizing radiation device. In another aspect, the ionizing radiation device uses ionizing radiation produce by a source of x-rays or a decay of radioactive material. In another aspect, the system further includes an agglomeration device adapted to promote agglomeration of particles charged by the particle charging device. In another aspect, the agglomeration device is adapted to promote agglomeration of particles by a turbulent mixing or by an electric field. In another aspect, the electric field is a constant electric field, a time-varying electric field, or a pulsed electric field. In another aspect, the time-varying field is an oscillating electric field. In another aspect, the turbulent mixing uses one or more protrusions in a fluid stream. In another aspect, the turbulent mixing uses vortices having rotational axes substantially parallel to a direction of flow of the fluid stream, substantially perpendicular to the direction of flow of the fluid stream, or at varying angles to the direction of flow of the fluid stream. In another aspect, the particle deflection device is adapted to separate the particles charged by the particle charging device using a constant electric field, a time-varying electric field, a pulsed electric field, a constant magnetic field, a time-varying magnetic field, or a pulsed magnetic field. In another aspect, the time-varying electric field is an oscillating electric field that is unbiased, biased positively, or biased negatively. In another aspect, the particle separation system is adapted for use with a flow separator to separate the particles charged by the particle charging device and deflected by the particle deflection device into a scavenge flow. In another aspect, the flow separator is an inertial particle separator, a centrifugal particle separator, a cyclonic particle separator, or a porous medium. In another aspect, the system further includes one or more sensors to sense a chemical composition of particles, a particle size, or a particle concentration. In another aspect, information from the one or more sensors informs control of individual components of the system. In another aspect, the one or more sensors are adapted to identify at least one of soil particles, particles from sea spray, particles from volcanic eruption, or particles from anthropogenic particulate emission. In another aspect, the one or more sensors include an optical sensor, an electrical sensor, a chemical sensor, a spectroscopic sensor, a sensor that uses Raman spectroscopy, or a sensor that uses laser-induced breakdown spectroscopy. In another aspect, the plurality of particles include particles of at least one of silica, gypsum, silicates, dolomite, salt, carbon, organic compounds, or metal oxides. In another aspect, the separation takes place in an engine that is in a stationary device, is in a vehicle, is in or about an aircraft, is in a vehicle for transportation on a land surface, is in a vehicle for transportation on the surface of a body of water, is in a vehicle for transportation on either a land surface or the surface of a body of water as needed, or is in a vehicle for transportation beneath the surface of a body of water. In another aspect, the engine is at least one of: a jet engine, a turbine engine, a supercharged engine, a compressor engine, a turbojet engine, a turbofan engine, a turboprop engine, a ramjet engine, a pulse jet engine, a scramjet engine, or an electric motor engine.

In another embodiment, the present invention includes a method of enhancing separation of particles from a fluid flow, including imparting predominately unipolar charging on each of a plurality of particles in a fluid stream; and separating the particles after they have been charged from a core fluid flow that is substantially free of particles. In one aspect, the imparting predominately unipolar charging on each of a plurality of particles in a fluid stream is performed using an electric discharge. In another aspect, the electric discharge is generated between a rod or a wire positioned substantially along the longitudinal axis of a tube and the tube. In another aspect, the tube has a substantially circular cross section or a non-circular cross-section. In another aspect, the electric discharge is generated between a plurality of rods or wires positioned within an annulus. In another aspect, the annulus is partitioned into a plurality of partial-annulus sections, and each partial-annulus section has at least one rod or wire positioned within it. In another aspect, the electric discharge is generated between one or more protrusions and a flat or curved surface. In another aspect, the curved surface is within an annulus. In another aspect, the annulus is partitioned into a plurality of partial-annulus sections, and each partial-annulus section has at least one protrusion positioned within it. In another aspect, the electric discharge is generated between a plurality of protrusions positioned on opposite sides of an annulus. In another aspect, the electric discharge is a corona discharge, a dielectric barrier discharge, a radio-frequency-inductively coupled plasma discharge, an arc discharge, or a gliding arc discharge. In another aspect, the imparting predominately unipolar charging on each of a plurality of particles in a fluid stream is performed using an ionizing radiation device. In another aspect, the ionizing radiation device uses ionizing radiation produce by a source of x-rays or a decay of radioactive material. In another aspect, the method further includes promoting agglomeration of the particles after they have been charged. In another aspect, the promoting agglomeration of particles after they have been charged is performed by a turbulent mixing or an electric field. In another aspect, the electric field is a constant electric field, a time-varying electric field, or a pulsed electric field. In another aspect, the time-varying field is an oscillating electric field. In another aspect, the turbulent mixing uses one or more protrusions in a fluid stream. In another aspect, the turbulent mixing uses vortices having rotational axes substantially parallel to a direction of flow of the fluid stream, substantially perpendicular to the direction of flow of the fluid stream, or at varying angles to the direction of flow of the fluid stream. In another aspect, the separating the particles after they have been charged is performed using a constant electric field, an time-varying electric field, a pulsed electric field, or a constant magnetic field, a time-varying magnetic field, or a pulsed magnetic field. In another aspect, the time-varying electric field is an oscillating electric field that is unbiased, biased positively, or biased negatively. In another aspect, the method is adapted for use with a flow separator to separate the particles charged by the particle charging device and deflected by the particle deflection device into a scavenge flow. In another aspect, the flow separator is an inertial particle separator, a centrifugal particle separator, a cyclonic particle separator, or a porous medium. In another aspect, the method further includes sensing a chemical composition of particles, a particle size, or a particle concentration. In another aspect, information from the sensing informs control of individual components of the system. In another aspect, the sensing includes identifying at least one of soil particles, particles from sea spray, particles from volcanic eruption, or particles from anthropogenic particulate emission. In another aspect, the sensing includes Raman spectroscopy or laser-induced breakdown spectroscopy. In another aspect, the plurality of particles includes particles of at least one of silica, gypsum, silicates, dolomite, salt, carbon, organic compounds, or metal oxides. In another aspect, the method is used with an engine that is in a stationary device, is in a vehicle, is in or about an aircraft, is a vehicle for transportation on a land surface, is a vehicle for transportation on the surface of a body of water, is a vehicle for transportation on either a land surface or the surface of a body of water as needed, or is a vehicle for transportation beneath the surface of a body of water. In another aspect, the engine is at least one of: a jet engine, a turbine engine, a supercharged engine, a compressor engine, a turbojet engine, a turbofan engine, a turboprop engine, a ramjet engine, a pulse jet engine, a scramjet engine, or an electric motor engine.

In another embodiment, the present invention includes an engine including a system for enhancing a particle separation efficiency, including a particle charging device adapted to impart predominately unipolar charging on a plurality of particles in a fluid stream; wherein the particle charging device is positioned upstream from and adapted to provide the plurality of particles charged by the particle charging device to a particle deflection device capable of separating the particles charged by the particle charging device from a core fluid flow that is substantially free of dust particles. In one aspect, the engine is at least one of: a jet engine, a turbine engine, a supercharged engine, a compressor engine, a turbojet engine, a turbofan engine, a turboprop engine, a ramjet engine, a pulse jet engine, a scramjet engine, or an electric motor engine. In one aspect, the engine is in a stationary device, is in a vehicle, is in or about an aircraft, is in a vehicle for transportation on a land surface, is in a vehicle for transportation on the surface of a body of water, is in a vehicle for transportation on either a land surface or the surface of a body of water as needed, or is in a vehicle for transportation beneath the surface of a body of water.

In another embodiment, the present invention includes a kit adapted to protect an engine, including a particle charging device adapted to impart predominately unipolar charging on a plurality of particles in a fluid stream; wherein the particle charging device is positioned upstream from and adapted to provide the plurality of particles charged by the particle charging device to a particle deflection device capable of separating the particles charged by the particle charging device from a core fluid flow that is substantially free of dust particles.

BRIEF DESCRIPTION OF THE DRAWINGS

For a more complete understanding of the features and advantages of the present invention, reference is now made to the detailed description of the invention along with the accompanying figures and in which:

FIG. 14 shows improvement in separation efficiency achieved by operation of charging stage, agglomeration and deflection field. Control=Devices powered off. Test=Devices powered on.

FIGS. 30A and 30B show the relationship between particle size and total charge in terms of unit charges up to 2,500,000 unit charges and up to 200,000 unit charges, respectively.

FIGS. 31A and 31B depict the introduction of electrostatic field within the IPS for deflection of charged particles, with inner and outer shrouds grounded, respectively.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not limit the invention, except as outlined in the claims.

Figure 1:
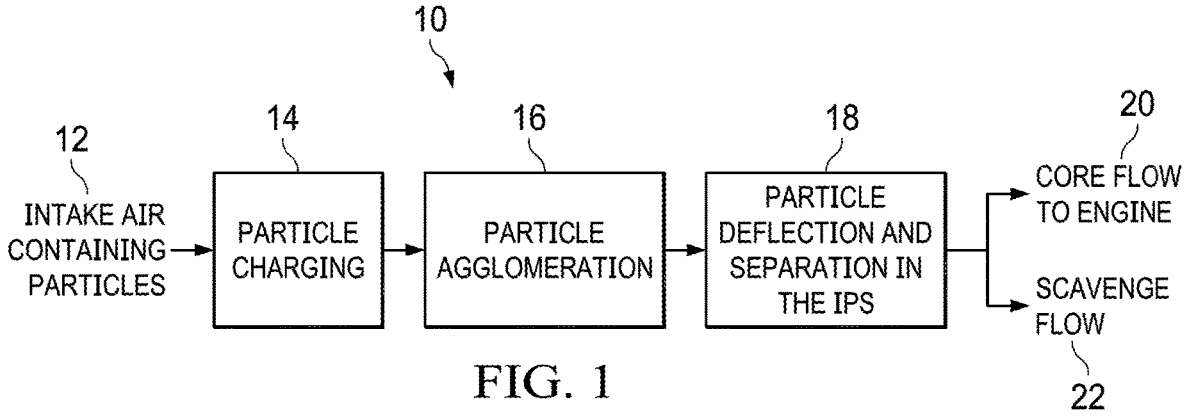
FIG. 1 shows the three stages in the present invention: Particle Charging, Particle Agglomeration and Particle Deflection towards Scavenge flow.

The following detailed description explains one of the many ways in which the present invention can be applied. The three stages in the present invention 10 can be summarized as shown in FIG. 1. Intake air containing particles 12 are charged unipolarly, i.e., the particles are imparted positive or negative charges in the Particle Charging Stage 1 at step 14. In the Particle Agglomeration Stage 2 at step 16, the charged particles are agglomerated by turbulent mixing and/or by electric field resulting in an increase in particle size. In the Particle Deflection Stage 3 at step 18, the charged and agglomerated particles are deflected into the desired air flow stream by the inlet particle separator (IPS), such as the core flow to the engine 20 or the scavenge flow 22. The IPS causes inertial separation of the particles in the intake air flow into the scavenge flow, while the relatively cleaner core flow is sent to the engine. In one embodiment, each stage requires application of an electric field, while in another embodiment only Stage 1 and Stage 3 require electric field. The characteristics and configurations of the applied electric field are different for Stage 1 versus Stage 2 or 3, as described in detail hereinbelow.

Particle Charging Stage 1.

Figure 2:
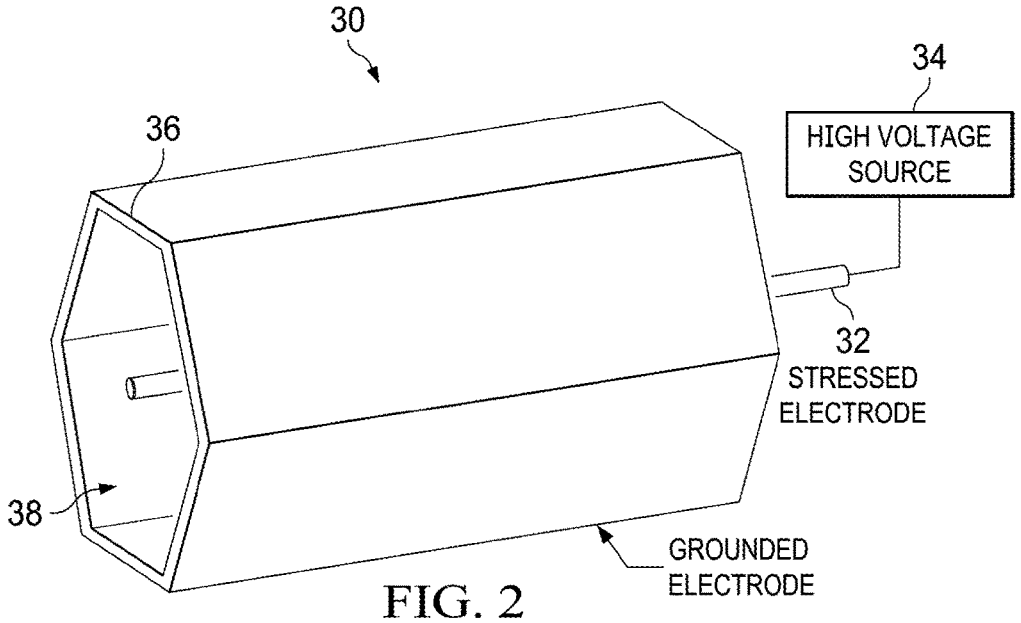
FIG. 2 is an example of a charger tube used to generate corona discharge.
Figure 3A:
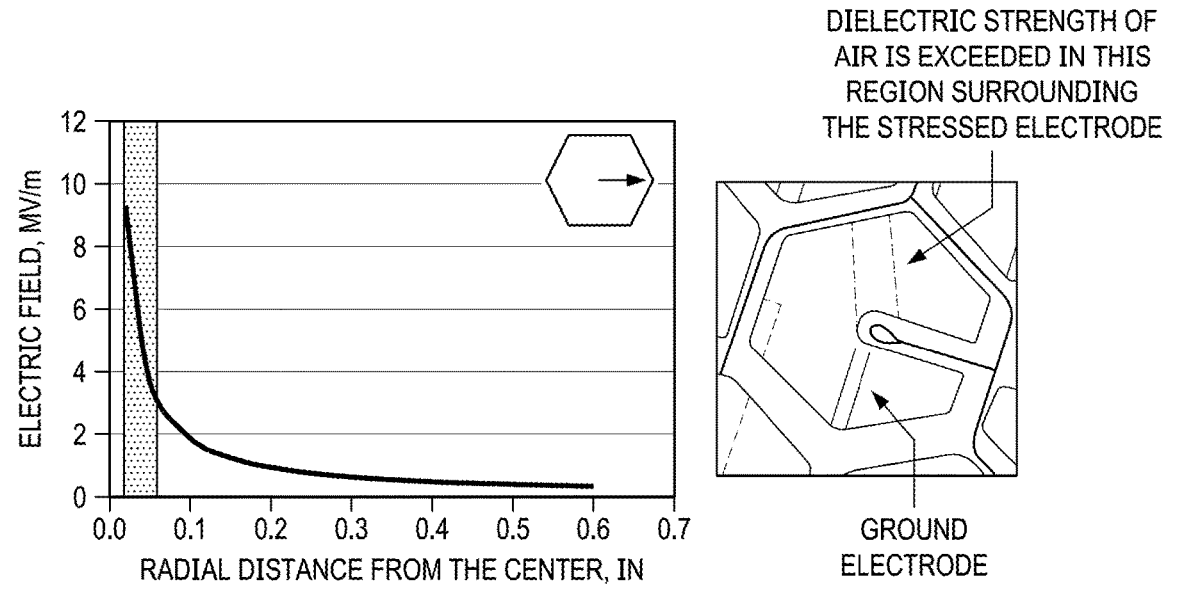
FIG. 3A shows electric field in a charger tube along the radial direction for an applied voltage of 16 kV. The electric field exceeds the dielectric strength of air in the shaded region.
Figure 3B:
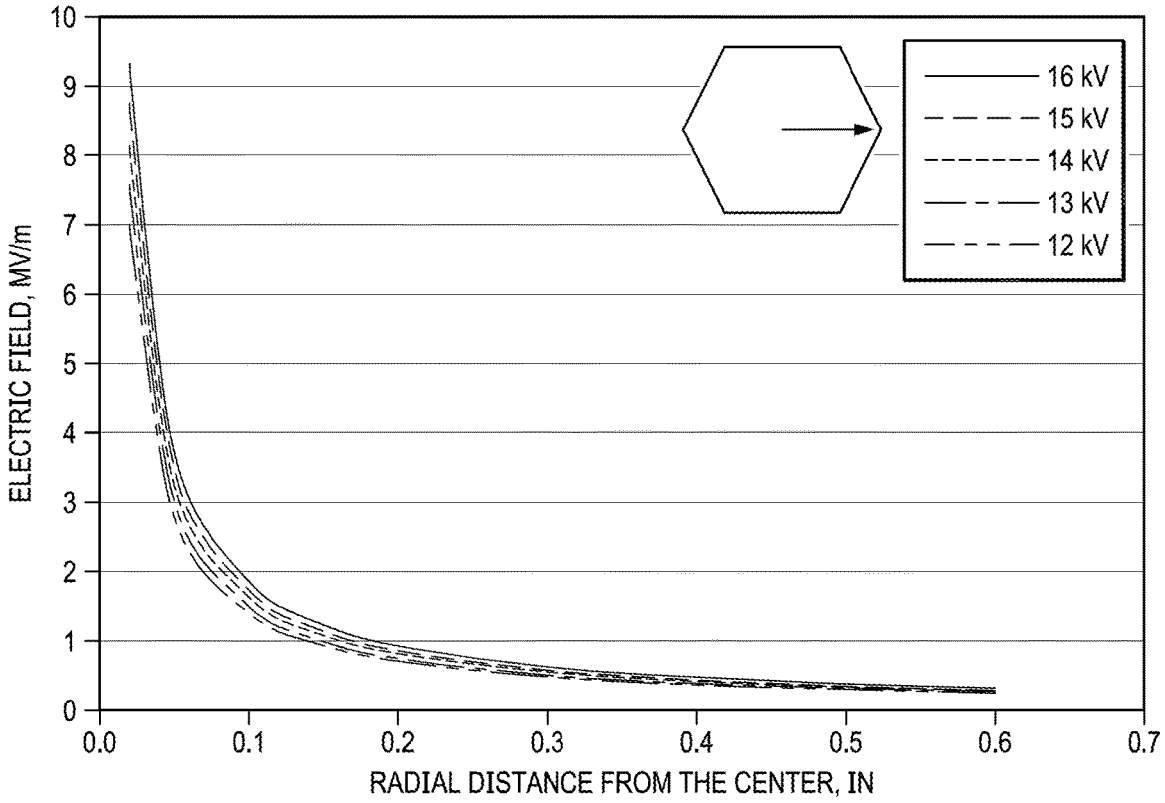
FIG. 3B shows the electric field in a charger tube along the radial direction for different applied voltages from 12 to 16 kV.

In the Particle Charging Stage 1 at step 14, the particles are imparted charges by a source of electrical discharge or a source of ionizing radiation. An electrical discharge is a flow of electrical charge through any matter. One type of electrical discharge is a corona discharge that is generated by maintaining a potential difference between two electrodes of non-uniform geometry such as a rod or a wire installed along the central axis of a tube. FIG. 2 shows at least a portion of a particle charging device 30, where a rod or wire 32 is connected to a high voltage source 34 and is called the stressed electrode, while the tube 36 having an opening 38 is connected to the ground and is called the ground electrode. Of course, the ground and high voltage source can be reversed, pulsed, or varied in time. The stressed and ground electrodes 32 in a corona discharge are made out of a conductive material. Examples of conductive material include metals or alloys such as stainless steel, copper, tungsten, etc. and conductive composites such as carbon fiber. The stressed electrode 32 can be in the form of a wire held under tension, rod, threaded rod, barb wire, rod with various protrusions, tube, etc. In some embodiments multiple stressed electrodes 32 may be installed within a single ground electrode. The ground electrode can be a tube 36 of any cross-sectional shape such as circular, hexagonal, square, rectangular, triangular, oval, etc. The ratio between the ground electrode inner diameter and the stressed electrode outer diameter for corona discharge can be 2.7:1 or higher. In the present invention, the range of ratios for stable discharge was found to be 20-83:1, wherein the ratio of 25-31:1 was preferred for particle charging. Other ratios such as 20:1, 30:1, 40:1, 50:1, 60:1, 70:1, 80:1, etc. would be sufficient and preferred in some cases. These ratios can be maintained independent of the overall dimensions (width, height, diameter, length, area, volume, etc.) of the grounded and stressed electrodes 32. This invention also includes a preferred ratio of the electrode area. The following ratio: ground electrode inner surface area: stressed electrode outer surface area should preferably be 416-6944:1. In some cases, other ratios such as 500:1, 600:1, 1000:1, 3000:1, 5000:1, 6500:1, etc., would be sufficient and preferred. The invention requires that this ratio be maintained regardless of the overall dimensions of the stressed and ground electrodes. One non-limiting embodiment of a device 30 to generate corona discharge is shown in FIG. 2. It is referred as the charger tube and consists of a rod 32 (0.039" diameter×6" length) and a tube 36 of hexagonal cross-section (0.612" side×6" length), which act as the stressed and ground electrodes, respectively. A high voltage source 34 is connected to the stressed electrode 32 and the applied voltage can be direct current (DC), pulsed DC, or biased alternating current (AC), such that the resultant electric field between the stressed and the ground electrode exceeds the dielectric strength of air (3 MV/m) and causes ionization of the air flowing through the opening 38 of the tube 36. Ionization is the process by which an atom or a molecule acquires a negative or positive charge by gaining or losing electrons to form ions. In the invention, the resultant electric field close to the stressed electrode exceeds the dielectric strength of air because of the logarithmic enhancement of the field as shown in FIG. 3A. In the invention, for an applied voltage of 16 kV, the electric field in air near the stressed electrode surface exceeds the dielectric strength of air (3 MV/m) for all radial distances less than 0.059". It is in this region that ionization mostly occurs. FIG. 3B shows the electric field strength for 1 kV increments from 12 kV up to 16 kV, wherein the dielectric strength of air is exceeded for radial distances smaller than those listed in Table 1. When air is flown through the charger tube, the particles in the air are charged unipolarly, i.e. positively or negatively depending on the polarity of the high voltage source connected to the stressed electrode. The particles in the air flowing through the charger tube can be charged bipolarly (positively and negatively), if the stressed electrode is connected to an AC high voltage source. Unipolar charging imparts charges of single polarity to the same particle while bipolar charging imparts charges of either polarity to the same particle. Unipolar charging imparts charging with higher efficiency than bipolar charging (wherein both positive and negative ions are generated in the same space) because there is no loss of charge due to recombination of oppositely charged ions. Therefore unipolar charging is preferable for used in combination with methods employing electric fields to agglomerate and/or deflect particles.

Table 1 includes the data for FIG. 3B.

| Voltage, kV | Electric Field Exceeds Dielectric Strength at Radial Distances Smaller Than |
|---|---|
| 12 | 0.046 in |
| 13 | 0.050 in |
| 14 | 0.053 in |
| 15 | 0.057 in |
| 16 | 0.061 in |

Figure 4:
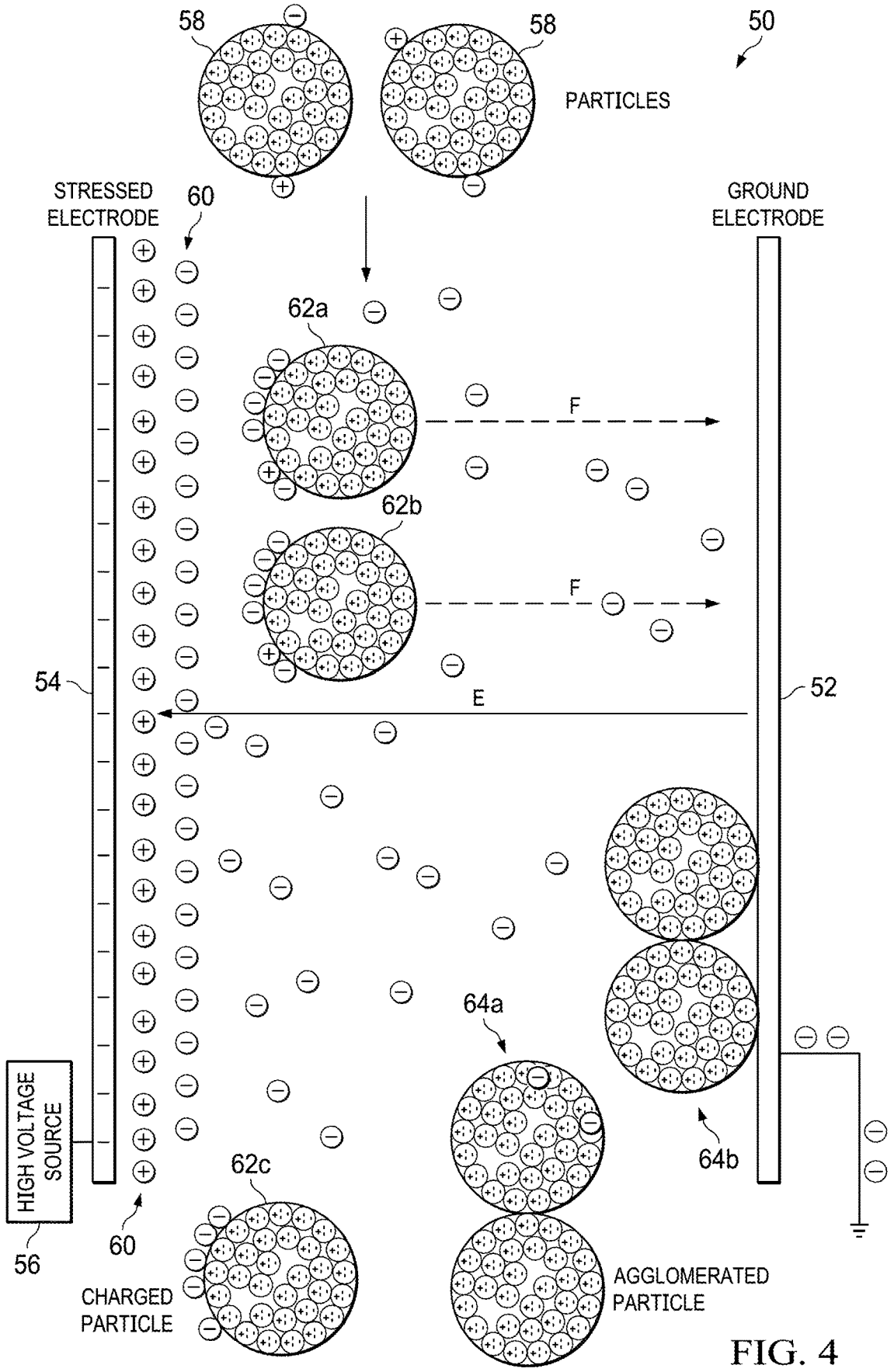
FIG. 4 shows a side, cross-sectional view of the mechanism of unipolar charging achieved in a charger tube connected to a negative voltage source.

FIG. 4 shows a side, cross-sectional view of a unipolar charging device 50 achieved in the charger tube 52 wherein the stressed electrode 54 is connected to a negative voltage source 56 (negatively biased AC or negative pulsed DC or negative DC). The particles 58 entering the charger tube 52 have some charge due to charging processes occurring in nature. The ionization of air occurs in the charger tube 52 because the electric field 60 close to the stressed electrode 54 exceeds the dielectric strength of air as described earlier. The positive ions (+) 60 travel very short distances towards the stressed electrode 54 as they are pulled by the electrostatic forces due to negative charges present on the stressed electrode 54, along the Field (E) generated by the negative voltage source 56. The negative ions (−) travel relatively longer distances towards the ground electrode 52 due to the Electrostatic Force (F), as they are pulled along the Field (E) generated by the negative voltage source 56. Therefore, the negative ions (−) have a greater probability to collide with the particles and impart negative charges. Due to the favorable distribution of negative charges in the charger tube 52 connected to a negative voltage source 56, the dust particles 62*a,b,c* are predominantly charged negatively (i.e., are generally unipolar favoring negative charges). As used herein, "predominately" means "more than half" and therefore includes any percentage more than 50%, e.g., 55%, 60%, 65%, 70%, 75%, 80%, 85%, 90%, 95%, or 100%. The negatively charged particles continuously drift towards the ground electrode 52 in the presence of the Field (E), when generated by a negative DC voltage source (constant in magnitude and direction). When the Field (E) is generated by a negatively biased AC voltage source, the negatively charged particles 62*a,b,c* oscillate in response to the time-varying AC field. In this invention, a peak-peak change of 1 kV with frequencies ranging from 10 Hz-60 kHz and 100% duty cycle is preferred for the time-varying AC field. During their oscillating motion in the AC field, a fraction of the charged particles agglomerate 64*a,b* upon collision with each other. The probability of interparticle collisions and agglomeration is increased due to the AC field. Another fraction of the charged particles migrate towards the ground electrode surface due to Electrostatic Force (F), where they are discharged upon contact with the surface. These particles stick to each other and the ground electrode surface due to van der Waals forces. Most particles leave the charger tube with negative charges because they are carried away by the flowing air.

Figure 5A:
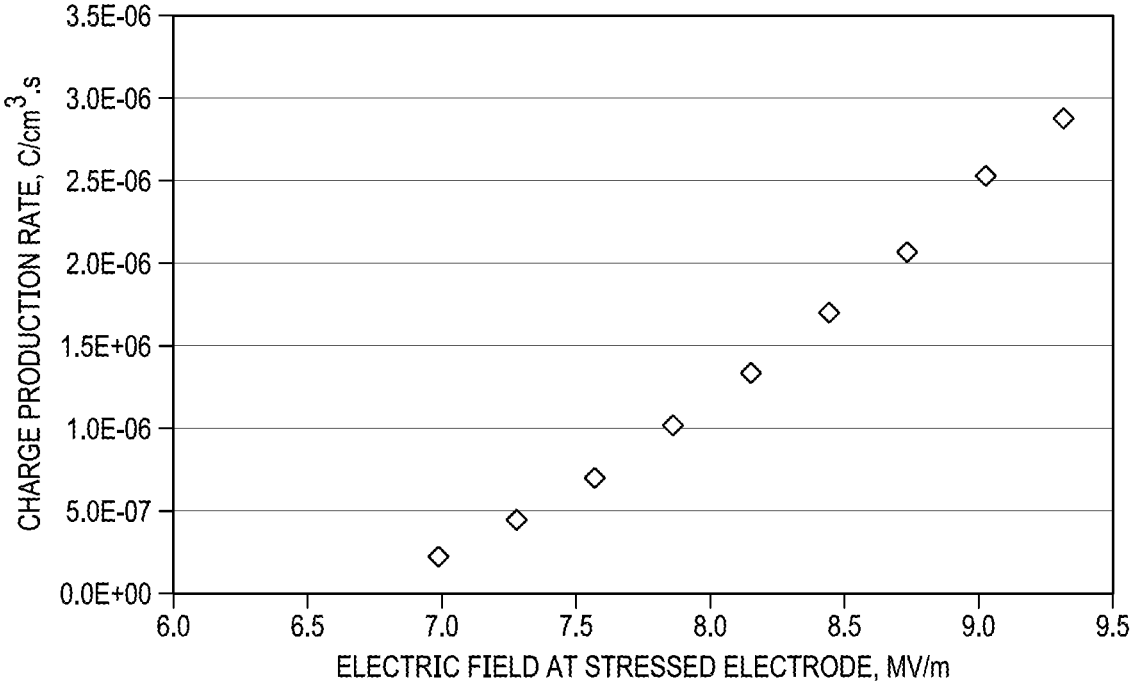
FIG. 5A shows experimentally determined charge production rate in a charger tube with hexagonal cross-section for different electric field values.
Figure 5B:
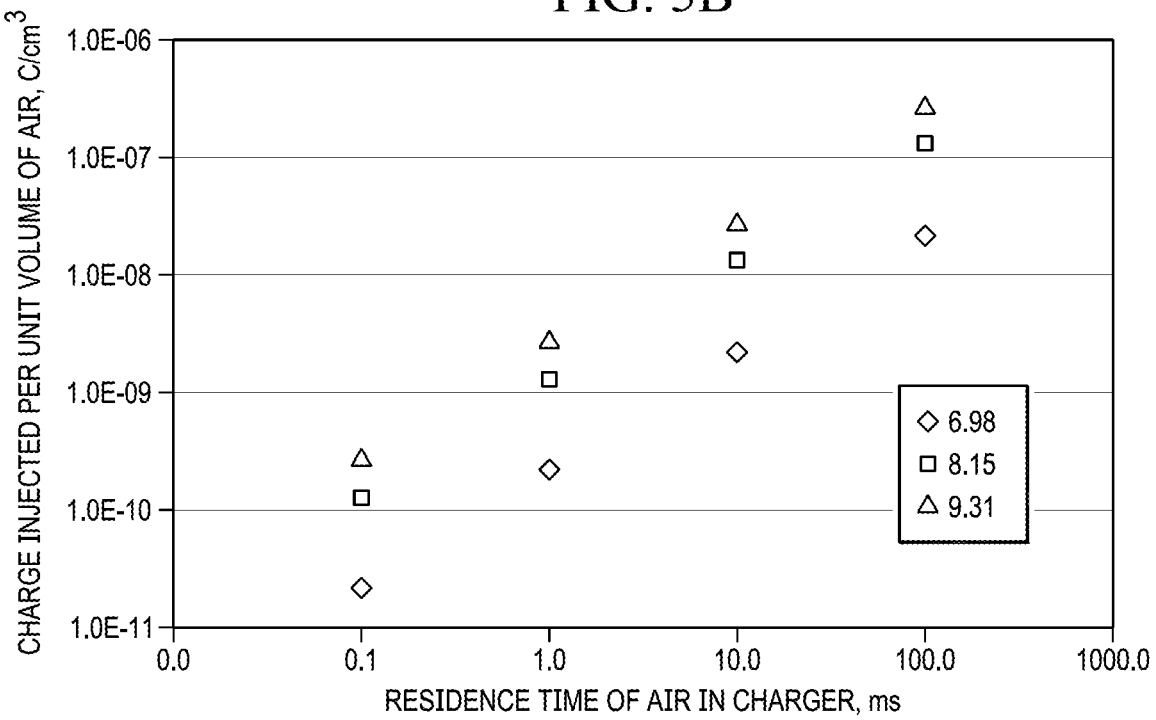
FIG. 5B shows charge injected per unit volume of air based on residence time for three different values of electric field at the stressed electrode (6.98 MV/m, 8.15 MV/m and 9.31 MV/m).

The experimentally determined charge production rate (coulombs/$cm^3$·s) for a charger tube with hexagonal cross-section is shown in FIG. 5A. The charge production rate increases with increase in the electric field strength at the stressed electrode. It is to be noted that the charge generation also depends on the humidity of air. The data shown in FIG. 5A was generated at ambient conditions present in the testing area—63% relative humidity and 22.8° C. temperature. In addition to the electric field, the residence time of air and particles in the charger tube also influence the charging of the particles. FIG. 5B shows the charge injected per unit volume of air as a function of the residence time ranging from 0.1 ms to 100 ms. Independent of residence time, these data indicate that for the Particle Charging Stage 1 to function effectively, between $10^{-11}$ and $10^{-6}$ coulombs should be injected into every $cm^3$ of air passing through the tube. The preferable range is $10^{-7}$ to $10^{-6}$ coulombs of charge injected per $cm^3$ of air passing through the tube. The charge injected per unit volume of air is generated for three different values of electric field strength at the stressed electrode. The residence time of the dust particles in the charger tube can be increased by reduction of air flow per tube or by elongation of the electric field along the direction of the flow.

Prolonged operation of the charger tube can result in accumulation of particles along the tube surface, which can reduce charging effectiveness and eventually lead to unstable operation due to sparking. The present invention includes a means to reduce such accumulation of particles. Application of negatively biased AC voltage (12-16 kV peak, peak-peak change of 1 kV, 10 Hz-60 kHz) to the stressed electrode is the preferred embodiment to reduce accumulation of particles in the charger tube connected to a negative voltage source. Therefore another advantage of the present invention is the application of negatively biased AC voltage to enable long term operation of electrostatic charging devices. An approach to prevent sparking in the charger tube is to internally line the ground electrode with a dielectric film and/or to encapsulate the stressed electrode in a dielectric tube. The dielectric material can be any material with dielectric strength greater than 3 MV/m. These materials include plastics (Teflon, PEEK, etc.), quartz, and ceramics (oxides, carbides, nitrides, etc). This dielectric-lined charger tube can be operated in the pulsed DC mode (12-16 kV peak with <1 ms pulse width) or biased AC mode (12-16 kV peak, peak-peak change of 1 kV, 10 Hz-60 kHz) for electrostatic charging of particles.

Particle Charging Stage 1 Geometry Considerations

Figure 6:
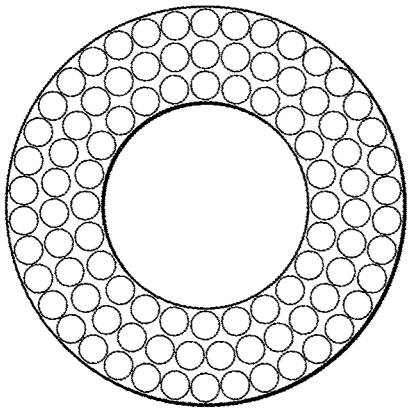
FIG. 6 shows the benefits of hexagonal cross-section over circular cross-section in the construction of the Particle Charging Stage 1 for turbine engine intake.
Figure 6:
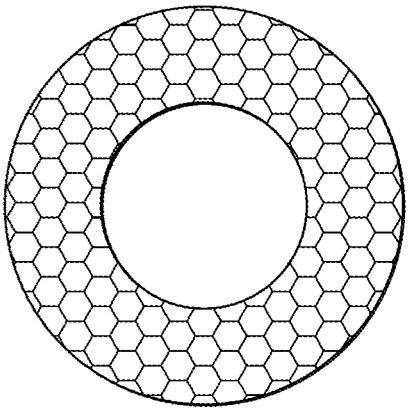

For turbine engine applications a single charger tube may be used or multiple charger tubes may be arranged, such that the particles in the large intake air volume/flow can be sufficiently accommodated and charged, according to the aforementioned specifications. These charger tubes can be packed together to form a bundle similar in shape to the annular opening of the IPS. These charger tubes can have any cross-sectional shape such as a circular, hexagonal, square, triangular, rectangular, etc. and can be arranged in any layout but they should provide the greatest open area for flow to ensure low pressure drop in intake air flow for turbine engine applications. Unlike circular cross-section, other cross-sections such as circular, square, triangular, rectangular, etc. can be packed together to have common or shared walls, thereby reducing material required to build them and the total weight. A comparison between circular and hexagonal cross-section geometries shown in FIG. 6 outlines the multiple benefits that the hexagonal cross-section tube geometry provides. The hexagonal cross-section is represented as a honeycomb structure with common or shared walls. The main benefits are greater open surface area and lesser weight. Higher open surface area results in lower pressure drop in intake airflow and lesser weight ensures that more engine power is available for useful work. The charger tube with hexagonal cross-section thus provides major benefits over circular cross-section charger tube in turbine engine applications.

Particle Agglomeration Stage 2

Figure 7:
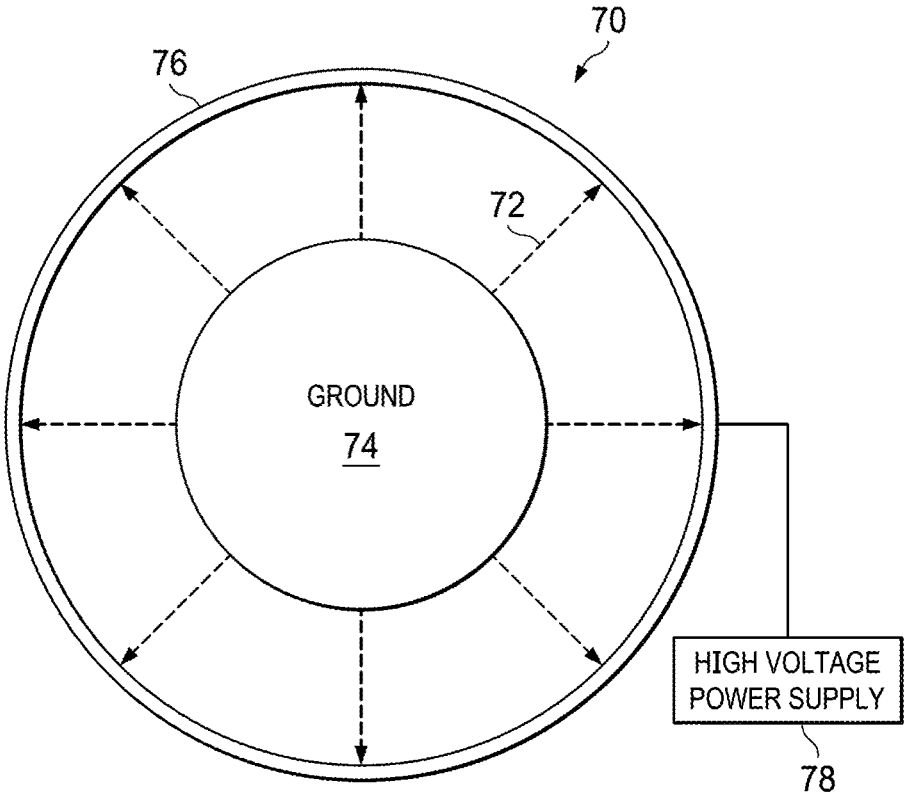
FIG. 7 shows an embodiment of a device to promote agglomeration of charged particles using electric field.

Air containing unipolarly charged dust particles from the Particle Charging Stage 1 can be flown into the Particle Agglomeration Stage 2. The goal of this Stage is to agglomerate the incoming charged dust particles and thereby enhance IPS separation efficiency, since the IPS separates larger particles more efficiently than finer particles. The Particle Agglomeration Stage 2 can accomplish agglomeration by the use of electric fields and/or by the use of turbulent mixing features. The electric field is distinct from the one used in Particle Charging Stage 1. One embodiment of the use of electric field is shown in FIG. 7. A charging device 70 shows an electric field 72 that is maintained between an inner surface 74 and outer surface 76 by the application of high voltage 78. The inner surface 74 and outer surface 76 serve as electrodes to generate the electric field 72 for promotion of agglomeration. It is to be noted that there is no electrical discharge in this device since the electric field is maintained below the dielectric strength of air to prevent ionization. For an inner surface of diameter 1.325" and an outer surface of diameter 3", voltages up to 41 kV can be applied without causing an electrical discharge. A constant electric field can be applied to cause the charged particles to move transverse to the air flow, i.e., towards either of the surfaces as they flow in the axial direction. During the motion of the charged particles in the electric field, they can collide, stick to each other, and agglomerate. An oscillating (10-500 Hz, 41 kV peak) or pulsed electric field (<1 ms peak width and 41 kV peak) can also be applied to cause the particles to oscillate or move spontaneously in the direction transverse to air flow. The induced oscillations are of different amplitudes for different particle sizes resulting in increased probability of collision of charged particles, thereby promoting their agglomeration.

Figure 8A:
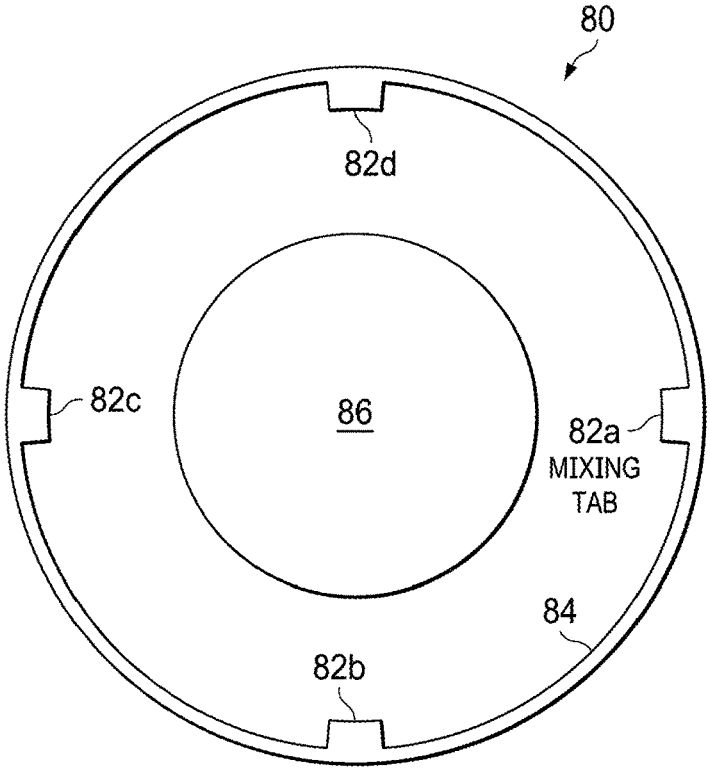
FIG. 8A shows an embodiment of the Agglomeration Stage 2 with the mixing tabs located 90 degrees apart from each other.
Figure 8B:
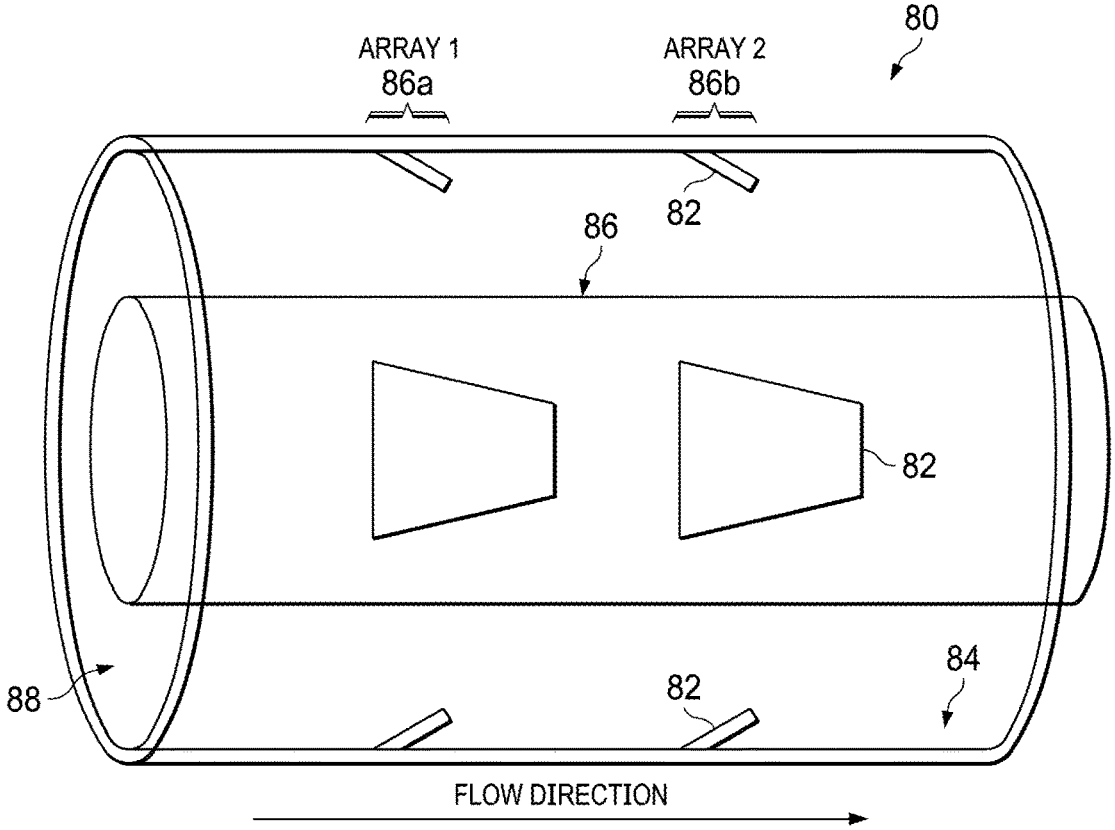
FIG. 8B shows an embodiment of the Agglomeration Stage shown at 90 degrees from the view in FIG. 8A.
Figure 8C:
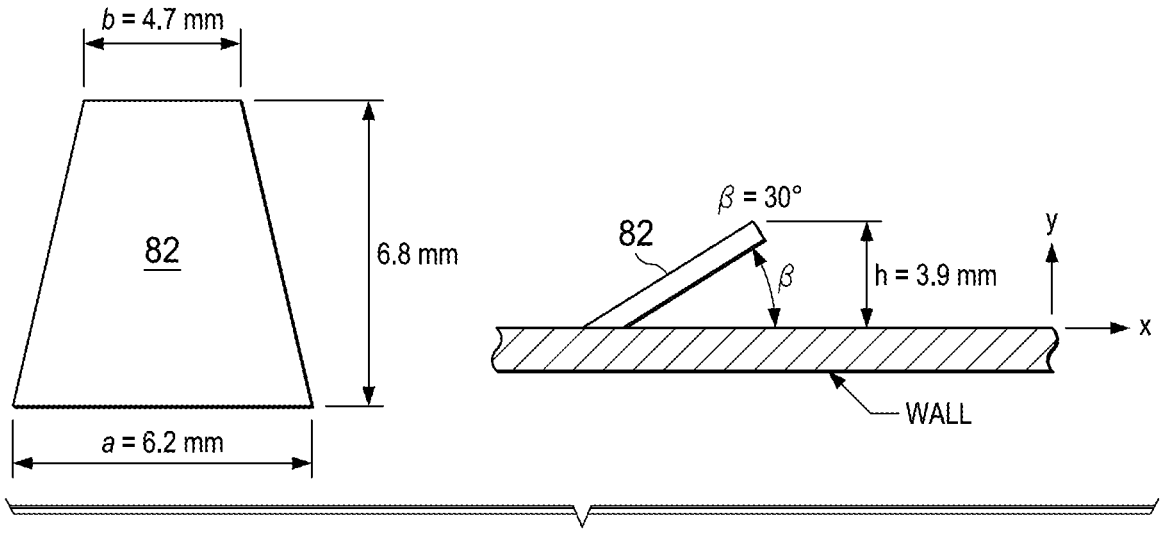
FIG. 8C shows specifications of mixing tab geometry and dimensions.
Figure 8D:
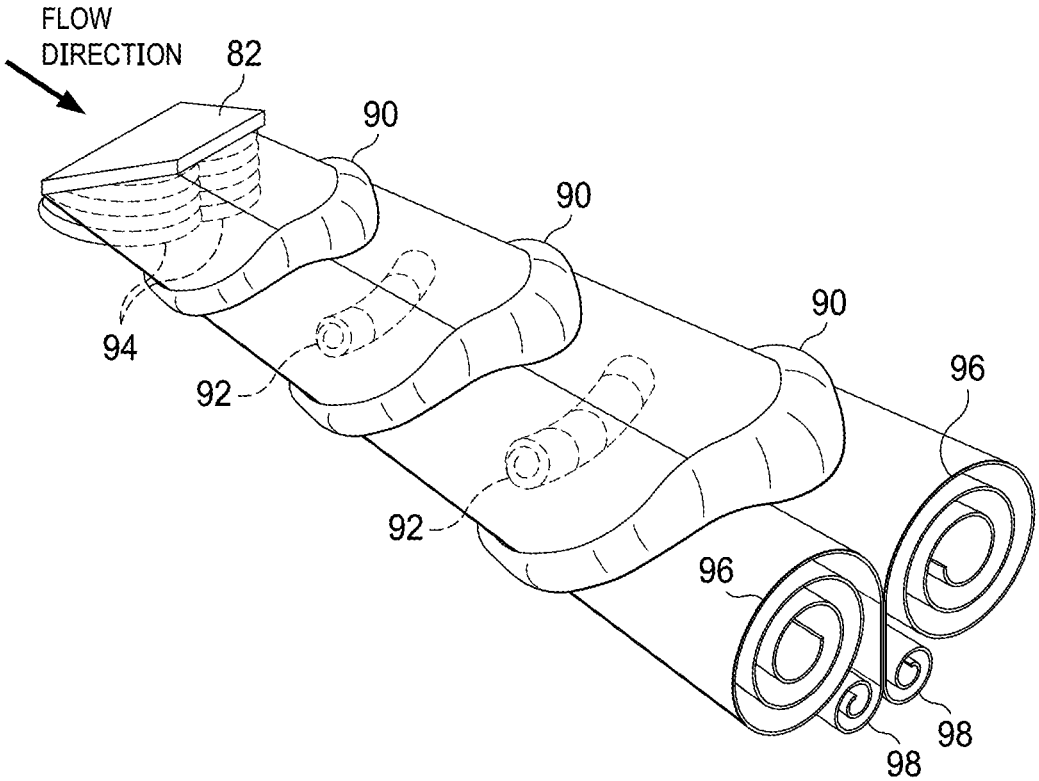
FIG. 8D shows the flow features generated by a single high efficiency vortex mixing tab.
Figure 8E:
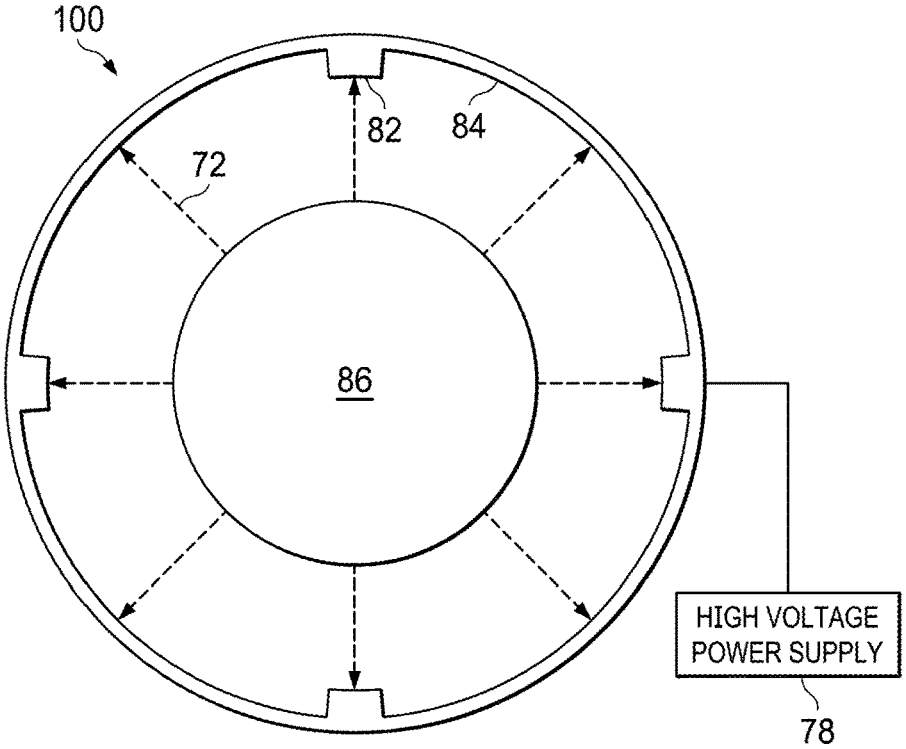
FIG. 8E shows the geometry of the Agglomeration Stage 2 with the mixing tabs and the application of the electric field.

Another embodiment of Particle Agglomeration Stage 2 is the generation of turbulence in the airflow containing charged dust particles to promote interparticle collision and agglomeration. FIGS. 8A and 8B shows an agglomeration device 80, that shows an end-view (FIG. 8A) and a cross-sectional side view (FIG. 8B) of the agglomeration device 80. FIG. 8A shows trapezoidal mixing tabs 82*a,b,c,d* installed along the outer wall 84 in relation to the inner surface 86. FIG. 8B shows a pair of arrays 86*a,b* that have mixing tabs 82 placed at 90° with respect to each other in the opening 88 of the agglomeration device 80 or portion of the device. The tabs 82*a,b,c,d* are inclined at 30° relative to the tube walls 84, 86 in the direction of the flow within the opening 88. FIG. 8C shows some preferred specifications and dimensions for mixing tabs with trapezoidal geometry. While the mixing tabs 82 are depicted as being trapezoidal, the mixing tabs 82 can have any shape, e.g., square, rectangular, triangular, polygonal, circular, oval, etc. FIG. 8D shows different types of vortices formed by a tab 82 in relation to the fluid flow. FIG. 8D shows that various vortices are generated in the airflow to promote mixing by the mixing tab 82, these different vortices are, e.g., hairpin vortices 90, reverse vortices 92, transverse vortices 94, primary counter-rotating vortex pairs 96 (CVP), primary counter-rotating vortex pairs 98, etc. The mixing is found to occur in three different scales: micro-mixing due to diffusive transfer, meso-mixing due to velocity fluctuations in eddies, and macro-mixing by large scale flows. For efficient mixing of micron-sized bipolarly charged particles, meso- and macro-mixing are the relevant scales. The hairpin vortices contribute majorly to meso-mixing and the tab geometry contributes to macro-mixing. There are two types of mixing in the tab wake: (i) mixing between the ambient fluid and the wake, which is the region spanned by the CVP and hair pin structures, and (ii) mixing inside the wake. The mixing between the wake and the ambient air flow is attributed to hairpin vortices and in the near-wake region is due to the CVP. The vortex mixing of differently charged particles results in increased probability of collisions between the oppositely charged particles, which are drawn to each other by their opposing charges. The greater number of collisions results in a greater degree of agglomeration between charged particles. A drawback of use of turbulent mixing is pressure loss in the intake airflow and therefore a tradeoff study is recommended for selection of the mixing tab dimensions and inclination, layout pattern and inter-tab distance. Another embodiment of the Particle Agglomeration Stage 3 (100) is the combination of electric field 72 formed by high voltage power supply 78 and mixing tabs 82 in the same volume as shown in the end view of FIG. 8E, that includes outer wall 84 and inner wall 86.

Particle Deflection and Separation Stage 3

Figure 9:
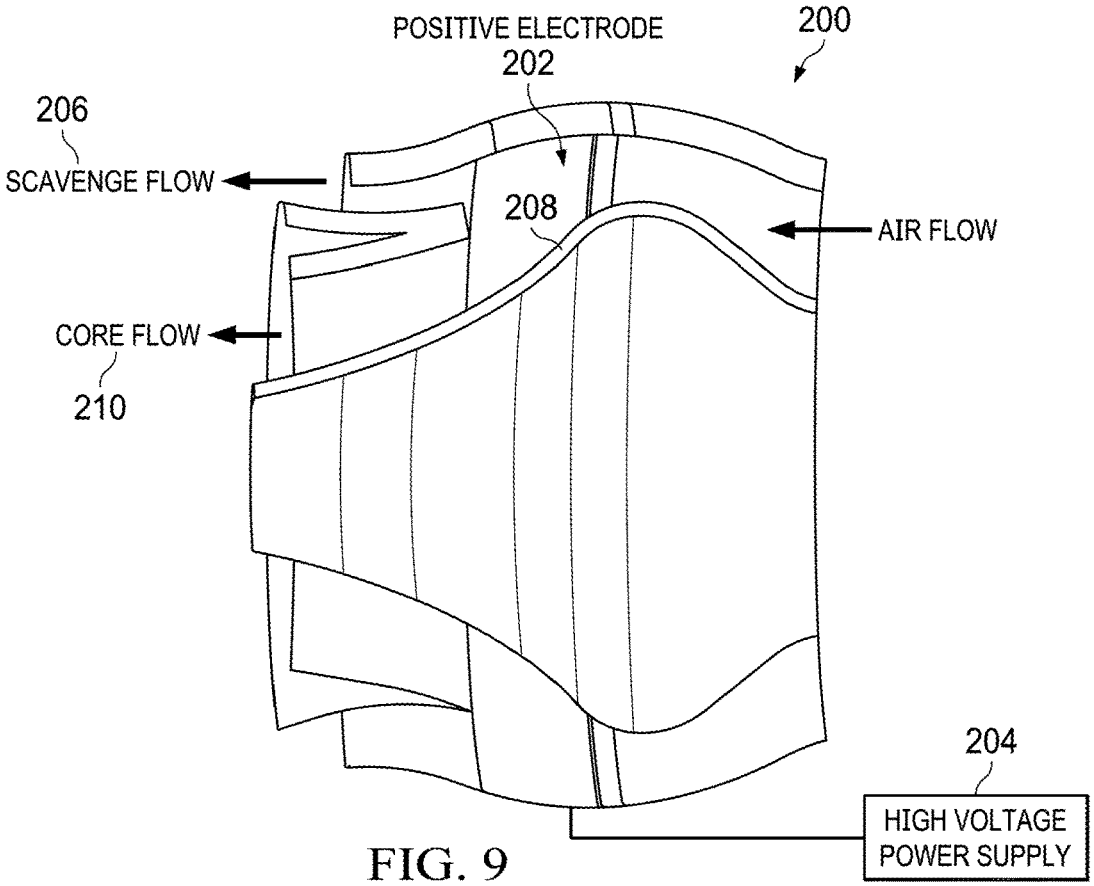
FIG. 9 shows an example of an IPS with deflection electrodes.

Air containing the charged and agglomerated dust particles is then flown into the Particle Deflection and Separation stage. This stage is integrated into an inertial separation device 200 such as the IPS as shown in FIG. 9. The outer surface 202 of the IPS 200 is maintained at a positive potential by connecting it to a high voltage power supply 204. It is to be noted that there is no electrical discharge in this stage since the electric field is maintained below the dielectric strength of air to prevent ionization. Negatively charged particles entering the field experience an electrostatic force of attraction towards the outer surface 202 and are deflected towards the scavenge flow path 206. Alternatively, the inner surface 208 can be maintained at a negative potential, while the outer surface 202 is grounded, or vice versa. In this case, the negatively charged particles would be repelled away from the inner surface 208 and towards the scavenge flow path 206. Alternatively, if the particles entering the IPS 200 carry predominantly positive charge, the outer surface 202 can be maintained at a negative potential while the inner surface 208 is grounded or the inner surface 208 can be maintained at a positive potential, while the outer surface 202 is grounded. The whole surface or part of the inner and outer surfaces (208, 202) of the IPS 200 can serve as the deflection electrodes, wherein one of them is maintained at a high potential while the other is grounded. The electrode maintained at a high potential should be electrically isolated from the rest of the IPS 200 or the engine. Electrical isolation can be achieved by use of dielectric materials with dielectric strength greater than that of air such as PEEK or ceramics such as carbides, nitrides or oxides. The goal of this stage is to deflect the charged particles into the scavenge flow 206 using an electric field thereby reducing the number of particles flowing into the core flow 210, which results in an improvement in the IPS 200 separation efficiency.

Voltage Considerations

Figure 10:
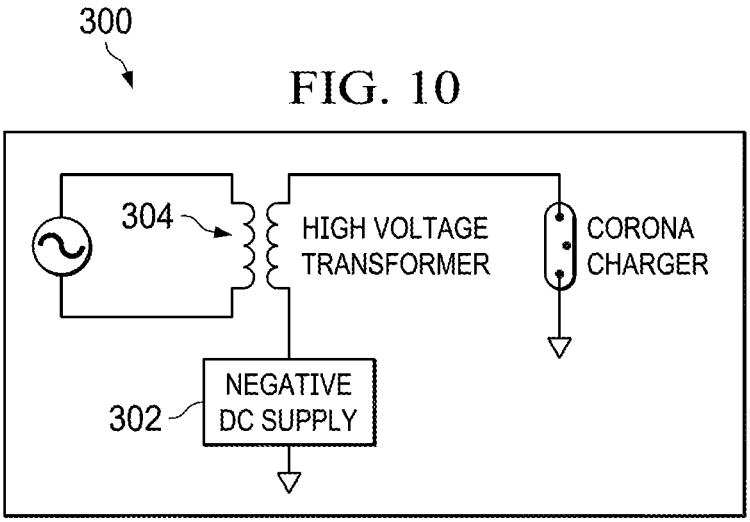
FIG. 10 shows the electrical circuit used to generated a negatively biased AC waveform.
Figure 11:
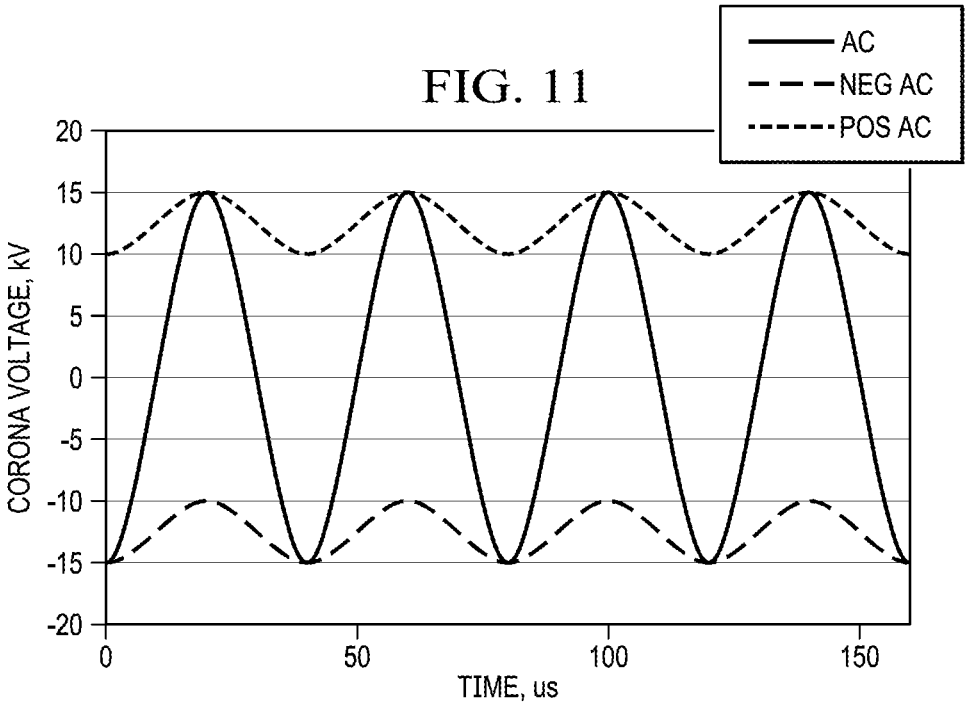
FIG. 11 shows the biased high voltage AC waveforms generated in the present invention and its comparison with the typical AC waveform. The shaded region indicates the voltages at which ionization occurs. Pos AC: Positively biased AC waveform. Neg AC: Negatively biased AC waveform. AC: Alternating current waveform.

As shown in FIG. 10, a device 300 used to create the biased AC waveform is used with the present invention (see FIG. 11) and is generated by combining a negative DC power supply 302 with a high voltage AC transformer 304. The lead of the negative DC power supply 302 is connected to the ground connection of the secondary coil of the high voltage transformer 304. For example, the negative DC power supply is set to 12.5 kV, while the high voltage transformer is set to oscillate at 2.5 kV peak-peak. The resulting waveform oscillated between 10 kV and 15 kV and is labeled as Neg AC in FIG. 11. The negatively biased AC waveform is used to drive the charger tubes in the Particle Charging Stage 1. When no DC power supply is used in the circuit, the typical AC waveform is obtained that oscillates between 15 kV and −15 kV. The minimum voltage required for ionization in the charger tube (0.612" side hexagonal cross-section tube with 0.039" diameter rod; 6" long) is about ±5.2 kV. The shaded region in FIG. 11 indicates the voltages that exceed the ionization voltage. The biasing of the AC waveform ensures that the output voltage is always greater than the ionization voltage, whereas the output voltage for the entire AC cycle is not within the ionization region. Therefore, during a part of the AC cycle, the ions and electrons are not generated, whereas they are generated during the entire cycle of the biased waveform (Neg AC). Charging of dust particle is improved because there is continuous generation of ions and electrons during the entire cycle. If the negative DC power supply 302 in FIG. 10 is replaced with a positive DC power supply, the positively biased waveform labeled as Pos AC is obtained. The positively biased AC waveform can be used in the Agglomeration Stage 2 and the Deflection Stage 3.

Example 1

In laboratory testing, a bundle of six charger tubes with a circular cross-section (Φ1"×6" long), a 3" long agglomeration field (Φ3"×Φ1.325" similar to FIG. 7), and a 1.2" long deflection field was used with a scaled-down version (1/1sth) of a full-scale IPS (rated for 14 lb/s turboshaft engine) to demonstrate improvement in separation efficiency. Dust laden air is flown through the charger tubes, agglomeration and deflection field, and the IPS. Within the IPS, the intake flow is split between the core flow and scavenge flow paths and the respective flows enter the core and scavenge filters. The core and scavenge flows were maintained at 400 SCFM and 80 SCFM, respectively. The average dust concentration in the intake air was 49-67 mg/m$^3$. The test duration was 30 min. The dust in the air flow is captured using filter elements with fine pore size (0.03 um or 1 um). The IPS separation efficiency is calculated as:

[(Dust injected into airflow−Dust captured by core filter)/Dust injected into air flow]×100

Figure 12:
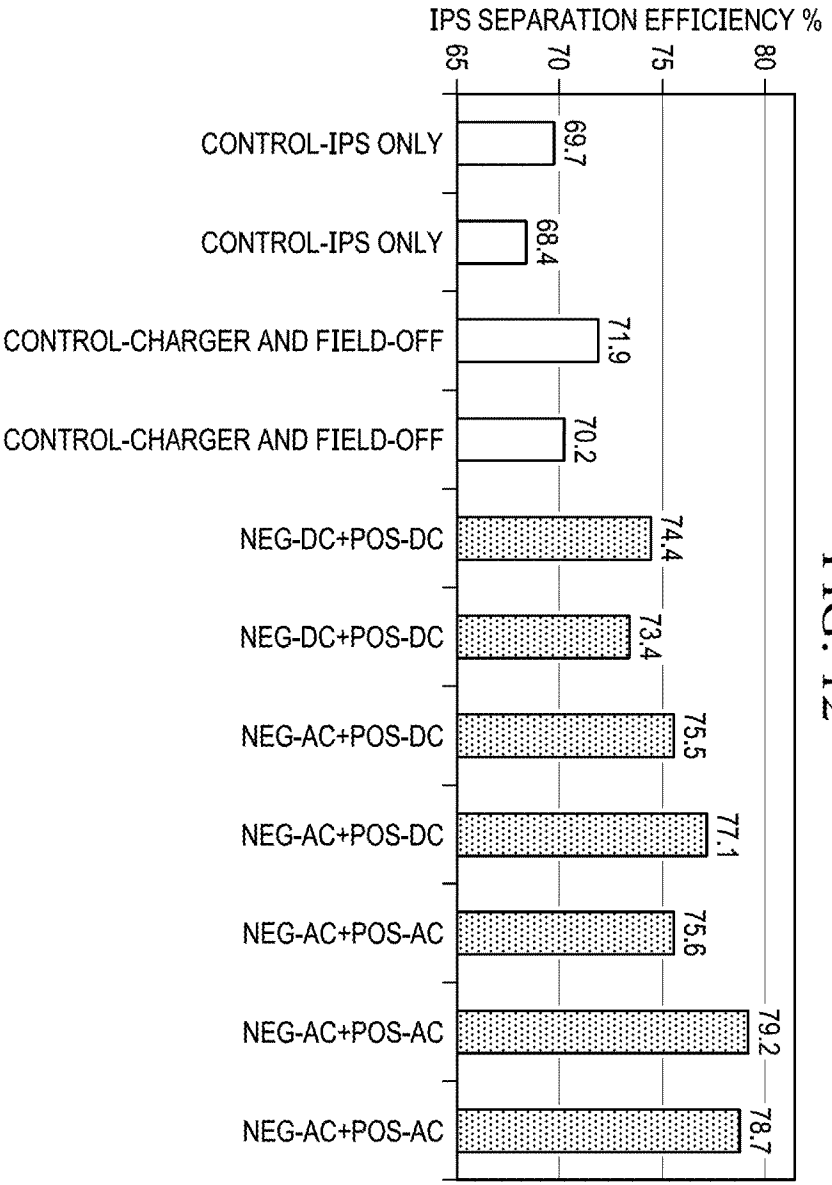
FIG. 12 shows improvement in separation efficiency achieved by operation of charging stage, agglomeration field, and deflection field.

The improvement in separation efficiency of the IPS by electrostatic enhancement is shown in FIG. 12. The Control-IPS only runs were obtained with only the IPS in the test setup. The Control-Charger and Field-Off runs were obtained with all components in the system but the charger tube, agglomeration field, and the deflection field was not powered on. The Neg-DC+Pos-DC runs were obtained with the charger tube operated in negative DC mode, while the agglomeration and the deflection field was operated in positive DC mode. The Neg-AC+Pos-DC runs were obtained with the charger tube operated in negative biased AC mode, while the agglomeration and the deflection field was operated in positive DC mode. The Neg-AC+Pos-AC runs were obtained with the charger tube operated in negative biased AC mode, while the agglomeration and the deflection field was operated in positive biased AC mode. Accumulation of dust (0.5-1.5 g) was observed for all tests wherein the charger tube was powered on; lower accumulation of dust was seen in Neg-AC runs than in Neg-DC runs. On average the separation efficiency is seen to improve from 70.1% (all control runs) to 74% (all test runs), with the highest efficiency of 79.2% observed in the Neg-C+Pos-AC run.

Table 2 shows the data for FIG. 12.

| Test | Stage 1 Voltage (−kV) | Stage 2 Voltage (+kV) | Stage 3 Voltage (+kV) |
|---|---|---|---|
| Control-IPS | 0 | 0 | 0 |
| Control-IPS only | 0 | 0 | 0 |
| Control-Charger&Field Off | 0 | 0 | 0 |
| Control-Charger&Field Off | 0 | 0 | 0 |
| Neg-DC + Pos-DC | 11.9 | 13.0 | 13.0 |
| Neg-DC + Pos-DC | 12.5 | 13.0 | 13.0 |
| Neg-AC + Pos-DC | 12.2 to 11.1 (46 kHz) | 12.0 | 12.0 |
| Neg-AC + Pos-DC | 12.2 to 11.1 (46 kHz) | 12.7 | 12.7 |
| Neg-AC + Pos-AC | 12.2 to 11.4 (46 kHz) | 11.4 to 12.4 (46 kHz) | 11.4 to 12.4 (46 kHz) |
| Neg-AC + Pos-AC | 12.0 to 11.2 (48 kHz) | 11.3 to 12.3 (42 kHz) | 11.3 to 12.3 (42 kHz) |
| Neg-AC + Pos-AC | Similar to the values in above two rows | | |

Example 2

Figure 13:
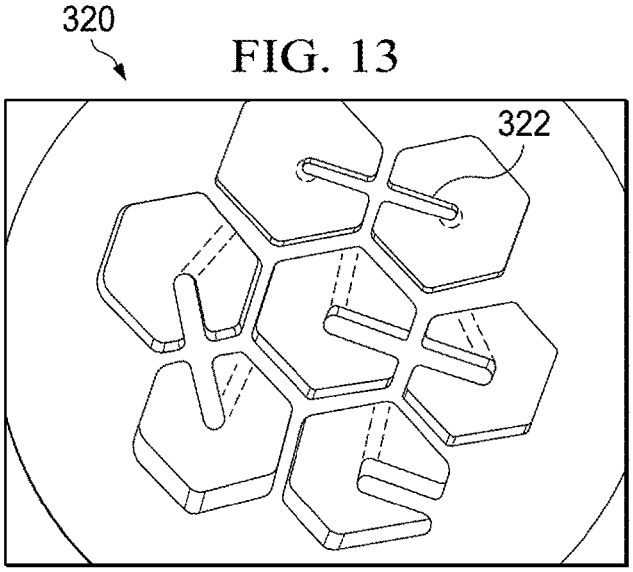
FIG. 13 shows corona discharge formation in Particle Charging Stage 1 consisting of a bundle of seven chargers tube of hexagonal cross-section.
Figure 14:
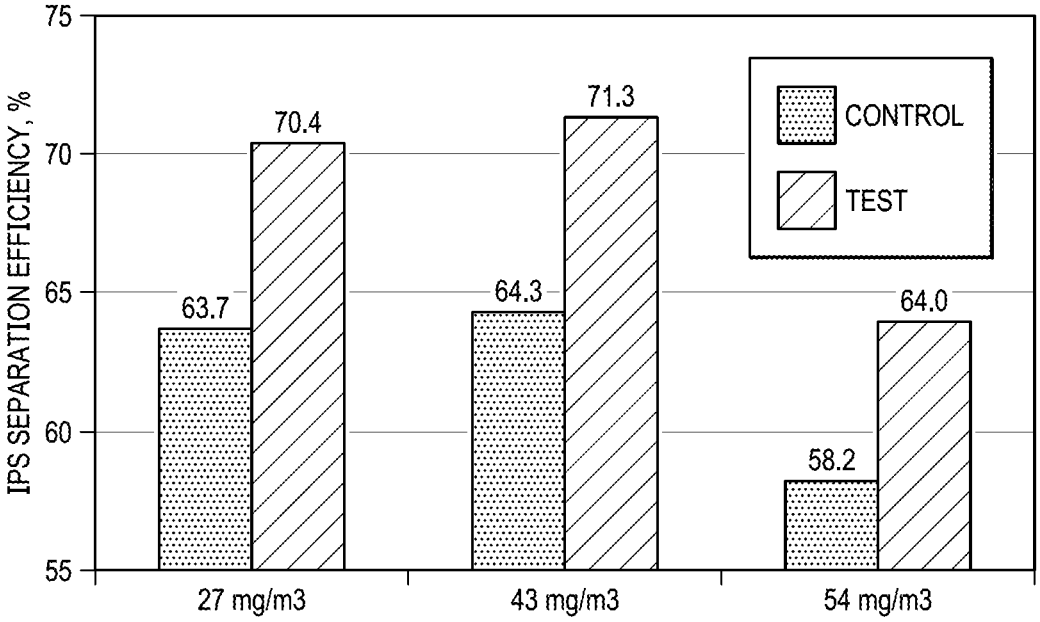
Figure 15:
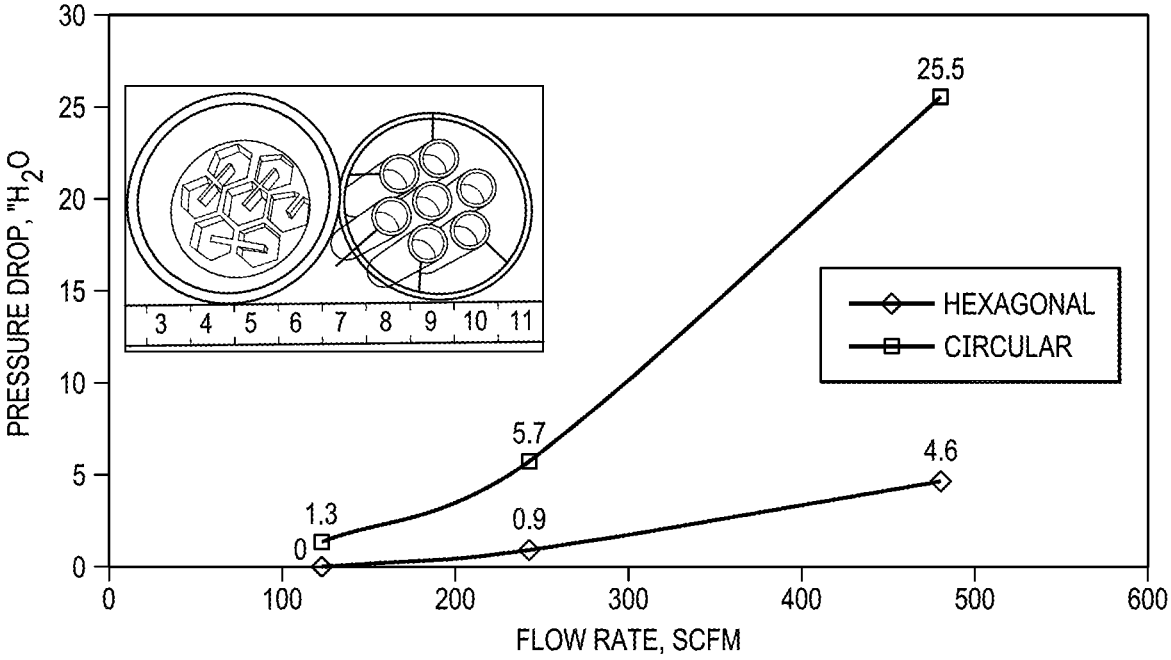
FIG. 15 shows measured reduction in pressure drop over a 6" length achieved by hexagonal cross-section as compared to circular cross-section. Circular dimensions: 0.97" ID×6" L. Hexagonal dimensions: 1.06"×6"L. Both bundles were connected to an intake nozzle (3" diameter).

In similar laboratory testing, a Particle Charging Stage 1 containing seven charger tubes of hexagonal cross-section and an Agglomeration Stage 2 and Deflection Stage 3 was used with a scaled-down version of the full-scale IPS mentioned above. The hexagonal tube (0.612" side×6" length) was grounded while the 0.039" diameter rod was used as the high potential electrode. FIG. 13 shows discharge formation in Particle Charging Stage 1 consisting of a bundle of seven chargers tubes 320 of hexagonal cross-section, and the rods used as the high potential electrodes 322. The Agglomeration Stage 2 (Φ3"×Φ1.325" similar to FIG. 7) was 6" long and the Deflection Stage 3 was 1.2" long. In these tests the concentration of dust in the intake air flow was varied from 27 mg/m$^3$ to 54 mg/m$^3$. The core and scavenge flows were maintained at 400 SCFM and 80 SCFM, respectively. The test duration was 30 min. All tests were conducted with the Particle Charging Stage 1 charger tubes operated in a negative biased AC mode, while the Agglomeration Stage 2 and Deflection Stage 3 was maintained in the positive biased AC mode. The results from these tests are shown in FIG. 14. An improvement in IPS separation efficiency is observed in all cases from low to high concentration values. The pressure drop across two bundles of charger tubes containing seven tubes of circular and hexagonal cross-sections was measured for three different flow rates. The results shown in FIG. 15 indicate that a reduction of 5.6 times is obtained in pressure drop with the hexagonal design. This difference in pressure drop is significant in application of electrostatic devices for protection of turbine engines because inlet pressure loss causes a reduction in power and cycle efficiency of the engine.

Table 3 is the data for FIG. 14.

| Test | Stage 1 Voltage (−kV) | Stage 2 Voltage (+kV) | Stage 3 Voltage (+kV) |
|---|---|---|---|
| Control-27 | 0 | 0 | 0 |
| Control-43 | 0 | 0 | 0 |
| Control-54 | 0 | 0 | 0 |
| Test-27 | 14.5 to 13.7 (51 kHz) | 10.0 to 9.1 (41 kHz) | 10.0 to 9.1 (41 kHz) |
| Test-43 | 14.3 to 13.6 (44 kHz) | 10.3 to 9.1 (40 kHz) | 10.3 to 9.1 (40 kHz) |
| Test-54 | 14.5 to 13.8 (48 kHz) | 10.4 to 8.9 (40 kHz) | 10.4 to 8.9 (41 kHz) |

The multi-stage electrostatic enhancement process described above can be connected to a sensor for the activation or modulation of individual stages depending on the concentration of dust in the intake air. A sensor capable of estimating particle concentration, particle size range, and/or chemical composition of particles in the air flow can be used. The sensor can be based on techniques such as Raman Spectroscopy and Laser Induced Breakdown Spectroscopy. The particle sensor data can aid in tuning of the Particle Charging, Particle Agglomeration, and Particle Deflection. A particle sensor that provides information on the charging state of the particles can also provide feedback to the overall process to determine the charging voltage polarity, waveform, and frequency and deflection field polarity, and frequency. The above discussed particle sensors can serve as part of aircraft crew or personnel notification system.

Inlet particle separators only prevent 60-70% of fine dust particles (1-80 μm) from entering the core flow of the turbine engine. Therefore, operation of helicopters in dusty environments can cause significant damage to different sections of the turbine engines due to ingestion of fine dust particles. The damage to the engines leads to performance deterioration, frequent maintenance, reduced engine life, lower flight safety, and higher costs. Enhancement of IPS performance with minimal addition to pressure drop and engine weight is highly desirable for use of advanced turbine engines in challenging environments.

While the present invention is discussed herein in terms of aircraft, one skilled in the art will recognize that it can be used in engines of stationary devices such as generators and in engines of a variety of vehicles including aircraft, land vehicles, water-borne vehicles, amphibious vehicles, and underwater vehicles.

Figure 16:
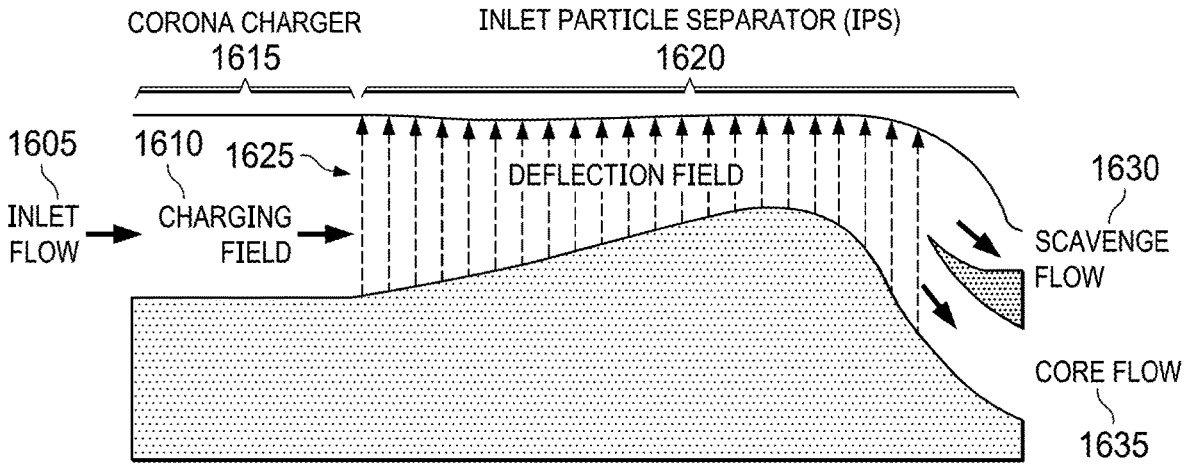
FIG. 16 illustrates the concept of electrostatic enhancement for a generic inlet particle separator (IPS) system.

The approach of the present invention to improve the separation efficiency of the inlet particle separator (IPS) involves electrostatic charging of dust particles followed by their deflection into scavenge flow path of the IPS. The concept of electrostatic enhancement for a generic IPS is shown in FIG. 16. Dust-laden airflow enters the Corona Charger installed upstream to the IPS, shown as inlet flow 1605. The electrostatic charging of dust particles is achieved in the charging field 1610 of the Corona Charger 1615. The charged dust particles then flow into the IPS 1620, wherein an electric field, shown as deflection field 1625 is applied to pull up the particles toward the flowstream that leads into the scavenge flow path 1630. Also shown is core flow 1635. The generic IPS with the addition of an electric field for deflection of the particles is known as the Field-Enhanced IPS. The most challenging aspect of influencing the particle flow is the very short residence time (milliseconds) in the Corona Charger and the Field-Enhanced IPS due to extremely high velocity airflow through the turbine engine. The velocity of air flow ranges from 64.6 to 80.7 m/s at the IPS inlet for air flow of 8 to 10 lb/s. To adequately charge the dust particles in short time, the Corona Charger generates high concentration of charges that are imparted to the particles in a high strength electric field. The Corona Charger causes very low pressure loss (<0.25%) in the intake airflow and this is important because any reduction in intake airflow pressure causes a reduction in power and efficiency of the turbine engine.

The electrostatic enhancement system can improve separation of particles by inlet particle separators for turbine engines during taxiing, hovering, take-off, final approach, landing and any other phases of flight. The system can be active during the whole flight or can be activated prior to approaching a dusty region such as a desert or region of volcanic activity.

The electrostatic charging of dust particles is achieved in a Corona Charger, wherein a corona discharge is produced by high strength electric field. The corona discharge is a type of low temperature plasma, generated by application of a high voltage between two electrodes of non-uniform geometry such as a tube with a wire installed at its central axis or a sharp edge positioned close to a plane. Upon application of high voltage between the electrodes, a corona discharge occurs when the dielectric strength of air (31 kV/cm at 25° C. and 1 atmosphere) is exceeded by the electric field in the gap. Charged species such as ions and electrons are generated which impart charge to dust particles though collision and subsequent adsorption.

Embodiments of the present invention can be used to enhance particle separation in fluid streams such as engine intake flow, core flow, or scavenge flow, and that embodiments of the present invention can be used to enhance particle separation with a inertial particle separator, a centrifugal particle separator, a cyclonic particle separator, or with a porous medium such as a filter.

Embodiments of the present invention use an electric discharge suitable to charge particles that is generated using a variety of equipment geometries, including a rod or a wire positioned substantially along the longitudinal axis of a tube and the tube, where the tube has either a substantially circular cross section or a non-circular cross-section such a triangular, square, rectangular, hexagonal cross-section, and the electric discharge is generated between the rod or wire and the tube. Embodiments of the present invention also generate a suitable electric discharge between a rod or wire positioned within an annulus and the annulus. Embodiments of the present invention also generate a suitable electric discharge between a plurality of rods or wired positioned within an annulus, which may be partitioned into partial-annulus sections, each with a rod or wire positioned within it. Embodiments of the present invention also generate a suitable electric discharge between a protrusion and a flat or curved surface, where the curved surface may be within a annulus, and the annulus may be partitioned into a plurality of partial-annulus sections, each with a protrusion positioned within it. Embodiments of the present invention also generate a suitable electric discharge between a plurality of protrusions positioned on opposite sides of an annulus.

Further, embodiments of the present invention charge particles in a variety of ways, including an electric discharge (including a corona discharge, a dielectric barrier discharge, a radio-frequency-inductively coupled plasma discharge, an arc discharge, or a gliding arc discharge), or an ionizing radiation device (e.g., from a source of x-rays or from the decay of radioactive material).

Further, embodiments of the present invention deflect charged particles in a variety of ways, including an electric field of constant magnitude, a time-varying electric field at any frequency (e.g., an oscillating field), a pulsed electric field at any frequency, or a magnetic field of constant magnitude, a time-varying magnetic field at any frequency (e.g., an oscillating field), a pulsed magnetic field at any frequency. The time-varying field may be unbiased, biased positively, or biased negatively.

Embodiments of the present invention use sensors to estimate the chemical composition of particles, particle size, and particle concentration in fluid flow. Embodiments of the present invention use such sensors to communicate with one or more computers to control or modulate the individual devices in the embodiments. Embodiments of the present invention include sensors adapted to detect, size, and quantify from sources of particles, such as soil erosion, sea spray, volcanic eruptions, and anthropogenic sources of particulate emission, and such particles may include particles of silica, gypsum, silicates, dolomite, salt, carbon, organic compounds, and oxides of various metals. Embodiments of the present invention include one or more optical sensors, electrical sensors, chemical sensors, and sensors that use spectroscopy, including Raman spectroscopy and laser-induced breakdown spectroscopy.

Herein follows an analysis where multiple factors are modeled leading to an inventive Corona Charger that improves particle separation (along with the Deflection Field) within an IPS at high flow velocity (short particle retention times) with low pressure drop. The electrostatic charging of dust particles is achieved in the charging field of the Corona Charger due to collision between particles and ions moving rapidly in an electric field. The ions generated in the Corona Charger are driven to a particle along the applied electric field and they collide with a particle and transfer their charge to it. The number of charges n(t) imparted by ions in an electric field E for a given residence time t is given as follows:

$$n(t) = \left(\frac{3\varepsilon}{\varepsilon+2}\right)\left(\frac{Ed_p^2}{4k_E e}\right)\left(\frac{\pi k_E e Z_i N_i t}{1+\pi k_E e Z_i N_i t}\right) \quad \text{Equation 1}$$

Here ε is the dielectric constant of the particles, E is the applied electric field, $d_p$ is the particle diameter, $k_E$ is Coulomb's law constant ($8.987\times10^9$ $Nm^2/C^2$), e is the charge of an electron ($1.602\times10^{-19}$ C) and $Z_i$ is the mobility of ions (for air, $Z_i \sim 1.5\times10^{-4}$ $m^2/Vs$). A linear dependence of particle charging on electric field and residence time is evident from Equation 1. It can also be inferred that larger particles can acquire greater charge than smaller particles for similar residence times as the charging process is proportional to the square of the particle diameter.

The second mechanism of charging occurs when an ion collides with a particle due to Brownian motion and there is a charge transfer to the particle. This process is dependent on the temperature of the gas and does not require an electric field. As the number of collisions increase with time, charges accumulate on the particle, which produces a field that repels additional ions. If sufficient time is allowed, these particles achieve a Boltzmann distribution in the absence of any external field. An approximation for the number of charges n(t) acquired by a particle of diameter dp by diffusion during time t is given by Equation 2:

$$n(t) = \left(\frac{d_p kT}{2k_E e^2}\right)\ln\left(1 + \frac{\pi k_E d_p \bar{c}_l e^2 N_i t}{2kT}\right) \quad \text{Equation 2}$$

Here $\bar{c}_l$ is the mean thermal speed of the ions at standard conditions, k is the Boltzmann constant, and T is the absolute temperature of the gas. In this case, the charge that is acquired is proportional to particle diameter $d_p$. Therefore, this mechanism is dominant for particles less than 0.1 μm. The total charge imparted to a particle is the sum of Equation 1 and Equation 2 for electrostatic charging process in an electric field.

The electrostatic charging of dust particles is dependent on the following factors: (i) Corona Charger parameters, (ii) particle residence time in the Charger, (iii) particle size and concentration, and (iv) particle material. The effect of each of these factors on electrostatic charging will be discussed in detail below.

Figure 17:
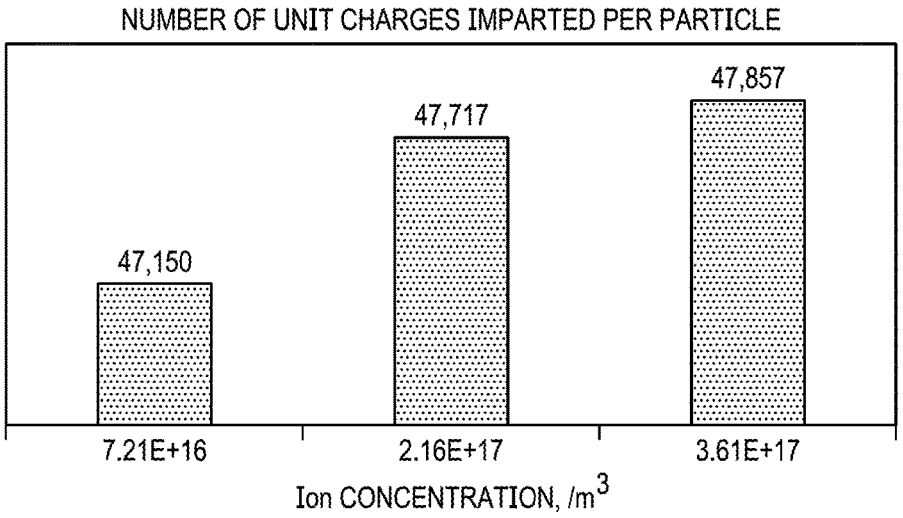
FIG. 17 shows the effect of ion concentration on the amount of charge imparted to silica particles.

Effect of Corona Charger Parameters: The Corona Charger parameters that control the electrostatic charging of dust particles are ion concentration and electric field. The effect of ion concentration on the amount of charge imparted to silica particles is shown in FIG. 17. Silica is a major constituent of Arizona A2 fine test dust particles and is harder to charge than other constituents of the test dust. Therefore, silica is a good representative particle material to study electrostatic charging of dust. The ion concentration was varied as follows: $7.21\times10^{16}$(1×), $2.16\times10^{17}$(3×), and $3.61\times10^{17}$ $m^{-3}$(5×). Each column in the graph represents unit charges ($1.6\times10^{-19}$ C) imparted to silica particles with a diameter of 10 μm. Less than 2% increase in charge imparted to the particles is seen in FIG. 17 for the variation in ion concentration. For these calculations, the concentration of silica particles was set at 53 mg/$m^3$. The residence time of the particles in the Corona Charger was 1.33 ms. The average electric field in the Corona Charger was set at 13.65 kV/cm. The air temperature and pressure was set at 15.2° C. and 1 atm, respectively.

Figure 18:
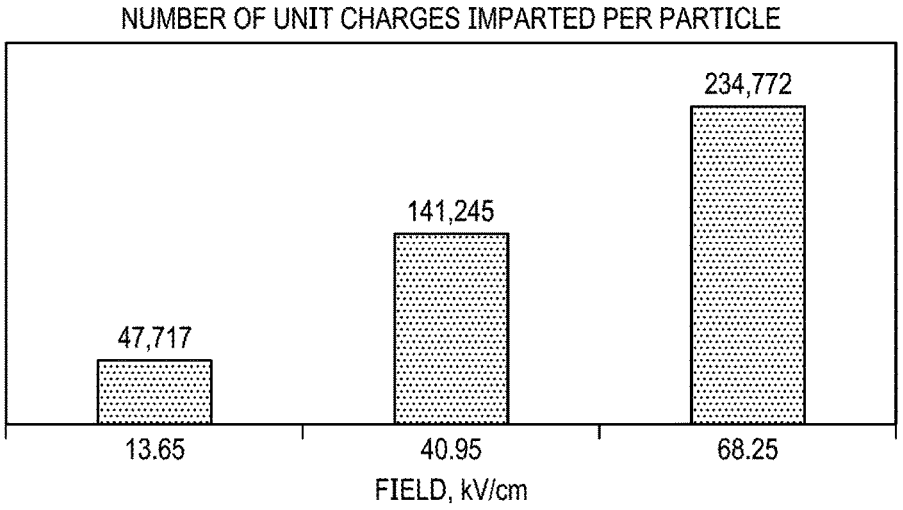
FIG. 18 depicts the effect of change in electric field in the Corona Charger on the electrostatic charging of 10 μm silica particles.

The effect of change in electric field in the Corona Charger on the electrostatic charging of 10 μm silica particles is shown in FIG. 18. The electric field was varied as follows: 13.65 (1×), 40.95 (3×), and 68.25 kV/cm (5×). Each column in the graph represents unit charges (1.6×10-19 C) imparted to silica particles with a diameter of 10 μm. The ion concentration was set to 2.16×1017/$m^3$ for all three cases. The residence time of the particles in the Corona Charger was 1.33 ms. The air temperature and pressure was set at 15.2° C. and 1 atm, respectively. The charge imparted to the dust particles at electric fields ranging from 13.65 to 68.25 kV/cm is substantial and it is seen to proportionally increase with electric field. 3× and 5× increase in charges imparted to the silica particles is seen with corresponding increase in the electric field. Therefore, electric field is a more important Corona Charger parameter than ion concentration for the electrostatic charging of particles.

Figure 19:
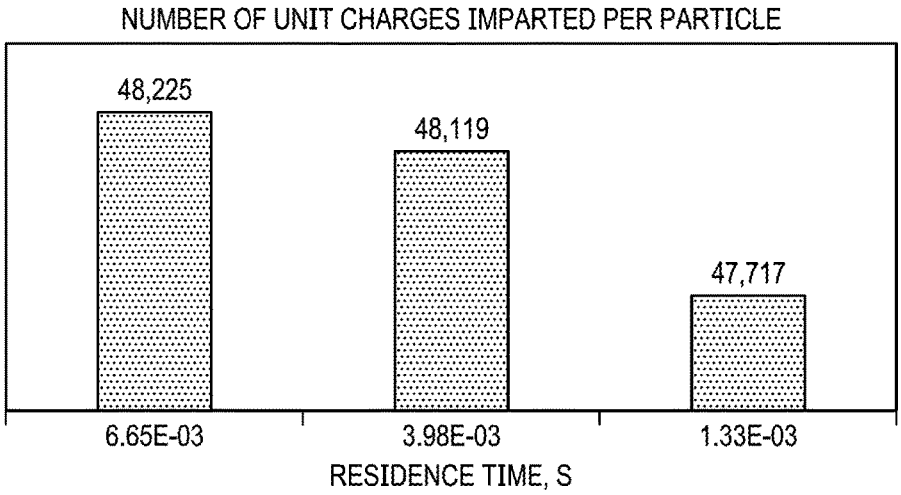
FIG. 19 shows the total charge imparted per particle.

Effect of Particle Residence Time: The particle residence time in the Corona Charger is dictated by the velocity of intake air in the Charger. Based on airflow of 8-10 lb/s and the dimensions the Corona Charger, the residence time of the particles is on the order of few milliseconds. The effect of particle residence time was studied by varying it as follows: approximately 1.3 (1×), 4.0 (3×), and 6.7 ms (5×). The total charge imparted per particle was calculated as per Equation 1 and Equation 2 and is shown in FIG. 19. As expected the imparted charge increases with residence time but only 1% increase is seen over the range under consideration. For these calculations, the concentration of 10 μm silica particles was set at 53 mg/$m^3$. The average electric field in the Corona Charger was set at 13.65 kV/cm and the ion concentration was set to 2.16×1017/$m^3$ for all three cases. The air temperature and pressure was set at 15.2° C. and 1 atm, respectively.

Figure 20:
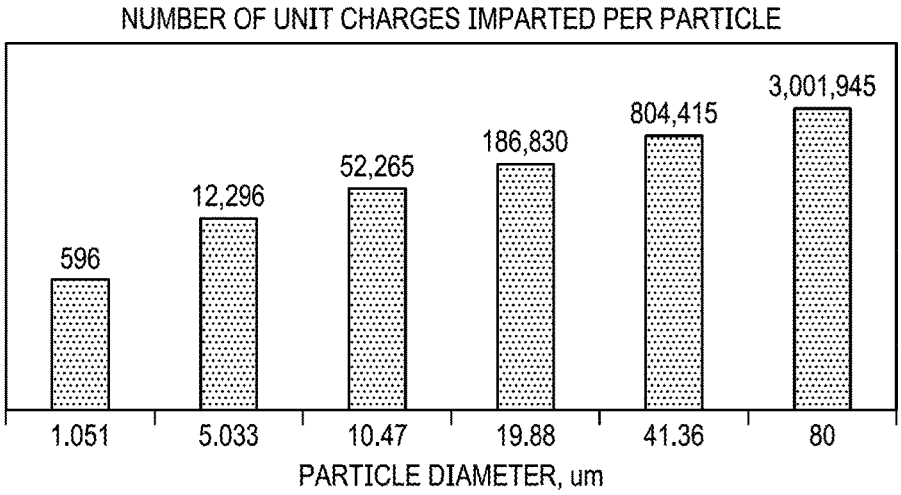
FIG. 20 shows the total number of charges imparted to each particle of a particular diameter.

Effect of Particle Size and Concentration: To demonstrate how particles of different sizes are charged, six different particle sizes ranging from 1 to 80 μm were selected from the Arizona A2 fine test dust datasheet. The particle material was assumed to be silica and the concentration was fixed at 53 mg/$m^3$ for each of the six cases. The particle residence time for each case was 1.33 ms. The total number of charges imparted to each particle of a particular diameter is shown in FIG. 20. Each column in the graph represents unit charges ($1.6\times10^{-19}$ C) imparted to silica particles of a particular diameter. The larger particles are imparted greater charge than the smaller particles because the imparted charge is proportional to the square of the particle diameter as seen in Equation 1. Since electrostatic force acting on a particle due to an electric field is proportional to the charge possessed by it, the greater charging of larger particles is advantageous for their subsequent deflection towards the scavenge path. For these calculations, the average electric field was set at 13.65 kV/cm and the ion concentration was set to 2.16×1017/$m^3$ for all six cases. The air temperature and pressure was set at 15.2° C. and 1 atm, respectively.

Figure 21:
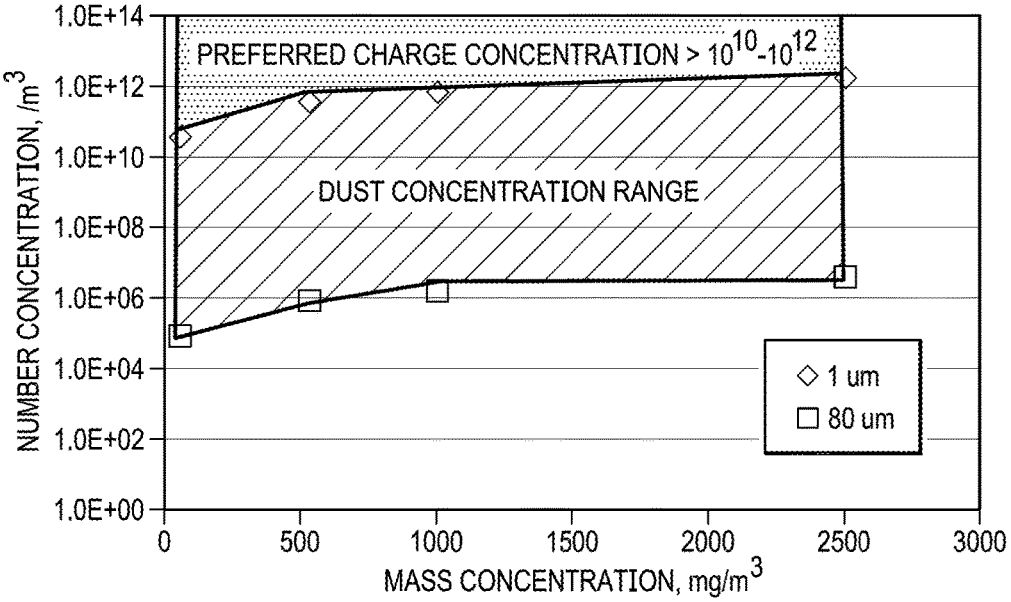
FIG. 21 shows a range of particle number concentrations.

The dust concentration recommended for engine testing is 53 mg/$m^3$ as per MIL-SPEC. (Specification Development Document—Engines, Aircraft, Turboshaft, Sep. 2, 2014.) During takeoff and landing from dusty fields, higher concentration of dust particles may exist and approach 2500 mg/$m^3$ (brownout). The smallest and largest particle sizes (1 and 80 μm) are considered for this analysis. These two sizes would provide the largest and smallest values of number concentration. Assuming all the particles have a diameter of 1 μm, the number concentration ranges from 3.96×1010 to 1.87×1012/$m^3$ as shown in FIG. 21. For the second case, assuming all the particles have a diameter of 80 μm, the number concentration ranges from 8.99×104 to 4.24×106/$m^3$. The selected particle diameters are the extreme cases for the fine dust particles (1-80 μm). This analysis indicates that the preferred ion concentration should be greater than 1010-1012/$m^3$.

Effect of Particle Material: The solid particles encountered by aircraft engines vary not only in size but also in chemical composition. The solid particles may include fine sand, dust, ash, etc. The chemical composition of the solid particles varies widely based on geographic location and season. For laboratory investigation of effect of solid particle ingestion on engine components and performance, standardized test dusts have been developed such as ISO12103-1, Arizona A2 Fine (ISO 12103-1 Arizona Test Dust Contaminants A2 Fine, Powder Technology Inc.) and AFRL03 (AFRL03, Proposed particle size specification, Powder Technology Inc.).

Arizona A2 fine test dust is widely used in testing of air cleaning and filtration equipment for automotive and aircraft engines. The results from chemical analysis of the Arizona A2 fine test dust is shown in Table 4. The density and relative permittivity (dielectric constant) were compiled from literature survey to determine the effectiveness of electrostatic charging for each of the reported constituents. The density of particles determines the number concentration for a particle mass concentration and particle size. The relative permittivity reflects the strength of the electrostatic field produced within the particle by a fixed potential relative to that produced in a vacuum under the same conditions.

TABLE 4

| Oxides detected in ISO12103-1, Arizona A2 Fine Test Dust, based on chemical analysis: | | | | | | | | |
|---|---|---|---|---|---|---|---|---|
| | $SiO_2$ | $Al_2O_3$ | $Fe_2O_3$ | $Na_2O$ | CaO | MgO | $TiO_2$ | $K_2O$ |
| Weight % | 68-76 | 10-15 | 2-5 | 2-4 | 2-5 | 1-2 | 0.5-1 | 2-5 |
| Density kg/m$^3$ | 2200 | 3965 | 5240 | 2270 | 3340 | 3580 | 4230 | 2320 |
| Relative Permittivity | 3.9 | 9 | 14.2 | — | 8.25 | 9.7 | 45 | — |

Figure 22:
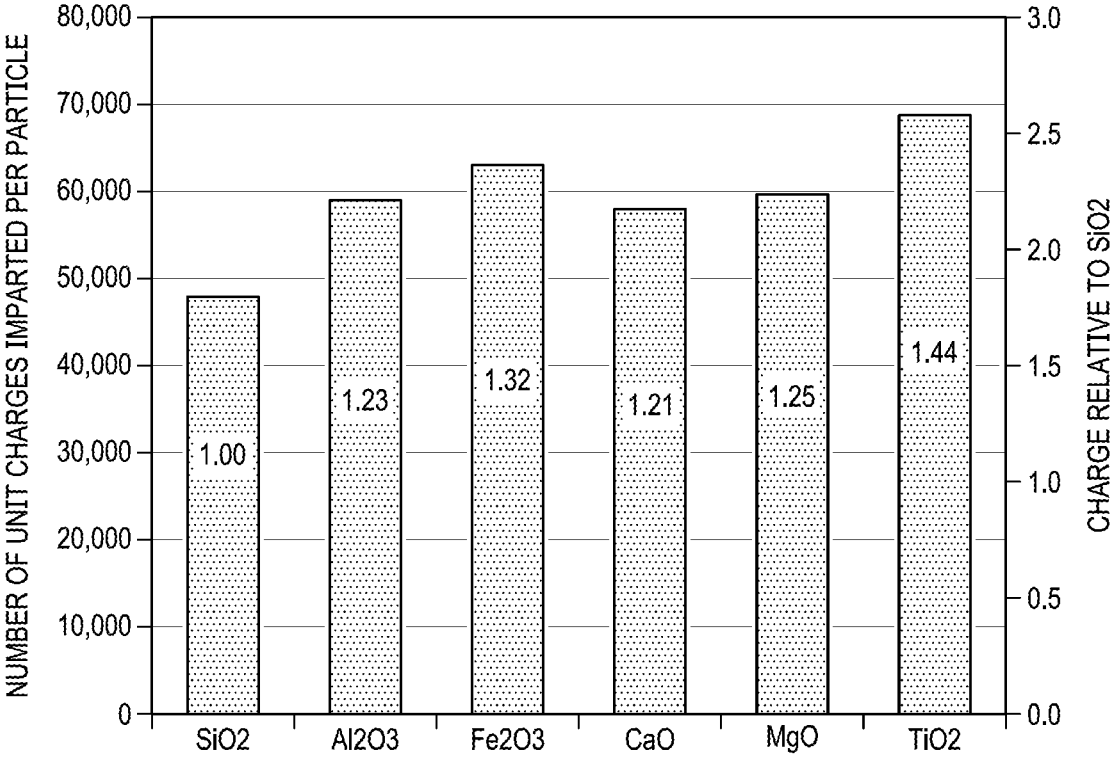
FIG. 22 depicts the influence of particle material on the ability to acquire charge.

The influence of particle material on the ability to acquire charge is seen in FIG. 22. The overall trend indicates that materials with high relative permittivity acquire greater charge. Among the oxides detected in Arizona A2 Fine Test Dust, titanium oxide particles acquire the greatest charge, while silica acquires the least charge. Therefore, silica is a suitable representative material to study electrostatic charging of dust particles. For generating this graph, the particle diameter was assumed to be 10 μm and the particle concentration was set at 53 mg/m$^3$. The residence time of particles in the Charger was 1.33 ms. The average electric field was set at 13.65 kV/cm and the ion concentration was set at 2.16×1017/m$^3$. The air temperature and pressure was set at 15.2° C. and 1 atm, respectively.

The AFRL03 test dust is used to study the effects of particle ingestion, such as impact erosion in the cold sections of the engine and formation of glassy deposits in the hot sections of engines. Table 5 lists the constituents and their proportions used to prepare AFRL03 test dust. The major components are quartz, gypsum, aplite, dolomite, and salt. Aplite is a mixture of quartz and aluminosilicates such as potassium feldspar (KAlSi3O8), albite (NaAlSi3O8), and anorthite (CaAl2Si2O8). The density and relative permittivity were compiled from literature survey. Among aluminosilicates, the density and relative permittivity for only orthoclase feldspar was found in our survey.

TABLE 5

| Constituents of AFRL03 Test Dust based on recipe: | | | | | |
|---|---|---|---|---|---|
| | Quartz | Gypsum | Aplite | Dolomite | Salt |
| | $SiO_2$ | $CaSO_4 \cdot 2H_2O$ | $SiO_2$(87-93%) + $KAlSi_3O_8$—$NaAlSi_3O_8$—$CaAl_2Si_2O_8$ (7-13%) + $H_2O$ (0.1%) | $CaMg(CO_3)_2$ | NaCl |
| Weight % | 34 | 30 | 17 | 14 | 5 |
| Density kg/m$^3$ | 2650 | 2330 | 2560 ($KAlSi_3O_8$) | 2850 | 2165 |
| Relative Permittivity | 4.2 | 4.25 | 5.36 ($KAlSi_3O_8$) | 7.4 | 6.12 |

Figure 23:
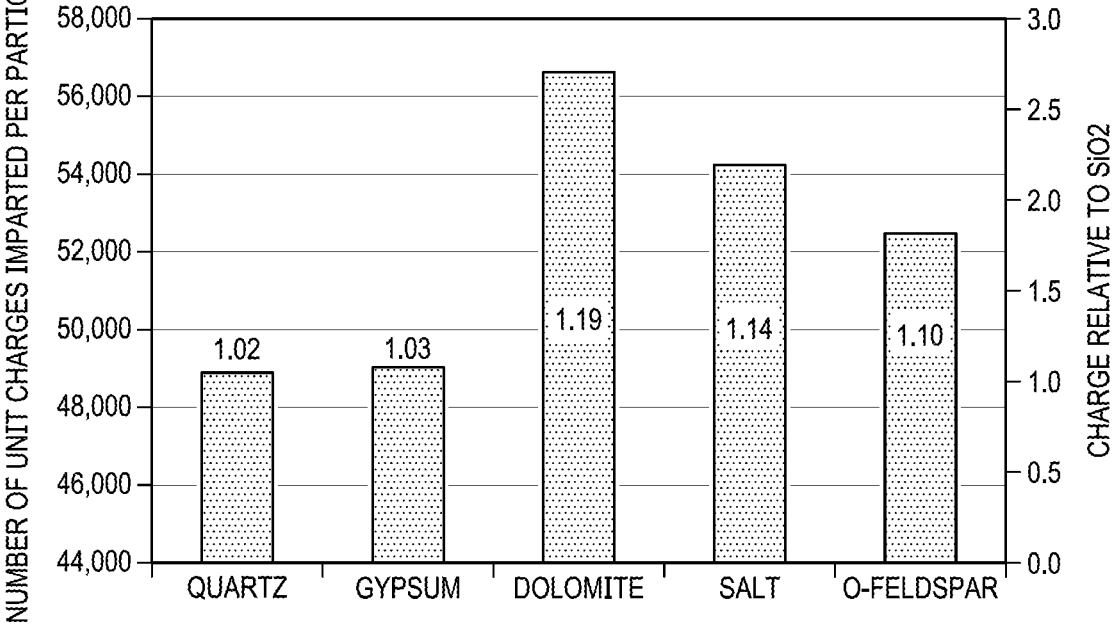
FIG. 23 shows how the different particle materials in AFRL03 test dust will acquire charge upon flowing through the Corona Charger.

FIG. 23 shows how the different particle materials in AFRL03 test dust will acquire charge upon flowing through the Corona Charger. Again, the overall trend indicates that materials with high relative permittivity acquire greater charge. Dolomite particles acquire the greatest charge, while quartz acquires the least charge. Quartz and silica have the same chemical formula but different crystalline structure. For generating this graph, the particle diameter was assumed to be 10 μm and the particle concentration was set at 53 mg/m$^3$. The residence time of particles in the Charger was 1.33 ms. The average electric field was set at 13.65 kV/cm and the ion concentration was set at 2.16×1017/m$^3$. The air temperature and pressure was set at 15.2° C. and 1 atm, respectively.

Figure 24C:
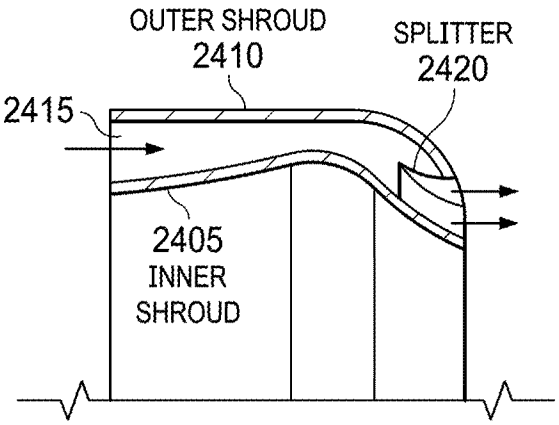
FIGS. 24A, 24B, and 24C show a perspective, side, and cross-sectional views of an IPS, respectively.
Figure 24B:
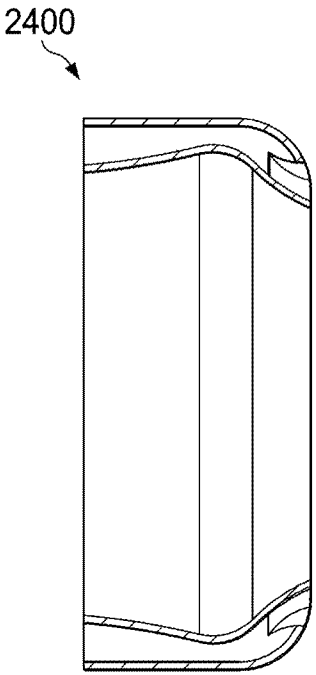
Figure 24A:
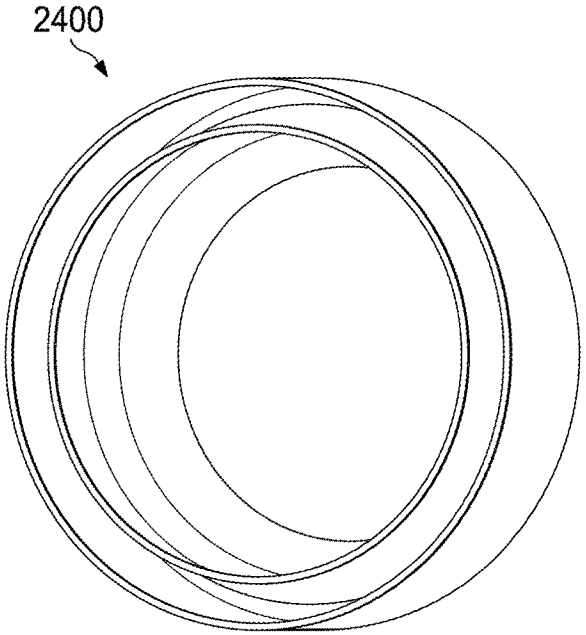

A preliminary design of the Corona Charger was developed for enhancement in separation efficiency of a generic IPS. The Corona Charger was designed to have a cross-section similar to the inlet of the generic IPS. FIGS. 24A, 24B, and 24C show a perspective view, a side view, and a cross-section respectively, of the generic IPS 2400, wherein the flowpath is created between inner shroud 2405 and outer shroud 2410. At the inlet plane, the nominal diameter of the outer shroud 2410 is 18.8", while the nominal diameter of the inner shroud 2405 is 16.2". The gap between the outer shroud 2410 and inner shroud 2405 at the IPS inlet 2415 is 1.3". The overall length of the generic IPS 2400 is 8.7". The inlet air flow was assumed to vary from 8-10 lb/s. The velocity of air flow ranges from 64.6-80.7 m/s at the IPS inlet for air flow of 8-10 lb/s. The air temperature and pressure was set at 15.2° C. and 1 atm, respectively. Also shown in FIG. 24C is a splitter 2420.

Figure 25C:
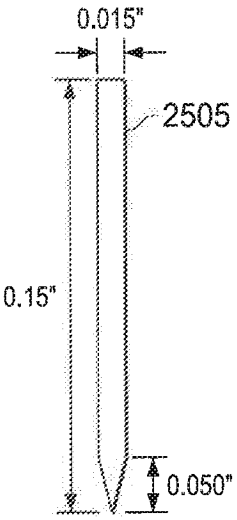
FIGS. 25A, 25B, and 25C illustrate a 3D-view and a front view of the Corona Charger and a cross-section of an electrode, respectively.
Figure 25B:
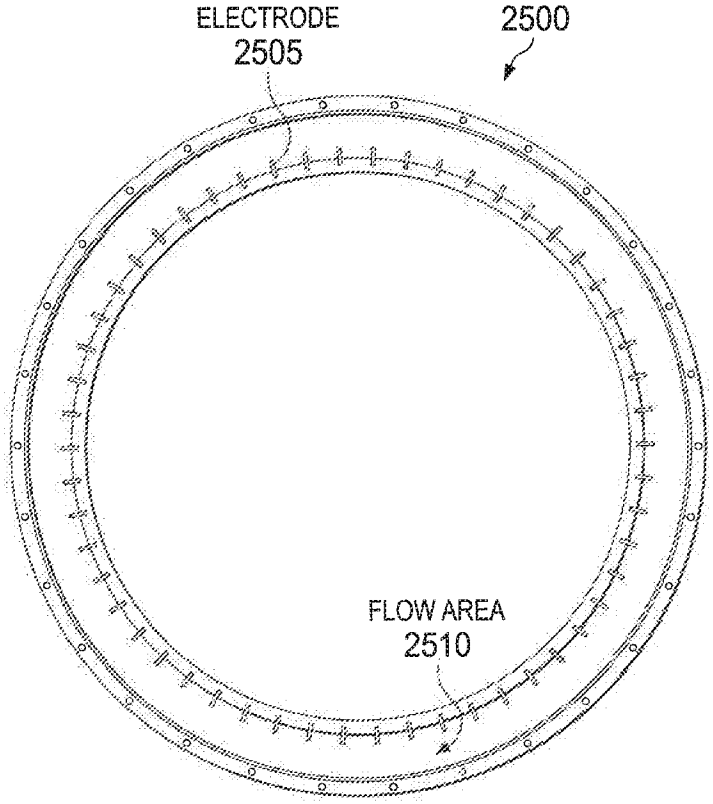
Figure 25A:
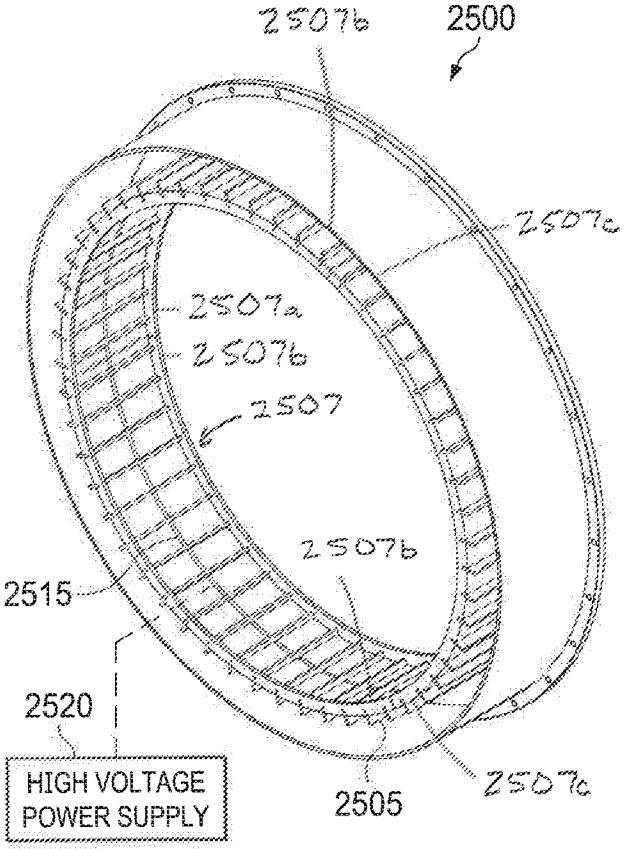

The Corona Charger is used to generate a corona discharge which contains charged species such as ions and electrons, which are transferred to the dust particles through collision and subsequent adsorption. The corona discharge is generated by application of a high voltage between two electrodes of non-uniform geometry such as a tube with a wire installed at its central axis or a sharp edge positioned close to a plane. Upon application of high voltage between the electrodes, a corona discharge occurs when the dielectric strength of air (31 kV/cm at 25° C. and 1 atmosphere) is exceeded by the electric field in the gap. Various designs of the Corona Charger that can provide the ion concentration and field strength required for electrostatic charging of dust particles were evaluated. The design based on vane-like electrodes was selected due to its robustness, least obstruction to air flow, and low pressure loss. FIG. 25A shows a 3D-view of one embodiment of the Corona Charger 2500, and FIG. 25B shows the front view of the Corona Charger 2500, including flow area 2510. The inner frame consists of 54 vane-like electrodes 2505 positioned within an annulus 2507 and placed parallel to the direction of airflow. In one embodiment, the annulus 2507 is partitioned into a plurality of partial-annulus sections, here illustrated by exemplary partial annulus sections 2507*a*, 2507*b*, and 2507*c*, and each exemplary partial-annulus section 2507*a*, 2507*b*, and 2507*c* has at least one rod, wire, or vane-like electrode 2505 positioned within it. As shown in FIG. 25C, in this embodiment the electrodes are about 3.5" long and 0.015" thick and they protrude 0.15" into the flow area 2510. In other embodiments, different electrode lengths, different electrode thicknesses, and different protrusion lengths would be sufficient and preferred. The tip of each electrode in the present embodiment is triangular in shape but it can also be semicircular, curved, square, rectangular, etc. The inner frame is made from a dielectric. The purpose of the dielectric casing is to isolate other engine parts such as any nose cone (upstream) and the IPS inlet (downstream) from the high voltage. A connector ring 2515, shown in FIG. 25A, placed under the inner frame, is used to power all the electrodes using a high voltage power supply 2520 to create the corona discharge for electrostatic charging of dust particles.

Figure 26:
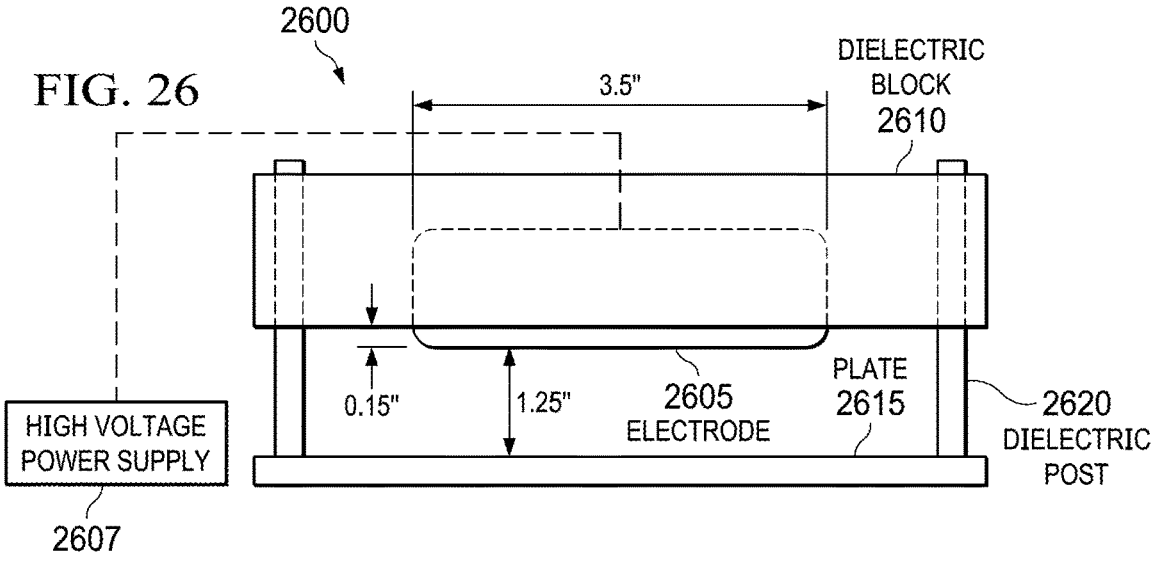
FIG. 26 depicts a test article for the Corona Charger.

Testing using a single vane-like electrode was conducted to determine the current, voltage, and power required for operation of the Corona Charger. A test article 2600 was designed and built as shown in FIG. 26. It consists of a vane-like electrode 2605 housed in a dielectric block 2610. The height of the protruding part of the electrode is about 0.15" and the gap between the tip of the electrode 2605 and the ground plate 2615 is about 1.25". The ground plate 2615 represents the outer frame in the Corona Charger. Also shown is dielectric post 2620. The spacing between the electrode 2605 and the ground plate 2615 is similar to the spacing between the electrode and the outer frame in the Corona Charger.

Figure 27A:
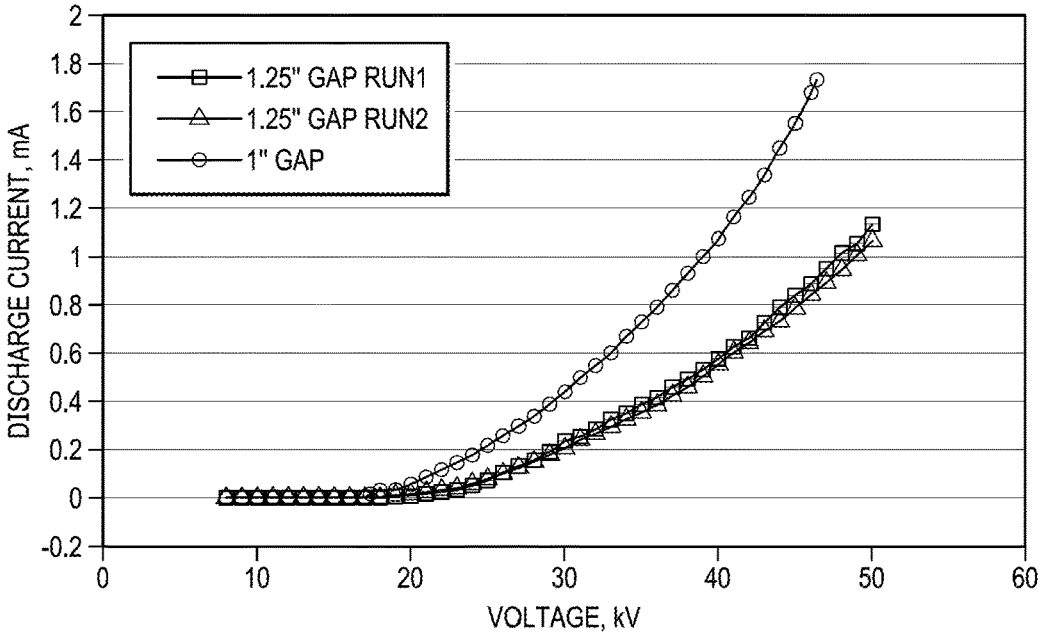
FIGS. 27A and 27B show set voltages and corresponding discharge currents for the test article and photograph of discharge current, respectively.
Figure 27B:
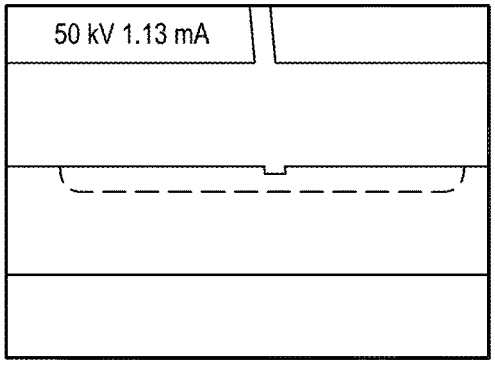

The electrode 2605 was connected to a high voltage DC power supply 2607 and the voltage was increased from 8 kV in 1 kV increments. The stable current was noted for each voltage setting. The set voltages and corresponding discharge currents are shown in the graph in FIG. 27A. FIG. 27B is a photograph of the discharge current of 1.13 mA at 50 kV. The discharge current is not detectable starting at 8 kV and the lowest current (0.01 mA) is detected at 19 or 20 kV. After this point, the current increases drastically as the voltage is increased up to 50 kV. At 50 kV, the discharge current is 1.1 mA for 1.25" gap. This trend is confirmed in two test runs. Since 50 kV is the limit of the power supply, higher discharge currents cannot be obtained at 1.25" gap. Therefore, the gap was reduced to 1" and the highest discharge current of 1.73 mA was obtained at 46.5 kV. This test run at a lower gap demonstrates that higher discharge currents can be obtained for the 1.25" gap if the voltage is not limited by the power supply. The data from 1.25" gap runs was averaged and then replotted. A curve described by a second-order polynomial equation was fitted to the new plot. Using the polynomial equation, the discharge current at 53 kV was estimated to be 1.23 mA. This pair of voltage and current values was selected as the operating value for the Corona Charger calculations. The net power for operating a single electrode is about 65 W, obtained as the product of the voltage (52 kV) and the current (1.23 mA).

Figure 28:
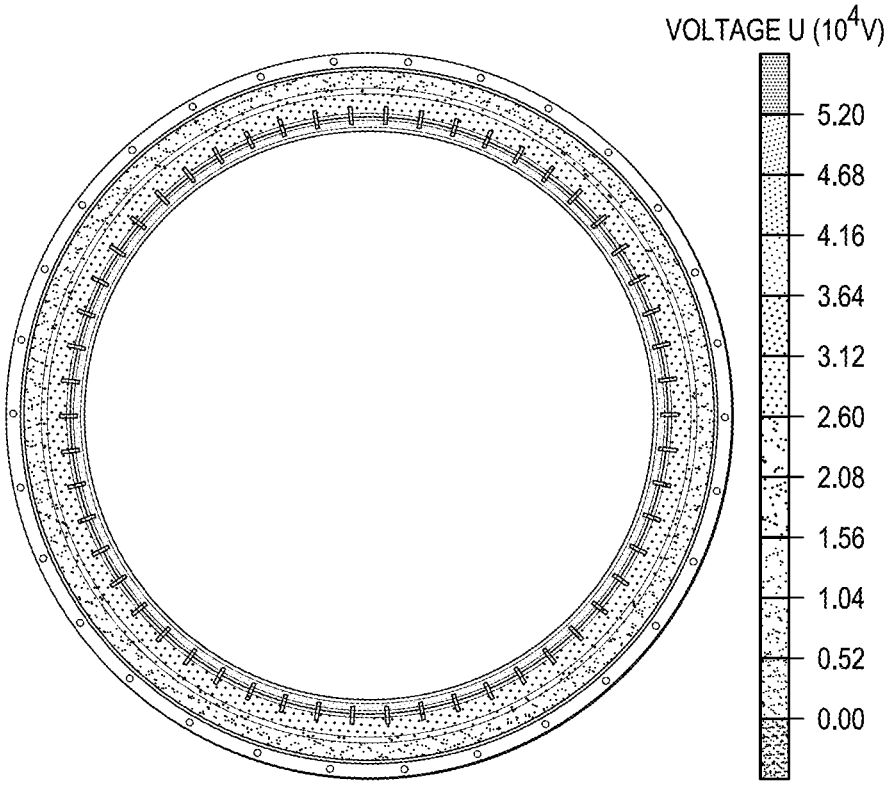
FIG. 28 illustrates the distribution of potential and relative permittivity within the Corona Charger.
Figure 28:
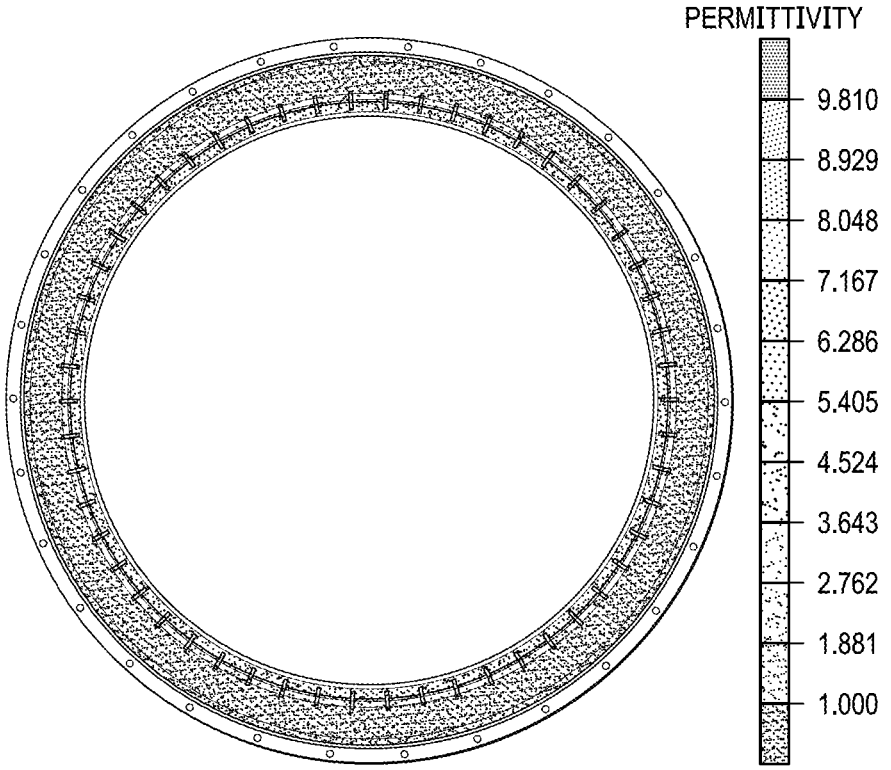

The electric field distribution within the Corona Charger was calculated using finite element analysis performed on a CAD model of the Corona Charger (see FIG. 10). The distribution of potential and relative permittivity within the charger is shown in FIG. 28. A potential of 52 kV is applied on the vane-like electrodes, while the outer frame surface is grounded (0 kV). The relative permittivity of the air flow region is set to 1 (air), while that for the surface of the inner frame (dielectric) is set to 9.8 (alumina).

Figure 29A:
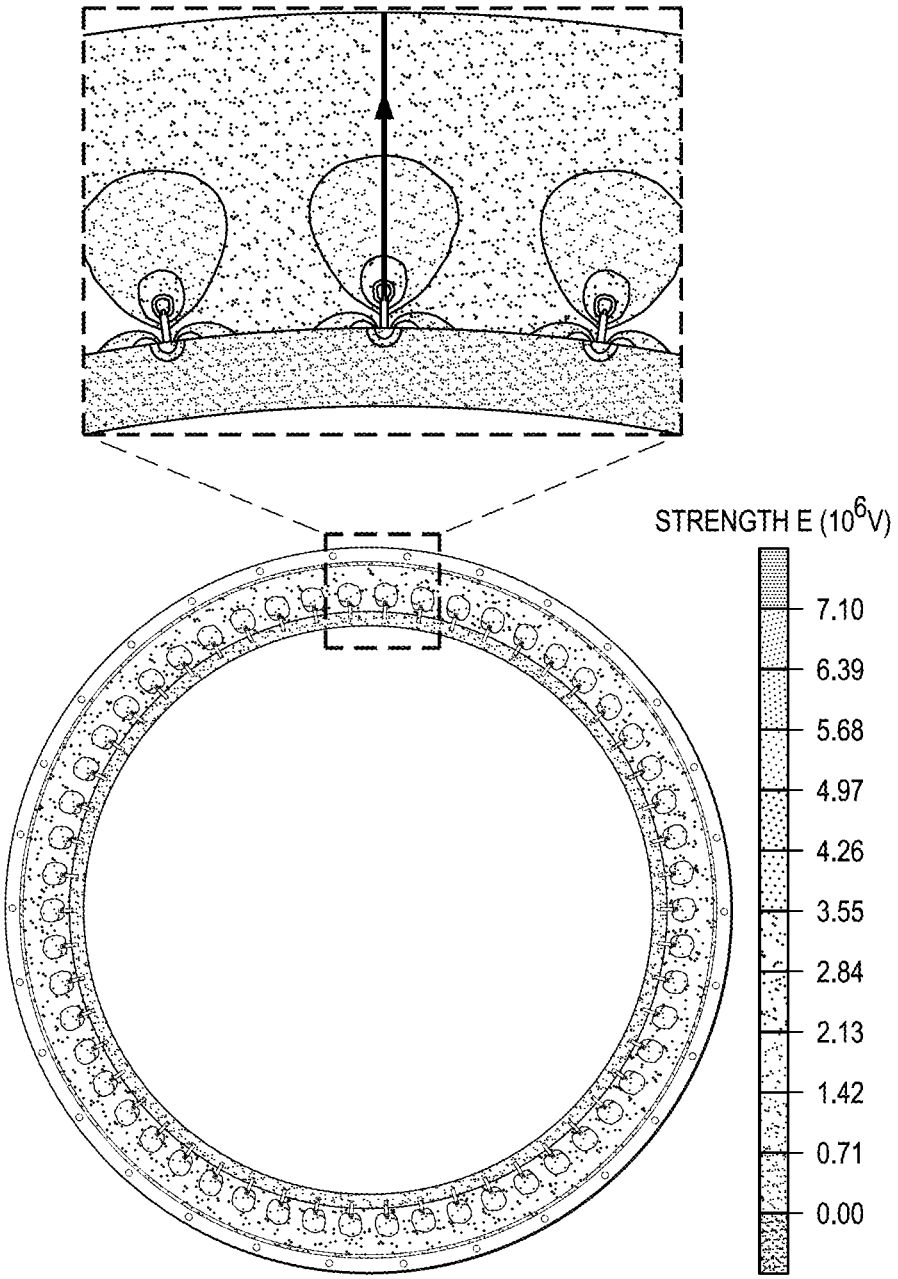
FIGS. 29A and 29B depict electric field strength in the Corona Charger (including the field strength near individual electrodes) and a graphical plot of the field strength, respectively.
Figure 29B:
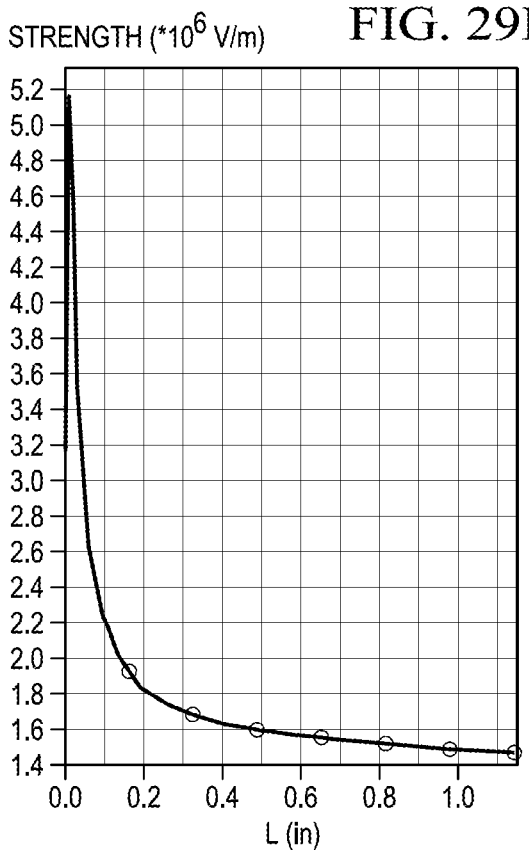

Based on the specified voltage and geometry, the electric field within the Corona Charger is calculated by finite element analysis. The distribution of electric field within the Charger is shown in FIGS. 29A and 29B. Mean square strength was obtained for the region of airflow in the Corona Charger as 2.413×1012 V2/m2. The square root of the mean square strength provides the average electric field. The average electric field in the Corona Charger (region of air flow) was 1.553×106 V/m.

Figure 30A:
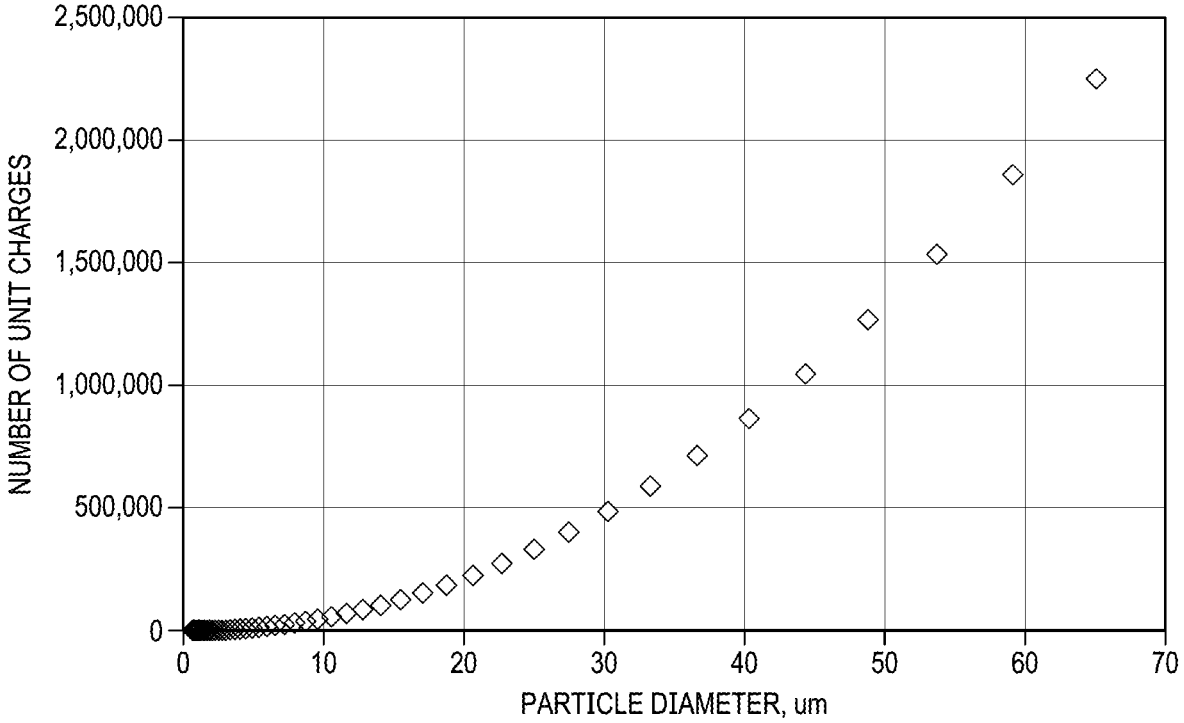

FIG. 29A shows electric field strength on a diagram of the Corona Charger, including the field strength near individual electrodes. The electric field near each electrode is very high. The electric field along the line drawn from the electrode to the outer frame was calculated and is plotted in FIG. 29B. The maximum electric field is about 5.16×106 V/m, which is sufficient to cause ionization of air and generate charges for electrostatic charging of dust particles. The charge imparted to the dust particles was calculated using the calculated average electric field (1.553×106 V/m) and the measured current (1.23 mA) for an applied potential of 52 kV. The charge concentration was calculated to be 1.22×1017/m$^3$ based on the measured current. The intake airflow was set at 9.18 lb/s at 15.2° C. and 1 atm. Since the Corona Charger consists of 54 electrodes, the volumetric airflow per electrode is about 133.3 SCFM. The dust concentration in the intake airflow was set at 53 mg/m$^3$. The particle size was varied as per datasheet for Arizona A2 Fine (Powder Technology Inc. ID 10666F) from 0.66 μm to 65.02 μm. The particle material was assumed to be silica since it was found to be the hardest material to charge (see FIG. 22). The residence time of the particle in the Corona Charger field was calculated to be 1.21 ms, for an active length of 3.5". The total charge imparted to these particles was calculated as the sum of charge imparted by field and diffusion charging mechanisms. The relationship between particle size and total charge in terms of unit charges is shown in FIGS. 30A and 30B, in which FIG. 30A shows the relationship for a number of unit charges up to 2,500,000 and FIG. 30B shows the relationship for a number of unit charges up to 200,000 in more detail. The imparted charge increases with particle size but even the small particles (0.66-18.75 μm) that are difficult to separate in the IPS are appreciably charged. This graph shows that the particles are appreciably charged even at a low residence time. Table 6 shows the total charge imparted by the Corona Charger to dust particles for three values of air flowrate. The velocity of air flow ranges from 64.6 to 80.7 m/s at the IPS inlet for air flow of 8 to 10 lb/s. The charge values are used to determine the deflection of the particles in the field-enhanced IPS in the next section.

TABLE 6

Total charge imparted to Arizona A2 fine test dust particles for three different air flowrates: (i) 8 lb/s (ii) 9.18 lb/s (iii) 10 lb/s.

| Particle diameter, | Number of unit charges | | |
|---|---|---|---|
| μm | 8 lb/s | 9.18 lb/s | 10 lb/s |
| 0.660 | 276 | 274 | 273 |
| 0.726 | 330 | 328 | 326 |
| 0.799 | 395 | 392 | 390 |
| 0.879 | 473 | 469 | 467 |
| 0.967 | 566 | 562 | 560 |
| 1.064 | 678 | 674 | 672 |
| 1.171 | 814 | 809 | 806 |
| 1.289 | 978 | 973 | 969 |
| 1.418 | 1,174 | 1,168 | 1,164 |
| 1.561 | 1,412 | 1,405 | 1,401 |
| 1.717 | 1,697 | 1,689 | 1,684 |
| 1.889 | 2,041 | 2,032 | 2,026 |
| 2.079 | 2,457 | 2,447 | 2,440 |
| 2.288 | 2,960 | 2,948 | 2,940 |

TABLE 6-continued

Total charge imparted to Arizona A2 fine test dust particles for three different air flowrates: (i) 8 lb/s (ii) 9.18 lb/s (iii) 10 lb/s.

| Particle diameter, | Number of unit charges | | |
|---|---|---|---|
| μm | 8 lb/s | 9.18 lb/s | 10 lb/s |
| 2.517 | 3,565 | 3,551 | 3,541 |
| 2.770 | 4,297 | 4,281 | 4,269 |
| 3.048 | 5,181 | 5,162 | 5,148 |
| 3.354 | 6,249 | 6,226 | 6,210 |
| 3.690 | 7,536 | 7,510 | 7,491 |
| 4.061 | 9,097 | 9,066 | 9,044 |
| 4.468 | 10,977 | 10,941 | 10,915 |
| 4.916 | 13,251 | 13,209 | 13,178 |
| 5.410 | 16,006 | 15,956 | 15,920 |
| 5.953 | 19,333 | 19,274 | 19,231 |
| 6.550 | 23,353 | 23,284 | 23,232 |
| 7.207 | 28,215 | 28,133 | 28,071 |
| 7.931 | 34,104 | 34,006 | 33,933 |
| 8.727 | 41,222 | 41,105 | 41,018 |
| 9.602 | 49,823 | 49,684 | 49,580 |
| 10.570 | 60,286 | 60,120 | 59,996 |
| 11.630 | 72,886 | 72,688 | 72,539 |
| 12.790 | 88,042 | 87,805 | 87,627 |
| 14.080 | 106,575 | 106,292 | 106,078 |
| 15.490 | 128,855 | 128,516 | 128,259 |
| 17.040 | 155,784 | 155,377 | 155,069 |
| 18.750 | 188,453 | 187,965 | 187,595 |
| 20.640 | 228,174 | 227,588 | 227,143 |
| 22.710 | 276,032 | 275,327 | 274,792 |
| 24.990 | 334,011 | 333,164 | 332,519 |
| 27.490 | 403,931 | 402,913 | 402,136 |
| 30.250 | 488,831 | 487,606 | 486,670 |
| 33.290 | 591,707 | 590,231 | 589,102 |
| 36.630 | 716,050 | 714,271 | 712,910 |
| 40.310 | 866,767 | 864,623 | 862,980 |
| 44.350 | 1,048,788 | 1,046,203 | 1,044,221 |
| 48.800 | 1,269,341 | 1,266,223 | 1,263,831 |
| 53.700 | 1,536,523 | 1,532,759 | 1,529,870 |
| 59.090 | 1,859,869 | 1,855,326 | 1,851,837 |
| 65.020 | 2,251,249 | 2,245,764 | 2,241,549 |

The flowpath of charged particles can be altered in an electrostatic field due to the Coulomb force exerted on the particles. The generic IPS with the addition of an electric field for deflection of the particles is known as the Field-Enhanced IPS and is shown in FIGS. 31A and 31B. FIG. 31A shows an IPS 3100 in which the electric field is applied by electrification of the outer shroud 3105 to function as the high potential electrode with positive polarity. The electrification of the outer shroud is achieved by connecting it to a high voltage power supply 3107. The inner shroud 3110 is grounded and functions as the ground electrode. The splitter 3115 and the trailing end of the outer shroud 3105 are made of dielectric material to prevent arcing with the electrified outer shroud 3105. As the dust particles leaving the Corona Charger are negatively charged, after their entry into the IPS 3100, they are deflected towards the scavenge flow path 3120 due to attractive force exerted by the positively charged outer shroud 3105. Alternatively, a negative potential can be applied on the inner shroud 3110 and the outer shroud 3105 can be grounded as shown in FIG. 31B. The electrification of the inner shroud is achieved by connecting it to a high voltage power supply 3107. This scheme results in repulsion of the negative charge particles away from the surface of the inner shroud 3110.

The deflection of the dust particles within the IPS can be calculated as follows. Consider a charged particle leaving the Corona Charger and entering the IPS wherein the outer shroud is energized. The particle is travelling in the x-direction from the inlet of the IPS towards the splitter. The electrostatic force $F_y$ experienced by a particle carrying nq charges due to an electrostatic field acting in the y-direction is given by Equation 3:

$$\vec{F_y} = nq\vec{E_y} \qquad \text{Equation 3:}$$

Figure 32:
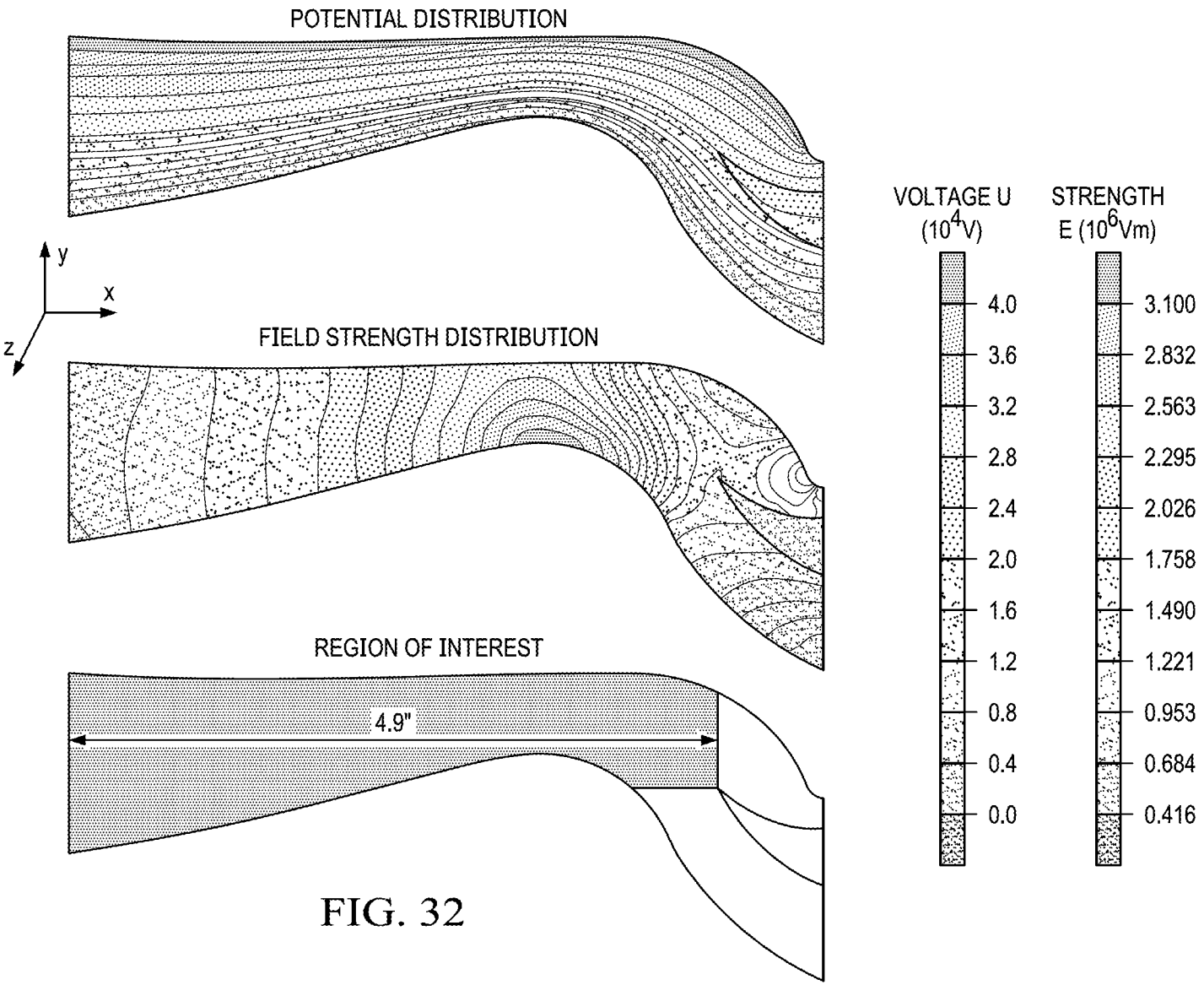
FIG. 32 shows the application of 40 kV potential and the resultant electric field in the region of the IPS before the splitter.

Here n is the number of unit charges on the particle, q is the value of unit charge, and $E_y$ is the electrostatic field. The electrostatic field in the IPS inlet was estimated for application of 40 kV along the outer shroud using a finite element analysis model. FIG. 32 shows the application of 40 kV potential (as per the scheme in FIG. 31A) and the resultant electric field within the IPS. In the region of interest (4.9" section long prior to the splitter), the root mean square electrostatic field is 1.855 MV/m, which exerts attractive force on the charged particle to pull it towards the outer shroud. The area for the region of interest is 4.2513 in2. Considering the three-dimensional IPS, the volume for the region of interest is 238.05 in3.

The acceleration experienced by the particle due to the electrostatic force acting on it is given by Equation 4:

$$\vec{a_y} = \frac{nq\vec{E_y}}{\rho_p(\frac{\pi}{6}d_p^2)} \qquad \text{Equation 4}$$

Here $d_p$ and $\rho_p$ is the diameter and density of the particle. The displacement of the particle in the y-direction is given by Equation 5:

$$\delta_y = u_y t + \frac{a_y t^2}{2}. \qquad \text{Equation 5}$$

Here $u_y$ is the initial velocity in the y-direction and t is the residence time of particles in the electric field. For these calculations, since displacement in the y-direction due to electrostatic force is being compared, the initial velocity in the y-direction $u_y$ is assumed to be zero. The residence time of the particles t is calculated using the mass flowrate (8-10 lb/s), temperature (15.2° C.), and pressure of inlet air and volume (238.05 in3) of the region of interest (electrostatic field). The residence time is 1.32, 1.15 and 1.05 ms for mass flowrates of 8.00, 9.18, and 10.00 lb/s, respectively.

Figure 33A:
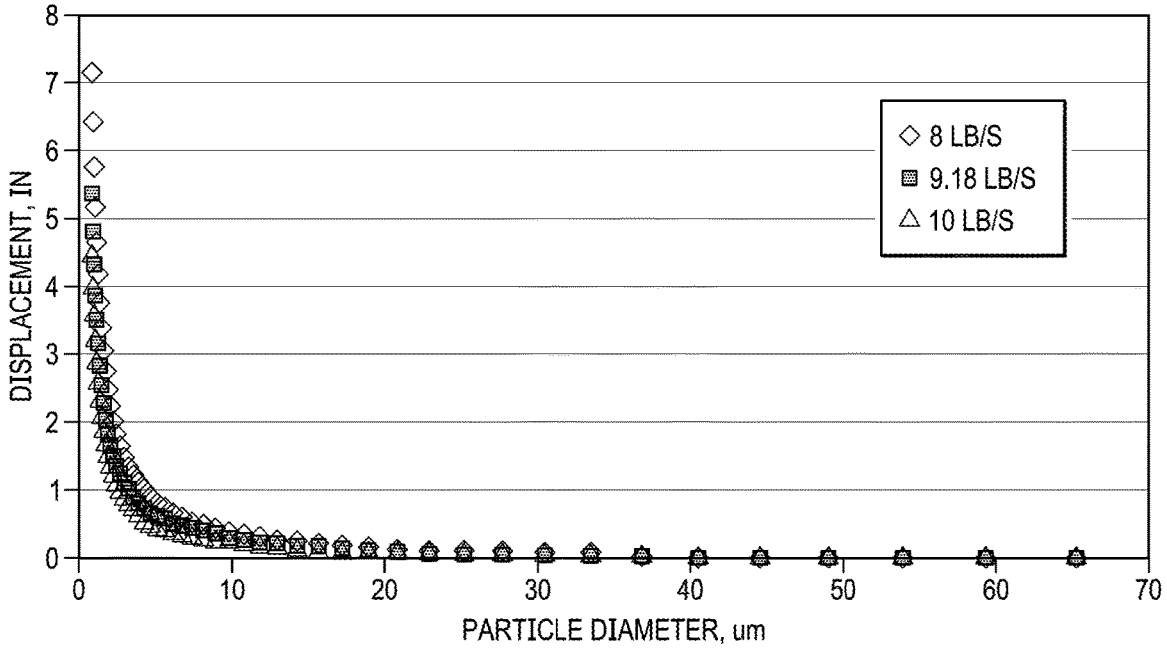
FIGS. 33A and 33B illustrate calculated displacements of particles ranging from 0.6 μm to 65 μm and from 5 μm to 25 μm, respectively.
Figure 33B:
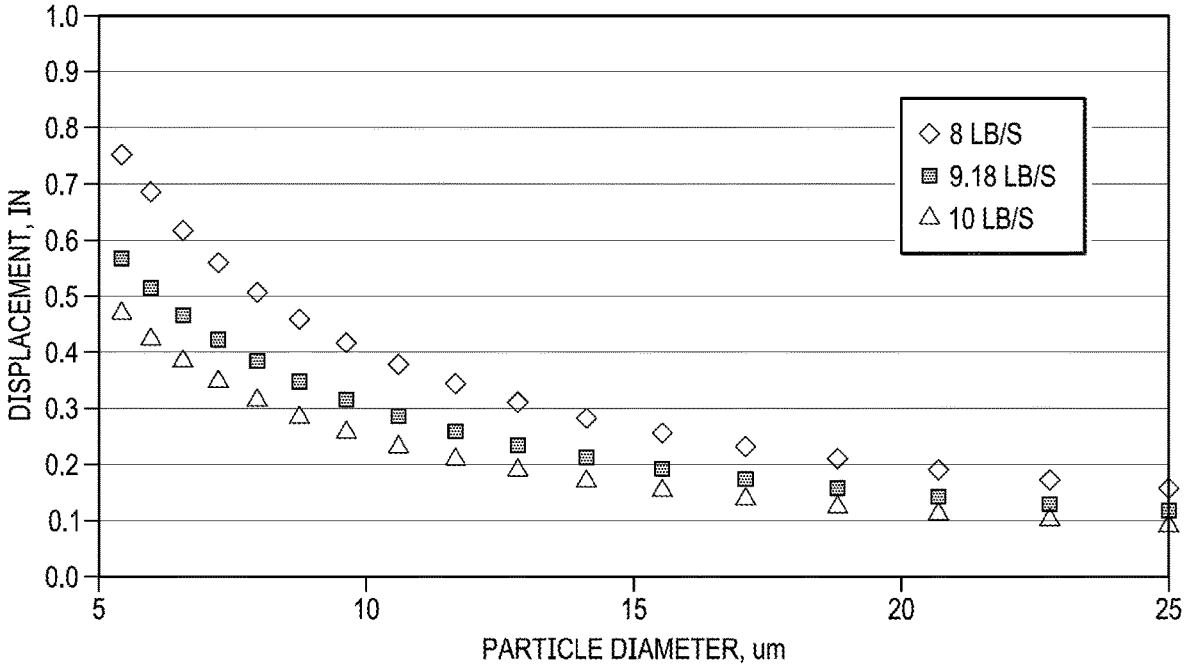

The calculated displacement in y-direction (towards scavenge flowpath) of charged particles ranging from 0.66 μm to 65 μm is shown in FIG. 33A and from 5 μm to 25 μm in FIG. 33B. The calculated displacement is that experienced by a charged particle in the y-direction as it travels through the region of interest (electric field) as the outer shroud is maintained at 40 kV. The displacement is shown for three mass flowrates: 8 lb/s, 9.18 lb/s and 10 lb/s. The velocity of air flow ranges from 64.6 to 80.7 m/s at the IPS inlet for air flow of 8 to 10 lb/s. The maximum displacement of 7.16" is experienced by the 0.66 μm particle for the lowest flowrate. Generally, the separation of particles ranging from 5 μm to 25 μm is most challenging for the IPSs. For particles ranging from 5.41 μm to 24.99 μm, the displacement in y-direction is substantial and it ranges from 0.1 in. to 0.75 in. Table 7 lists the displacement of all the particles for the three air flowrates.

TABLE 7

Displacement of particles within the Field-Enhanced IPS for three different air flowrates: (i) 8 lb/s (ii) 9.18 lb/s (iii) 10 lb/s.

| Particle diameter, | Displacement, in | | |
|---|---|---|---|
| μm | 8 lb/s | 9.18 lb/s | 10 lb/s |
| 0.66 | 7.16 | 5.40 | 4.53 |
| 0.726 | 6.44 | 4.86 | 4.07 |
| 0.799 | 5.78 | 4.35 | 3.66 |
| 0.879 | 5.19 | 3.91 | 3.29 |
| 0.967 | 4.67 | 3.52 | 2.96 |
| 1.064 | 4.20 | 3.17 | 2.66 |
| 1.171 | 3.78 | 2.86 | 2.40 |
| 1.289 | 3.41 | 2.57 | 2.16 |
| 1.418 | 3.07 | 2.32 | 1.95 |
| 1.561 | 2.77 | 2.09 | 1.76 |
| 1.717 | 2.50 | 1.89 | 1.59 |
| 1.889 | 2.26 | 1.71 | 1.44 |
| 2.079 | 2.04 | 1.54 | 1.30 |
| 2.288 | 1.84 | 1.39 | 1.17 |
| 2.517 | 1.67 | 1.26 | 1.06 |
| 2.77 | 1.51 | 1.14 | 0.96 |
| 3.048 | 1.37 | 1.03 | 0.87 |
| 3.354 | 1.24 | 0.94 | 0.79 |
| 3.69 | 1.12 | 0.85 | 0.71 |
| 4.061 | 1.01 | 0.77 | 0.64 |
| 4.468 | 0.92 | 0.70 | 0.58 |
| 4.916 | 0.83 | 0.63 | 0.53 |
| 5.41 | 0.75 | 0.57 | 0.48 |
| 5.953 | 0.68 | 0.52 | 0.44 |
| 6.55 | 0.62 | 0.47 | 0.39 |
| 7.207 | 0.56 | 0.43 | 0.36 |
| 7.931 | 0.51 | 0.39 | 0.32 |
| 8.727 | 0.46 | 0.35 | 0.29 |
| 9.602 | 0.42 | 0.32 | 0.27 |
| 10.57 | 0.38 | 0.29 | 0.24 |
| 11.63 | 0.35 | 0.26 | 0.22 |
| 12.79 | 0.31 | 0.24 | 0.20 |
| 14.08 | 0.28 | 0.22 | 0.18 |
| 15.49 | 0.26 | 0.20 | 0.16 |
| 17.04 | 0.23 | 0.18 | 0.15 |
| 18.75 | 0.21 | 0.16 | 0.14 |
| 20.64 | 0.19 | 0.15 | 0.12 |
| 22.71 | 0.18 | 0.13 | 0.11 |
| 24.99 | 0.16 | 0.12 | 0.10 |
| 27.49 | 0.15 | 0.11 | 0.09 |
| 30.25 | 0.13 | 0.10 | 0.08 |
| 33.29 | 0.12 | 0.09 | 0.08 |
| 36.63 | 0.11 | 0.08 | 0.07 |
| 40.31 | 0.10 | 0.07 | 0.06 |
| 44.35 | 0.09 | 0.07 | 0.06 |
| 48.8 | 0.08 | 0.06 | 0.05 |
| 53.7 | 0.07 | 0.06 | 0.05 |
| 59.09 | 0.07 | 0.05 | 0.04 |
| 65.02 | 0.06 | 0.05 | 0.04 |

The agglomeration of the unipolarly charged particles may occur in the Corona Charger and the Deflection Field because the motion of the charged dust particles is influenced by the electric field present in both the electrostatic devices. The extent of inter-particle agglomeration is not expected to be significant because of the millisecond residence time and unipolar charging of the particles. Therefore, electrostatic charging of dust particles followed by their deflection into scavenge flow path of the IPS is the most promising approach to enhance IPS separation efficiency.

Nevertheless, in some embodiments of the present invention, agglomeration of charged particles is an important feature, and one skilled in the art will recognize that agglomeration of particles can be promoted by turbulent mixing, by an electric field that is constant, time-varying (e.g., oscillating) at any frequency, or pulsed at any frequency, or a by a combination of turbulent mixing and an electric field that is constant, time-varying (e.g., oscillating) at any frequency, or pulsed at any frequency. Turbulent mixing can be promoted by a series of protrusions in the fluid stream. In embodiments of the present invention, turbulent mixing can take the form of vortices having rotational axes parallel or perpendicular to the fluid flow direction, or vortices may have rotational axes having a variety of angles varying in relation to the fluid flow.

Figure 34A:
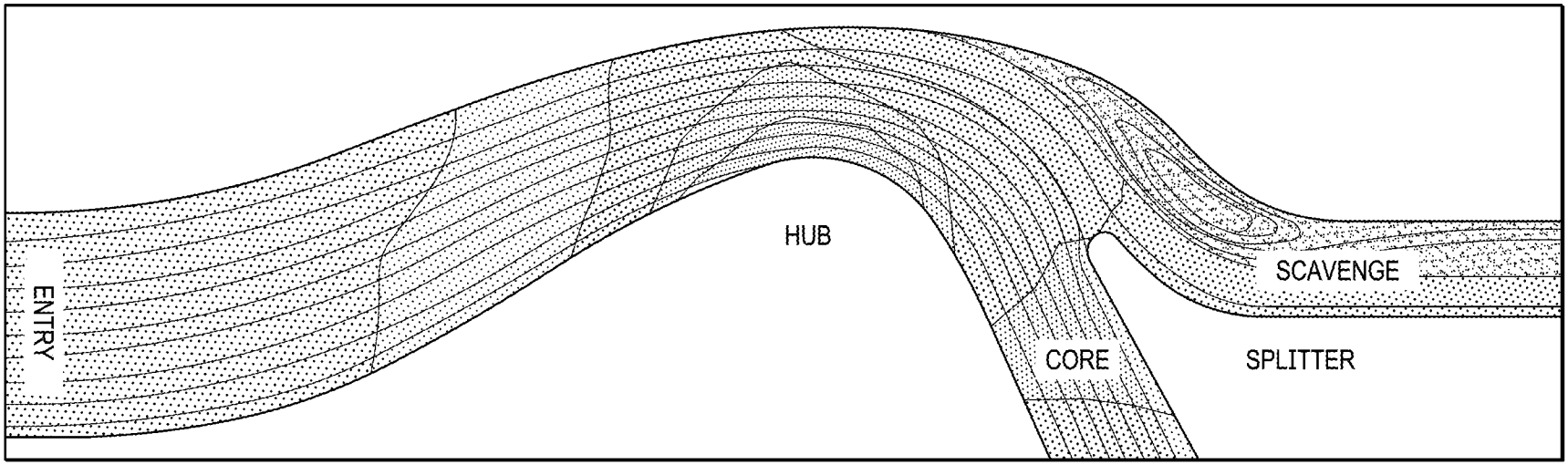
FIGS. 34A and 34B illustrate particles flowing along the flowstream lines from the inlet to the core flow section or the scavenge flow section within an IPS and the range of randomly assigned location for particle entry, respectively.
Figure 34B:
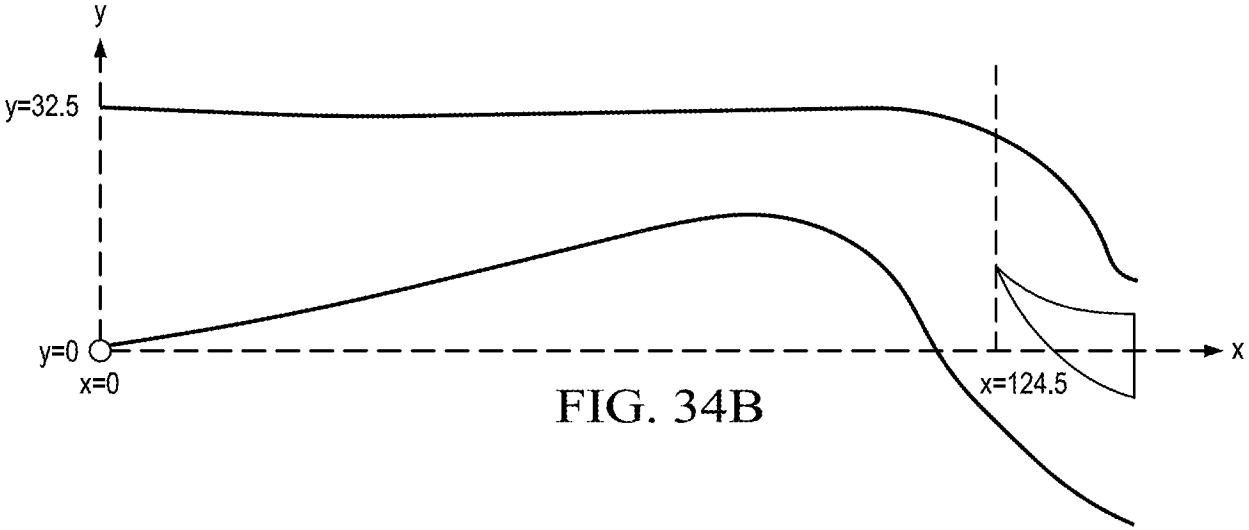

A mathematical modeling approach was developed for estimation of improvement in IPS performance by electrostatic charging in the Corona Charger followed by electrostatic deflection within a generic IPS. The modeling approach was based on the assumption that the separation efficiency for a particle depends on its size (or mass) and its location of entry at the IPS inlet. Each particle was assigned a separation efficiency based on its size and location of entry at the IPS inlet. The particles flowing along the flowstream lines from the inlet may lead to the core flow section or the scavenge flow section within an IPS are shown in FIG. 34A. (Efficiency of an Inertial Particle Separator, Dominic Barone, Eric Loth, and Philip Snyder, Journal of Propulsion and Power, Vol. 31, No. 4, July-August 2015, 997-1002.) Within the IPS, the airflow makes a hub-side turn, whereas the scavenge flow continues with very little flow turning. Very small drag-dominated particles (roughly <1 μm) tend to follow the core flow streamlines. Large particles (roughly >120 μm) are inertia dominated and therefore are weakly affected by the flow streamlines and are controlled more by their initial trajectories and any impact with the surfaces of the IPS; for moderately-sized particles (roughly 1-80 μm), the trajectories may follow core or scavenge flow streamlines because of a balance between inertial and fluid forces. (Influence of Particle Size on Inertial Particle Separator Efficiency, Dominic Barone, Eric Loth, and Philip Snyder, Powder technology, 318, 2017, 177-185.) For these particles, the IPS separation efficiency is about 70% and they are reported to cause detrimental effects on turbine engine performance and durability. (Electrostatic Methods for Improved Separation in Turbine Engines of Fine Sand/Dust Particles, A14-004, 2014.1 Army SBIR Solicitation.) The location of entry for very small and moderately-sized particles sets their initial path within the IPS. For calculation, the particles ranging from 0.66 to 65 μm were randomly sampled from a population of test dust particles and randomly assigned a location of entry (x=0, y=0 to 32.5 mm) as shown in FIG. 34B.

Figure 35:
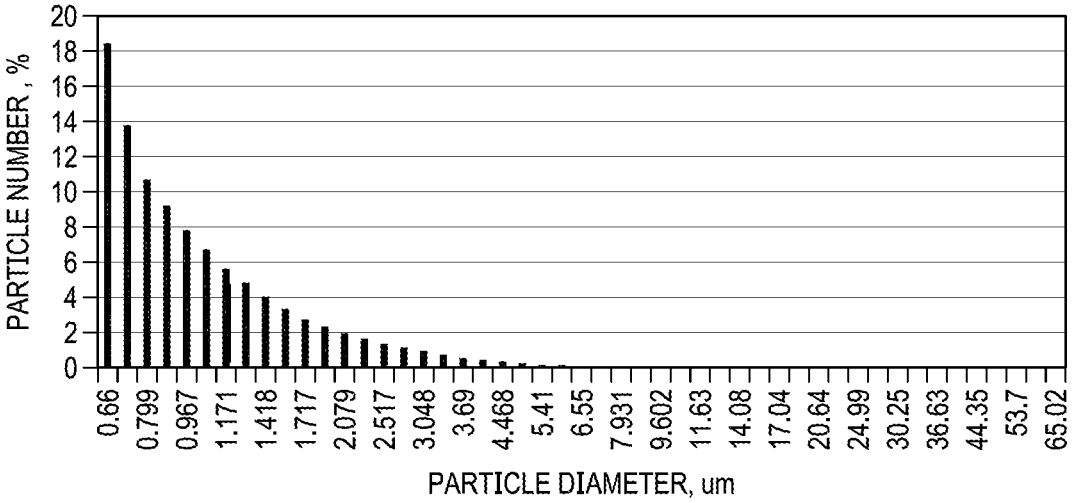
FIG. 35 illustrates the particle size distribution for a batch of Arizona fine test dust.

The particle size distribution for one batch of Arizona A2 fine test dust (10666F) is shown in FIG. 35. The graph was made from particle size measurement data obtained from the manufacturer of the test dust (Powder Technology Inc.). The graph shows that the proportion of fine particles is high on a number basis.

Figure 36A:
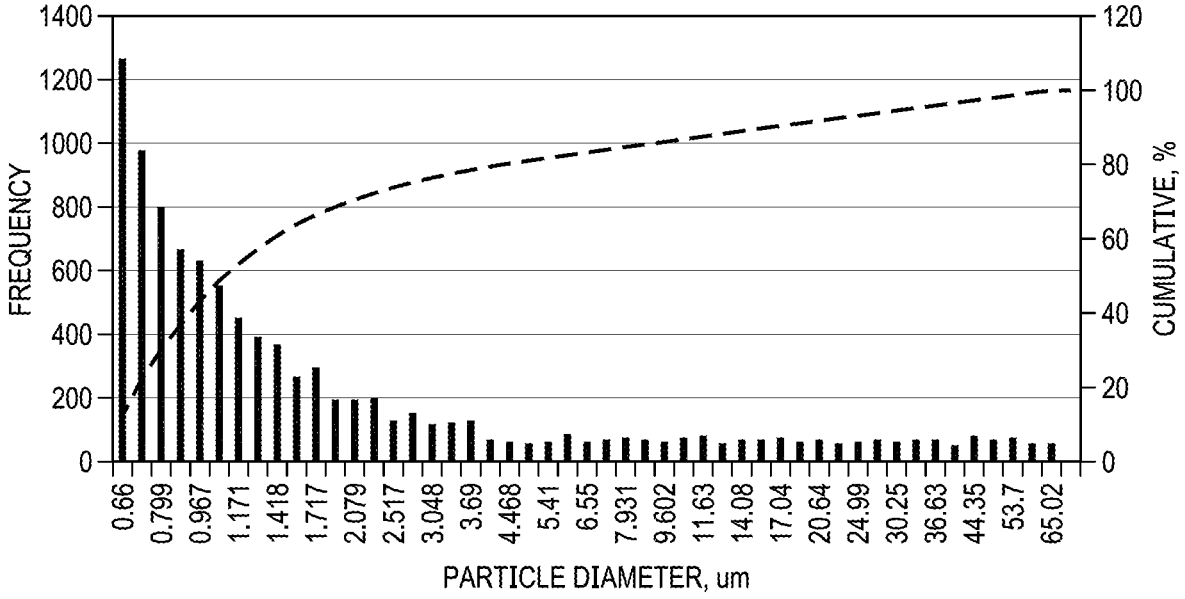
FIGS. 36A and 36B shows the number of particles and number concentration selected for each particle size ranging from 0.66 μm to 65.02 μm, respectively.
Figure 36B:
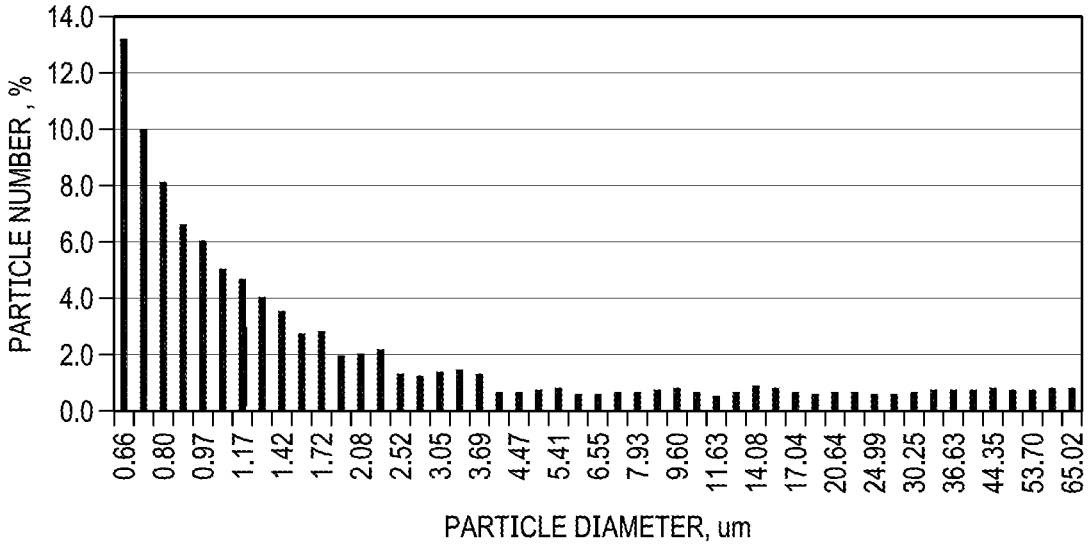

For the mathematical model of a generic IPS, ten thousand particles were selected to create a population that has size distribution similar to that for Arizona A2 fine test dust. FIG. 36A shows the number of particles selected for each particle size ranging from 0.66 μm to 65.02 μm for one simulation run. FIG. 36B is the plot for number concentration and it shows a similar trend to the Arizona A2 fine test dust.

Figure 37:
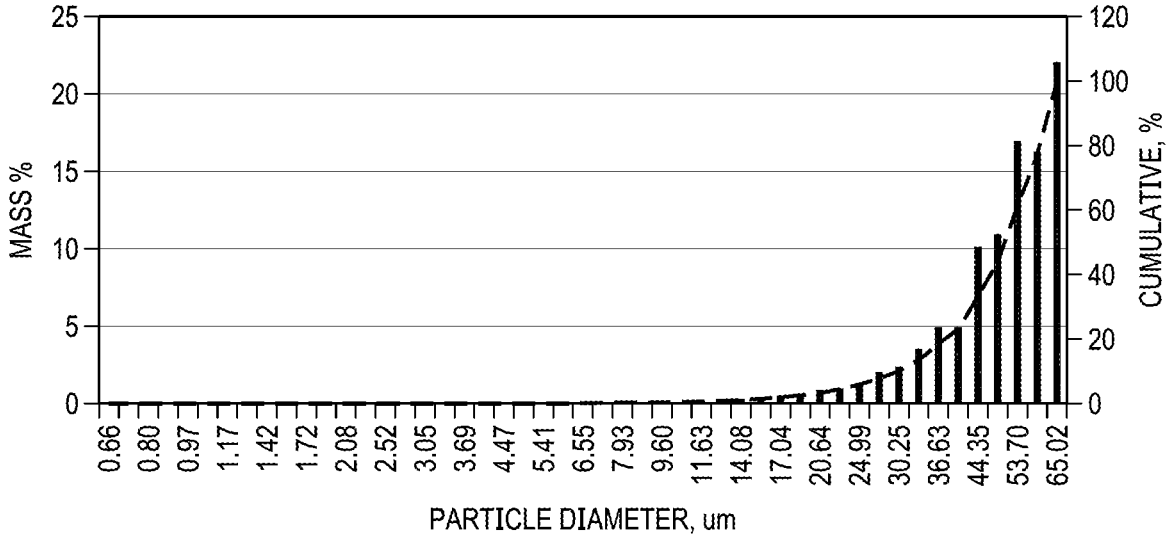
FIG. 37 shows the size distribution of sampled population in terms of mass for the same simulation run as the run treated in FIGS. 36A and 36B.

FIG. 37 shows the size distribution of sampled population in terms of mass for a simulation run. It is to be noted that 90% mass is occupied by particles greater than 25 μm. Though there are large numbers of fine particles, their contribution in terms of mass is not significant. This plot shows that even if all particles less than 25 μm were electrostatically deflected to the scavenge flow, the maximum improvement in IPS separation efficiency is 10 percent points.

Figure 38:
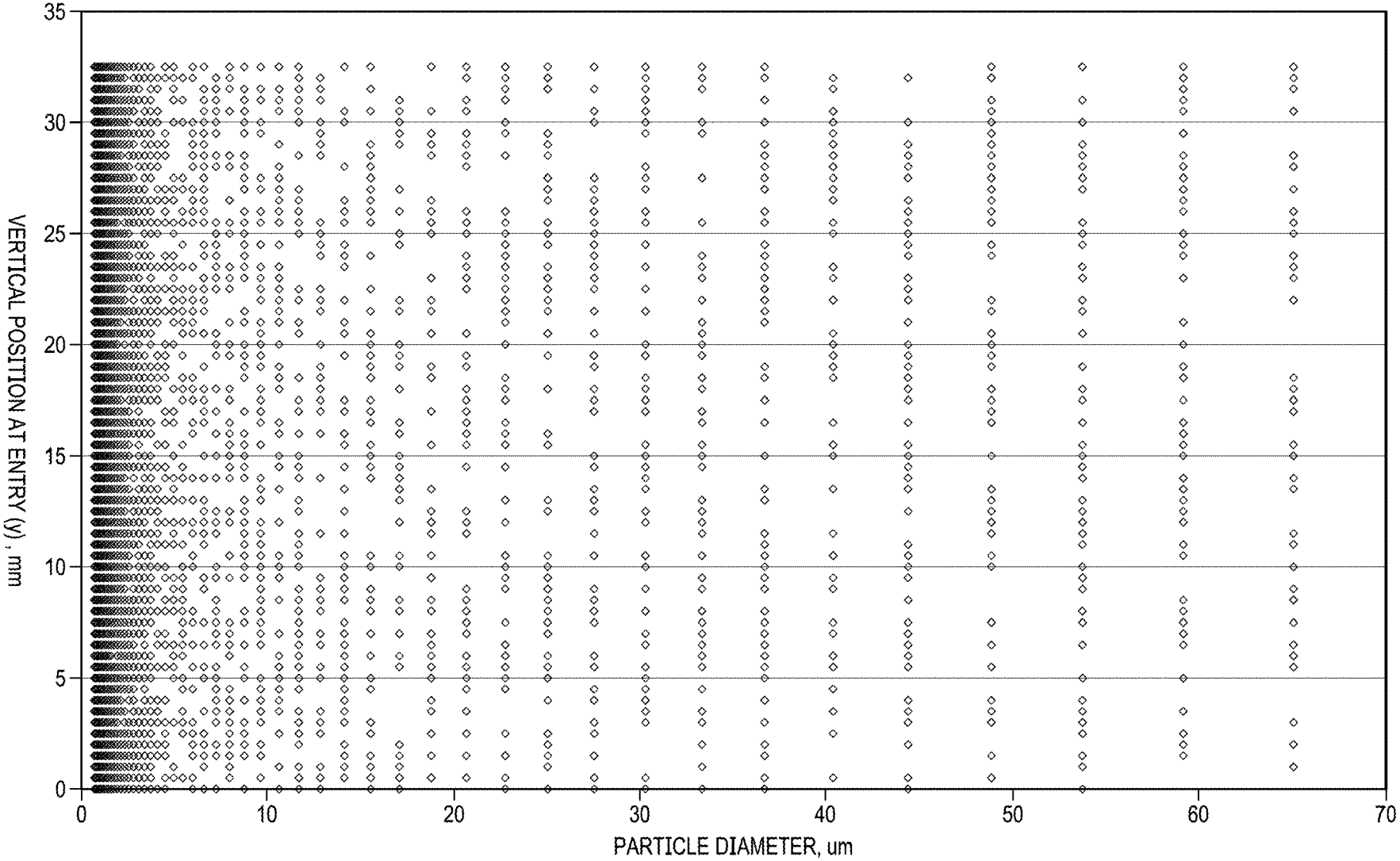
FIG. 38 illustrates the position and diameter of all the particles selected for one simulation run.

The ten thousand particles in the sample population were randomly assigned initial positions (y=0 to 32.5 mm) at the IPS inlet. FIG. 38 shows the position and diameter of all the particles selected for one simulation run. The plot shows that the particles are uniformly distributed within the inlet of the IPS.

The mathematical model describing the performance of a generic IPS is developed as follows. The separation efficiency ηi is assigned to particles based on their diameter i and position at entry y, according to Equation 6:

$$\eta i = y * f + \eta i0 \qquad \text{Equation 6:}$$

Figure 39:
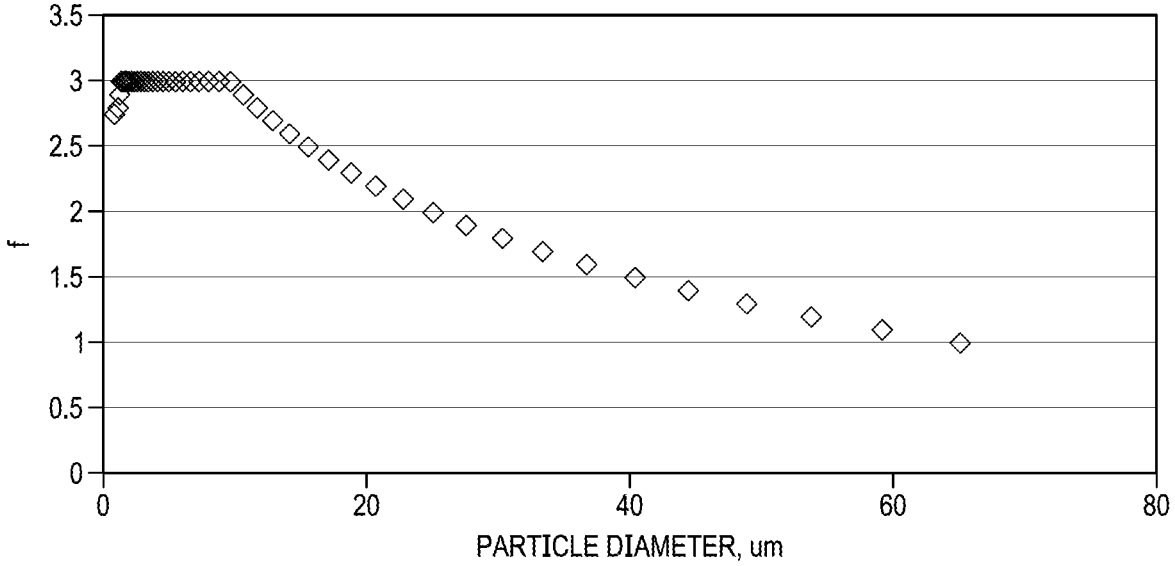
FIG. 39 depicts the value of the factor f which determines increase in separation efficiency with displacement towards outer shroud, for different particle diameters.

Here ηi0 is separation efficiency at the inner shroud for a particle with diameter i. It is bound as follows 0.5%≤ηi0≥56%. The position at entry is bound as follows: 0 mm≤y≥32.5 mm. Here y=0 corresponds to the inner shroud surface, while y=32.5 corresponds to the outer shroud surface. The factor f determines increase in separation efficiency with displacement towards outer shroud; the value off for different particle diameters is shown in FIG. 39.

Figure 40:
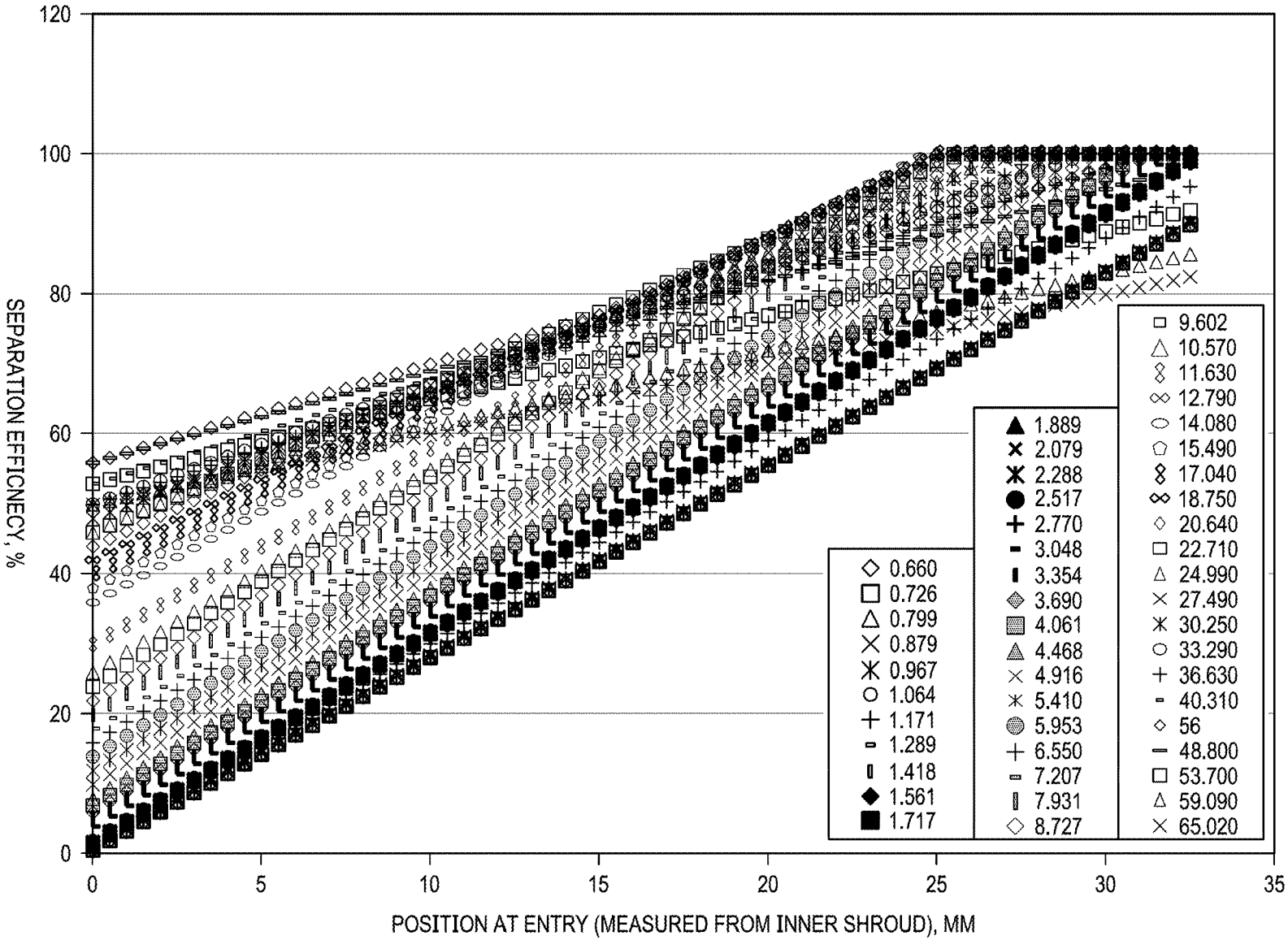
FIG. 40 shows the separation efficiency vs. position at entry based on the IPS model.

The separation efficiency plot based on the mathematical model of a generic IPS is shown in FIG. 40. It demonstrates the change in separation efficiency with particle diameter and position of entry at the IPS inlet. Once the particle diameter and position is specified, the separation efficiency can be derived from this plot.

Figure 41:
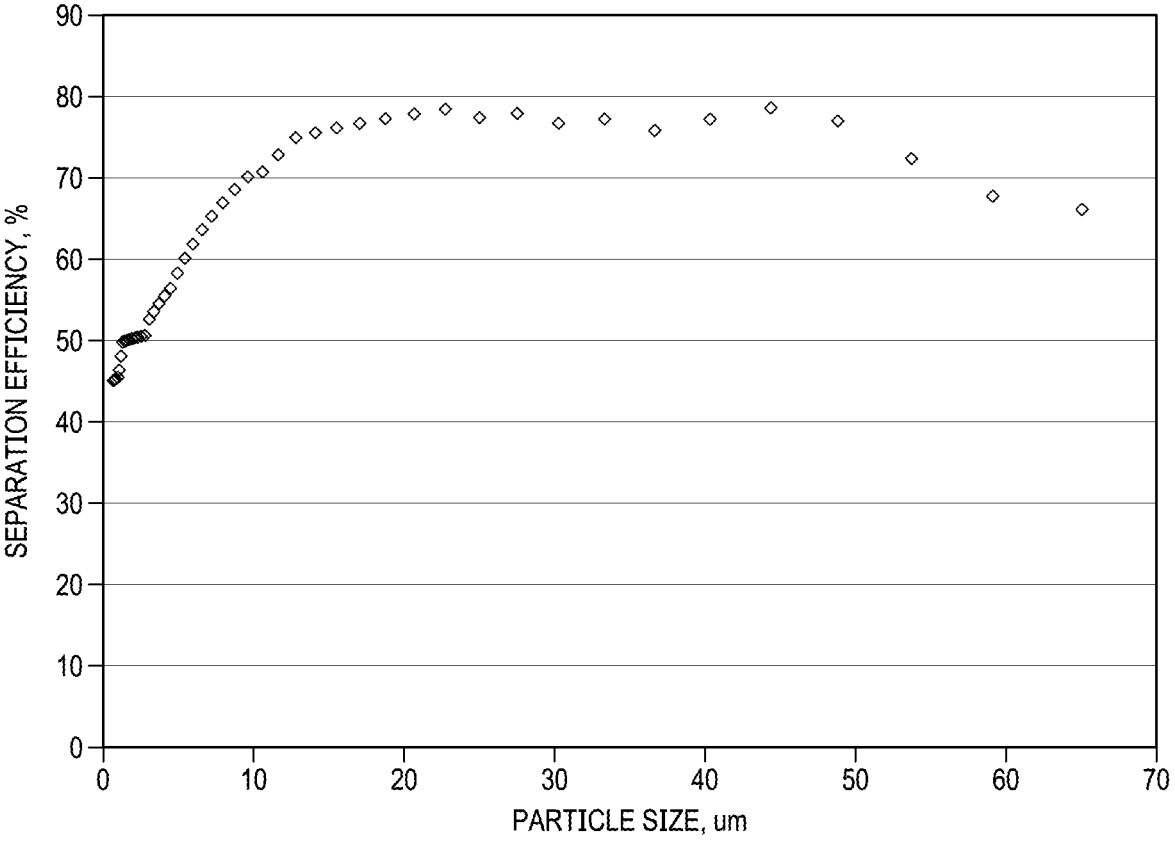
FIG. 41 shows the separation efficiency vs. particle size based on the IPS model.

The average separation efficiency for a particular size can be obtained by averaging separation efficiency values for all y-values. The average separation efficiency was calculated in this manner for all particles with diameter ranging from 0.66 μm to 65.02 μm. The average separation efficiency is plotted in FIG. 41 as a function of particle size.

To find the IPS separation efficiency $\eta_{IPS}$, the mass-weighted average was calculated as per Equation 7:

$$\eta_{IPS} = \frac{\sum_{i=0.66}^{65.02} \eta_i \times i^3}{\sum_{i=0.66}^{65.02} i^3} \qquad \text{Equation 7}$$

Here, $\eta_i$ is the average separation efficiency corresponding to particle diameter i. Using the IPS model, ten simulation runs were conducted for the IPS without electrostatic enhancement and another ten runs were conducted with electrostatic enhancement. The displacement in y-direction $\delta_y$ due to electrostatic field within the IPS as calculated in the earlier section was then added to the initial position at entry to obtain a new position at entry ($y'=y+\delta_y$). The particle will then follow the flowstream line originating at the new location of entry and be separated out into the scavenge flow at the separation efficiency corresponding to the new location.

Figure 42A:
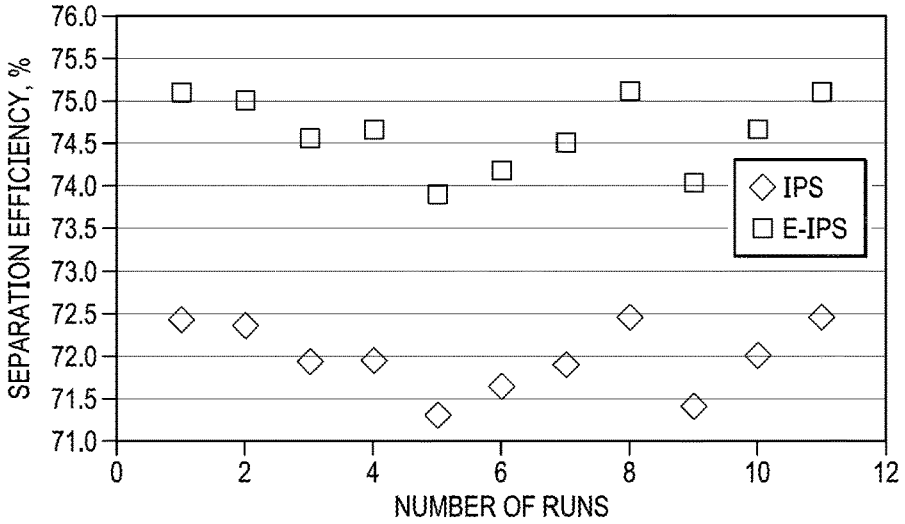
FIGS. 42A, 42B, 42C, and 42D show calculated IPS separation efficiencies for inlet flow rates of 8.00, 9.18, and 10.00 lb/s and improvements in separation efficiencies, respectively.
Figure 42B:
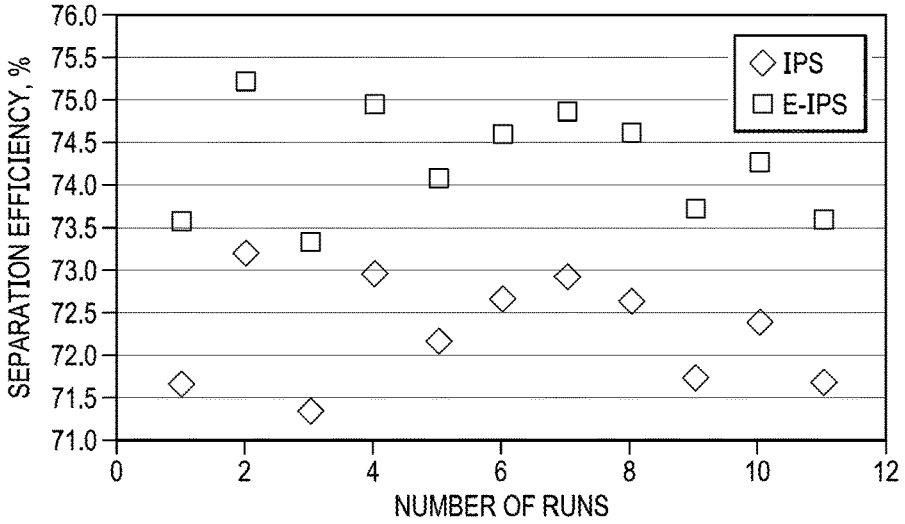
Figure 42C:
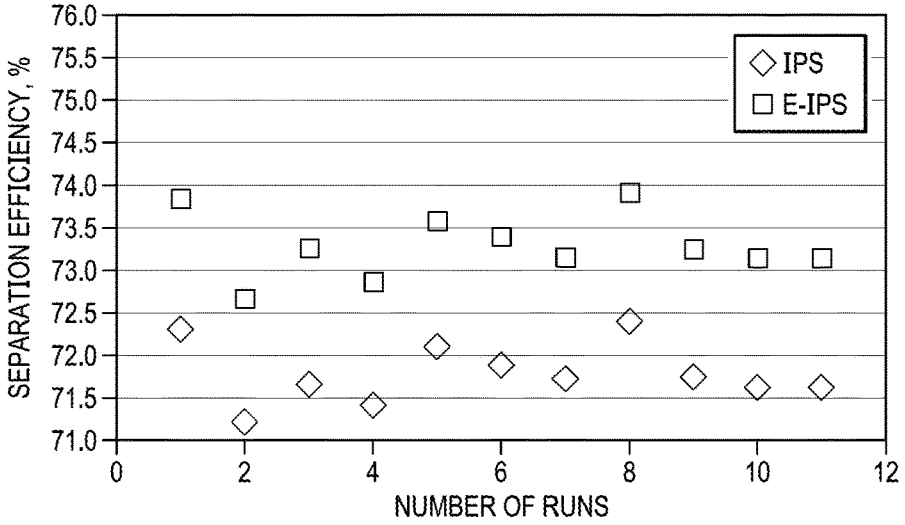
Figure 42D:
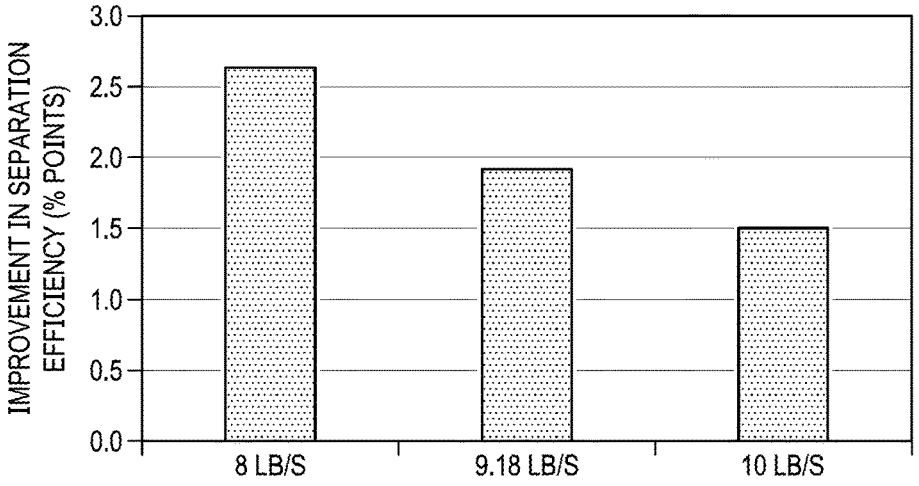

The mathematical model described above was used to calculate IPS separation efficiency with and without electrostatic enhancement. The calculated IPS separation efficiencies for three inlet flow rates of 8.00, 9.18 and 10.00 lb/s are shown in FIGS. 42A, 42B, and 42C, respectively. Twenty simulation runs were performed at each flowrate. An improvement in IPS separation efficiency due to electrostatic enhancement is observed at every flowrate. The average IPS separation efficiency without electrostatic enhancement is 72.00%, 72.29%, and 71.80% at 8.00, 9.18 and 10.00 lb/s, respectively. The average separation efficiency with electrostatic enhancement increases to 74.63%, 74.21%, and 73.30% for 8.00, 9.18 and 10.00 lb/s, respectively. The net average improvement due to electrostatic enhancement is 1.50%, 1.92% and 2.63% at the three flow rates under consideration as shown in FIG. 42D.

The improvement in separation efficiency is higher when it is calculated on a particle number basis for the population of ten thousand particles. Since $\eta_i$ is the average separation efficiency corresponding to particle diameter i and there are 49 particle diameters (i=0.66 to 65.02) under consideration, the separation efficiency on a number basis can be calculated as per Equation 8:

$$\eta'_{IPS} = \frac{\sum_{i=0.66}^{65.02} \eta_i}{49} \qquad \text{Equation 8}$$

Figure 43A:
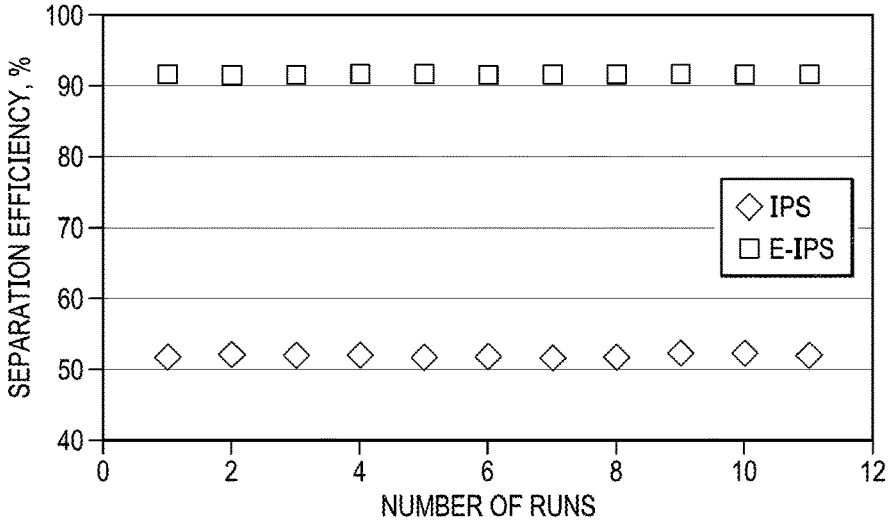
FIGS. 43A, 43B, 43C, and 43D show calculated IPS separation efficiencies using Equation 8 for inlet flow rates of 8.00, 9.18, and 10.00 lb/s and improvements in separation efficiencies, respectively.
Figure 43B:
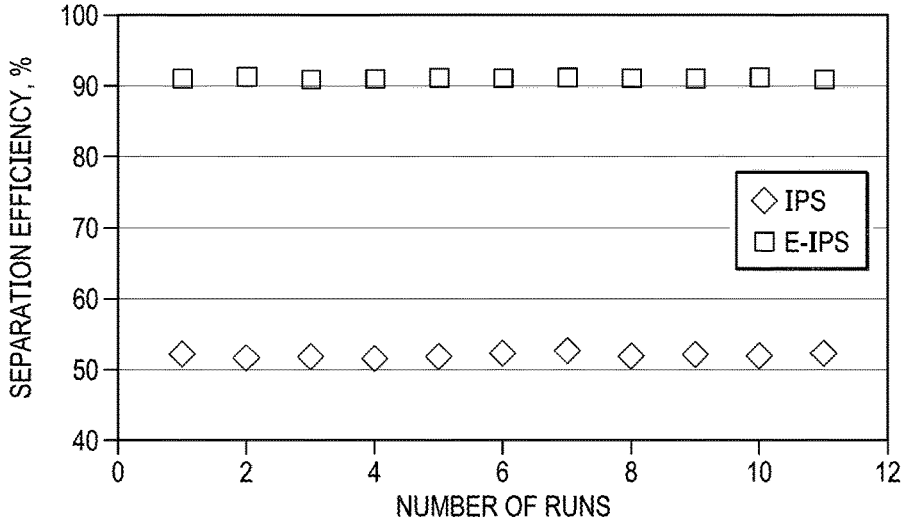
Figure 43C:
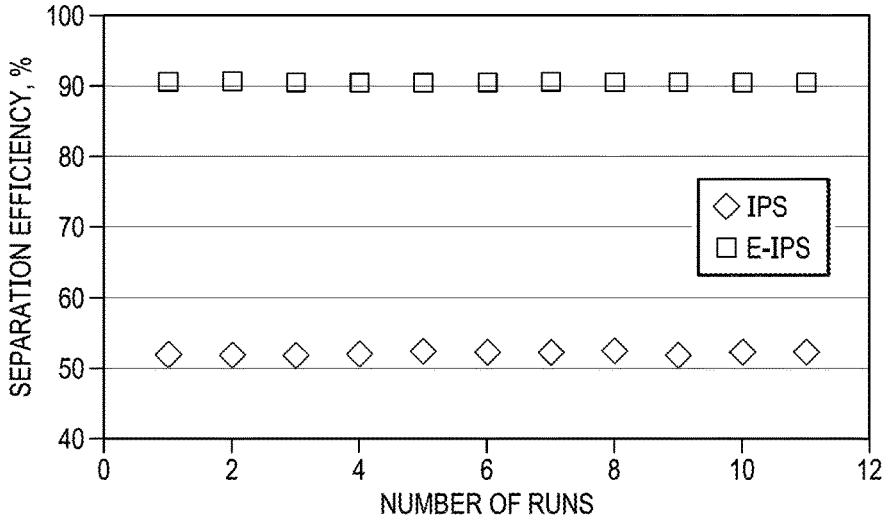
Figure 43D:
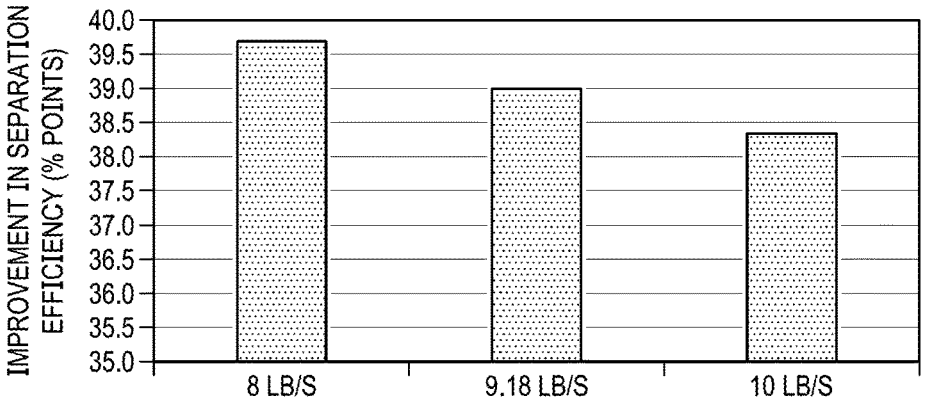

Using the mathematical model of the IPS, the average separation efficiency on a number basis without electrostatic enhancement is 52.16%, 52.22% and 52.33% for three inlet flow rates of 8.00, 9.18 and 10.00 lb/s as shown in FIGS. 28A, 28B, and 28C, respectively. With electrostatic enhancement, the IPS separation efficiency increases to 91.85, 91.19 and 90.67% on a number-basis for 8, 9.18 and 10 lb/s, respectively, again as shown in FIGS. 43A, 43B, and 43C. Comparison of the separation efficiency improvement obtained by mass-weighted average (1.5-2.6%) and number basis (38.3-39.7%) indicates that a large number of particles with relatively low mass are separated due to electrostatic charging and agglomeration. FIG. 43D shows improvement in separation efficiencies on a number basis for the three inlet flow rates of 8.00, 9.18 and 10.00 lb/s.

Figure 44A:
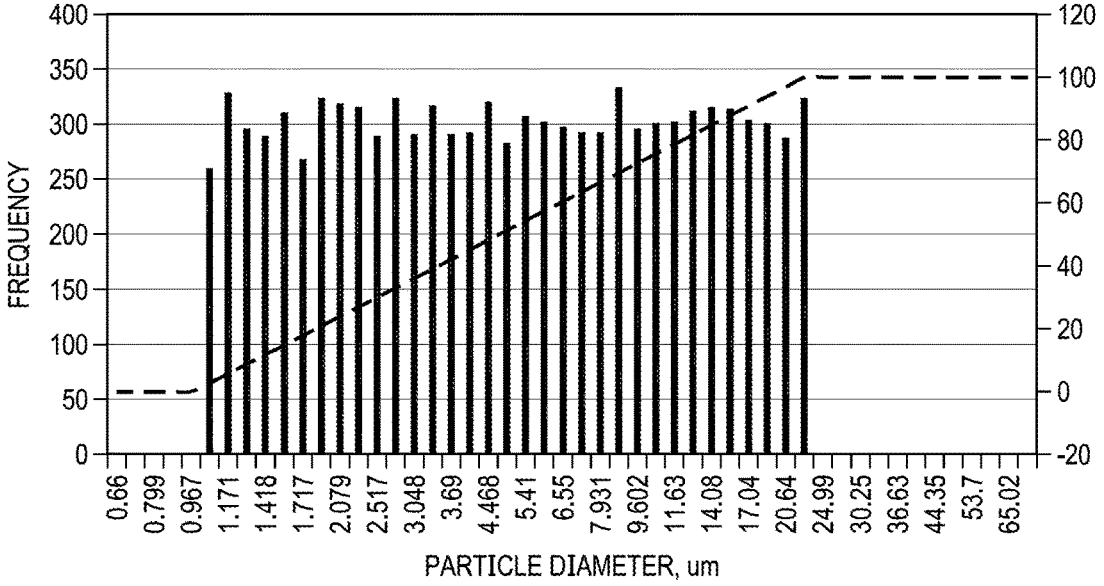
FIGS. 44A, 44B, and 44C illustrates particle size distribution by frequency, particle number (percentage), and mass (percentage), respectively.
Figure 44B:
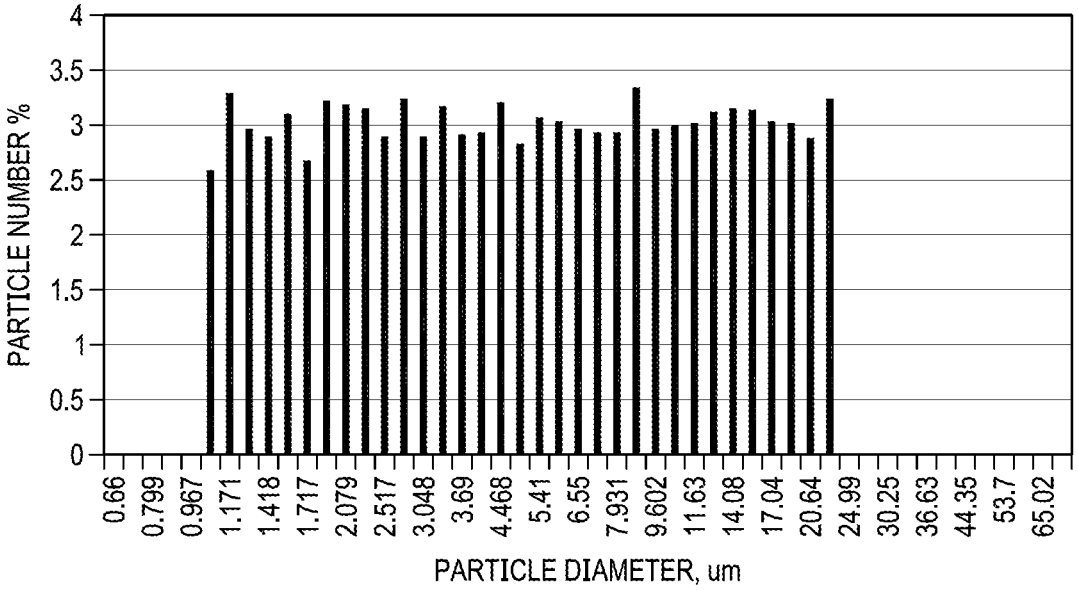
Figure 44C:
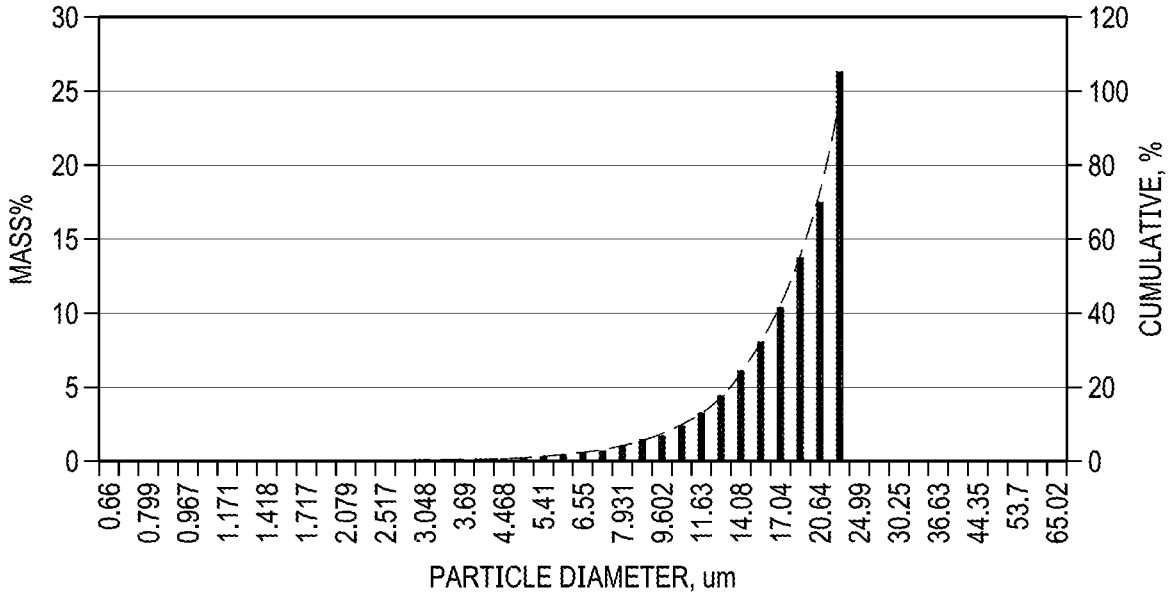

To demonstrate the effect of particle size distribution on improvement of IPS separation efficiency by electrostatic enhancement, a new population was created with equal number of particles with diameter ranging from 1 μm to 22 μm. The size distribution of the particles in the new population is shown in FIGS. 44A, 44B, and 44C by frequency, particle number (percentage), and mass (percentage), respectively. The population consists of 250-300 particles of each selected diameter, which is about 3% in particle number. In terms of mass, 90% of the mass contribution is from particles within 10-22 μm.

Figure 45A:
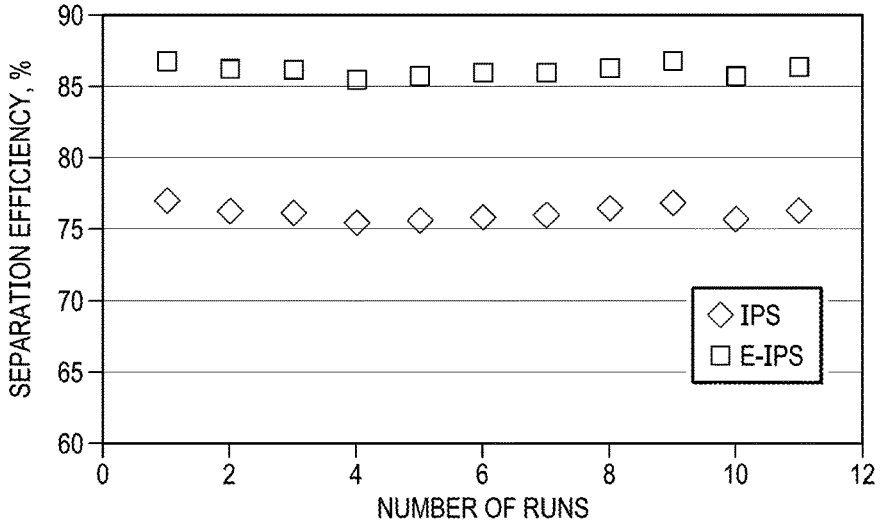
FIGS. 45A, 45B, 45C, 45D, 45E, and 45F illustrate separation efficiencies for inlet flow rates of 8.00, 9.18, and 10.00 lb/s (FIGS. 30A and 30B for 8.00 lb/s, FIGS. 30C and 30D for 9.18 lb/s, and FIGS. 30E and 30F for 10.00 lb/s).
Figure 45B:
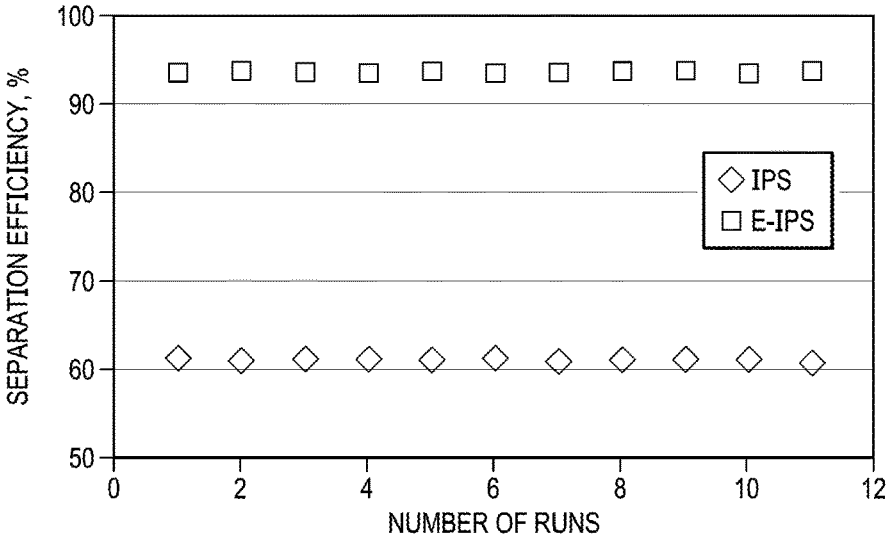
Figure 45C:
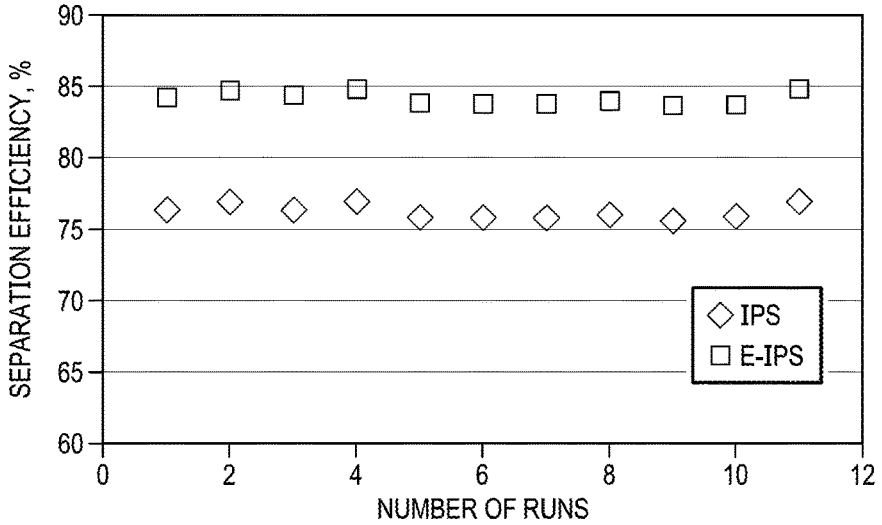
Figure 45D:
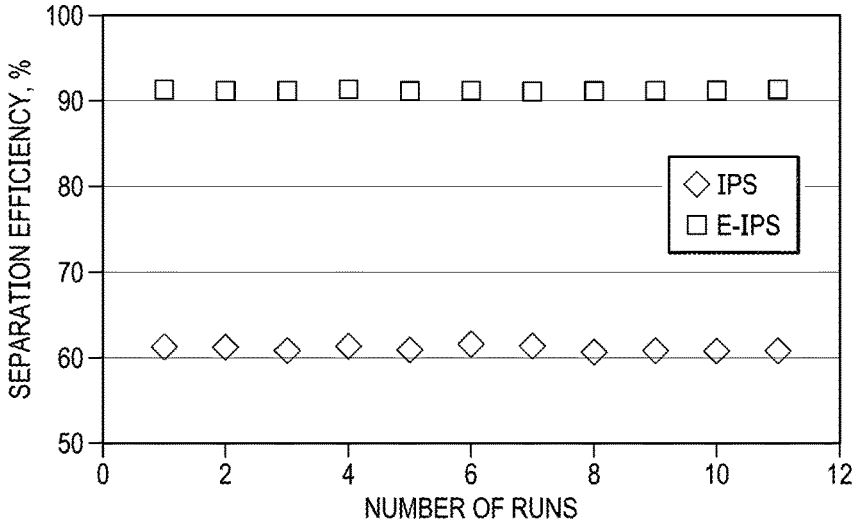
Figure 45E:
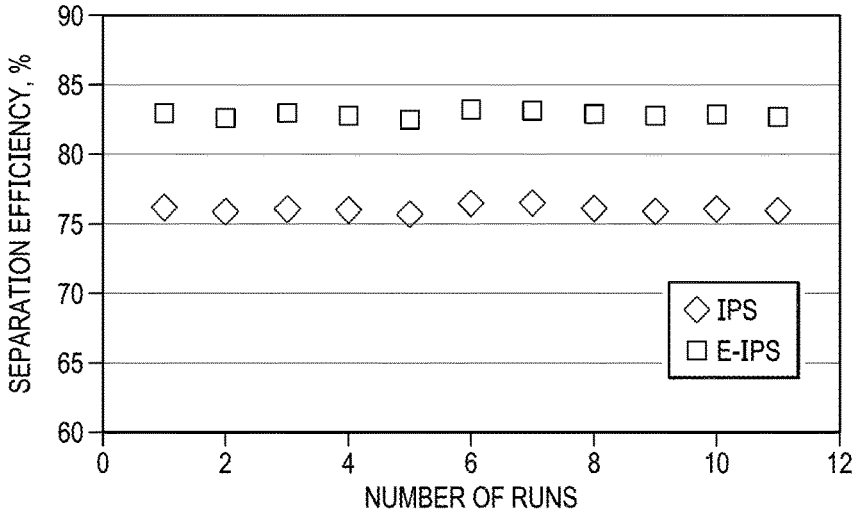
Figure 45F:
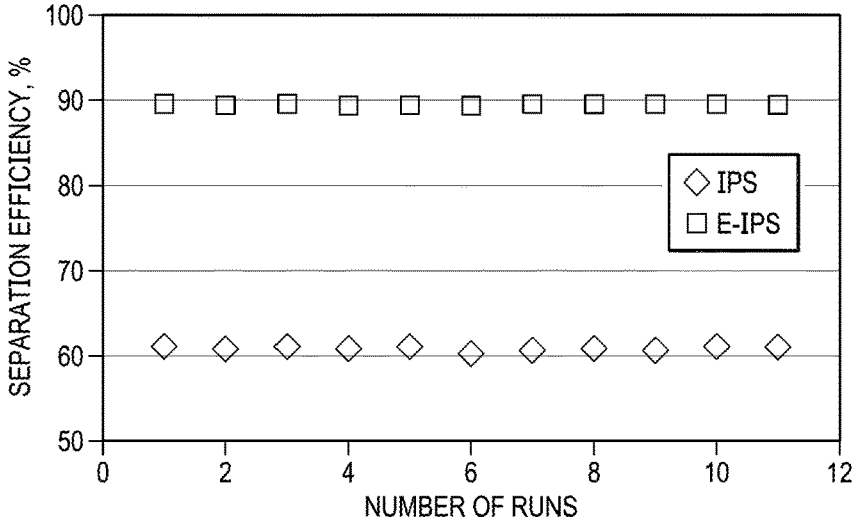

The new population was used in the mathematical model of the IPS to calculate separation efficiency without and with electrostatic enhancement. The results from simulation runs to calculate mass-weighted separation efficiency and number-based separation efficiency are shown in FIGS. 45A-45F for 8, 9.18, and 10 lb/s. FIGS. 45A and 45B show mass-weighted and number-based separation efficiency, respectively, for 8.00 lb/s, FIGS. 45C and 45D show mass-weighted and number-based separation efficiency, respectively, for 9.18 lb/s, and FIGS. 45E and 45F show mass-weighted and number-based separation efficiency, respectively, for 10.00 lb/s. The average IPS separation efficiency in the absence of electrostatic enhancement is 76.19%, 76.28% and 76.28% for inlet flowrates of 8.00, 9.18 and 10.00 lb/s. With electrostatic enhancement, the separation efficiency increases to 86.19%, 84.18%, and 82.91%, respectively. FIGS. 45B, 45D, and 45F show results obtained for the number-basis calculation. The average IPS separation efficiency in the absence of electrostatic enhancement is 61.06%, 61.21% and 61.04% for the three inlet flow rates. With electrostatic enhancement, the separation efficiency increases to 93.71%, 91.32%, and 89.58% for inlet flowrates of 8.00, 9.18, and 10.00 lb/s.

Figure 46A:
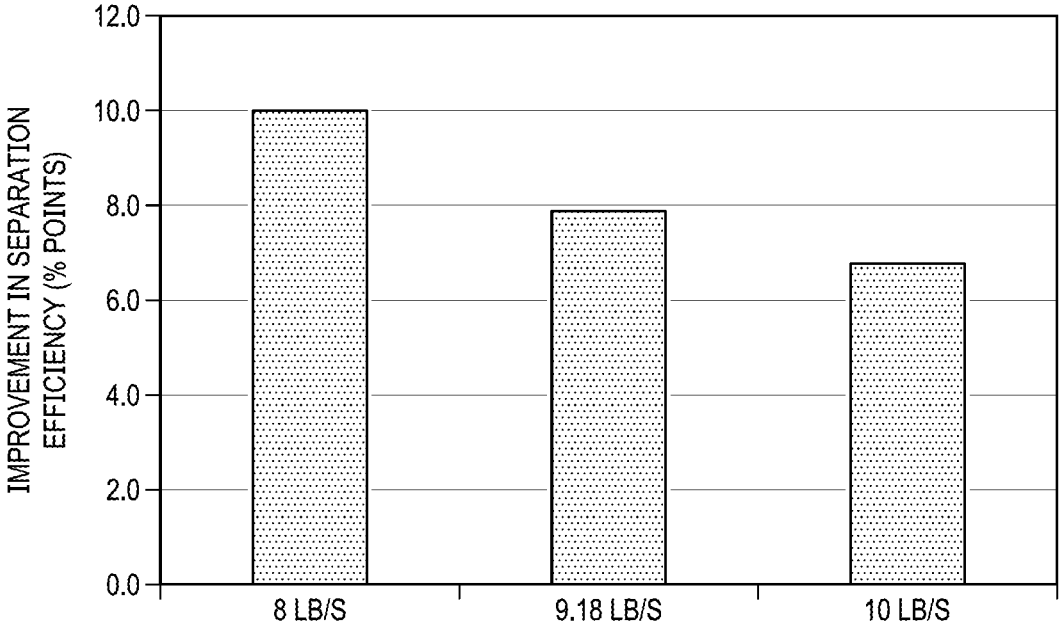
FIGS. 46A and 46B show mass-weighted IPS separation efficiency and number-based IPS separation efficiency calculated for 1-22 μm particles, respectively.
Figure 46B:
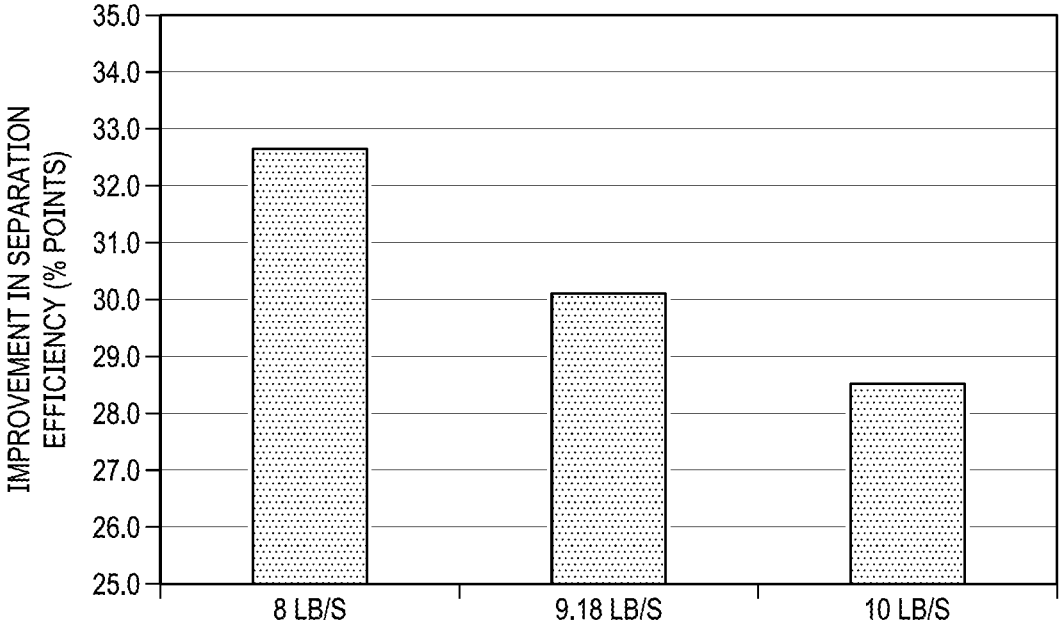

For particles of 1-22 μm, the improvement in mass-weighted IPS separation efficiency is 10.00%, 7.90%, and 6.79% for 8, 9.18, and 10 lb/s inlet air flowrates, as shown in FIG. 46A. The improvement in IPS separation efficiency calculated on a number basis is 32.66%, 30.11%, and 28.54% respectively as shown in FIG. 46B.

Thus the Corona Charging and Deflection Field can appreciably improve IPS separation efficiency based on particle size distribution. It is to be noted that the calculated improvement is a conservative estimate because all the particles were assumed to be silica, which are the hardest to impart charge among all the constituents of Arizona A2 fine and AFRL03 test dust. From the above analysis, it can be concluded that for flow velocities ranging from 64.6 to 80.7 m/s at the IPS inlet, the IPS separation efficiency can be appreciably improved with a system as follows: (i) a Corona Charger with maximum and average field strength of 51.6 kV/cm and 15.53 kV/cm, respectively and (ii) a Deflection Field with field strength of 18.55 kV/cm.

The pressure loss due to the Corona Charger was estimated by the following steps. The cross-sectional area (70.799 in2) and the wetted perimeter (124.944 in) for the Corona Charger were first calculated. This involves taking into account the annular opening of the Corona Charger as well as the 54 electrodes present in the flow path. The hydraulic radius (0.567 in) was then calculated by dividing the cross-sectional area with the wetted perimeter. The equivalent diameter (2.267 in) was then calculated by multiplying the hydraulic radius by 4. The equivalent diameter was then used in the Darcy's equation to obtain the pressure loss, assuming no major change in air density and velocity as it flows through the Corona Charger. The intake air flow rate was 9.18 lb/s at 15.2° C. and 1 atm. The calculated pressure loss for the Corona Charger is 0.31 inches water column or 0.08% for the active length of 3.5" considered in this study. For additional length of the Charger, the incurred pressure loss is shown in Table 8.

TABLE 8

Estimated pressure loss due to Corona Charger installed at the IPS inlet

| Corona Charger Length (in) | Pressure loss (in WC) | Pressure loss (%) |
|---|---|---|
| 3.5 | 0.31 | 0.08 |
| 5.5 | 0.49 | 0.12 |
| 11 | 0.97 | 0.24 |

Figure 47:
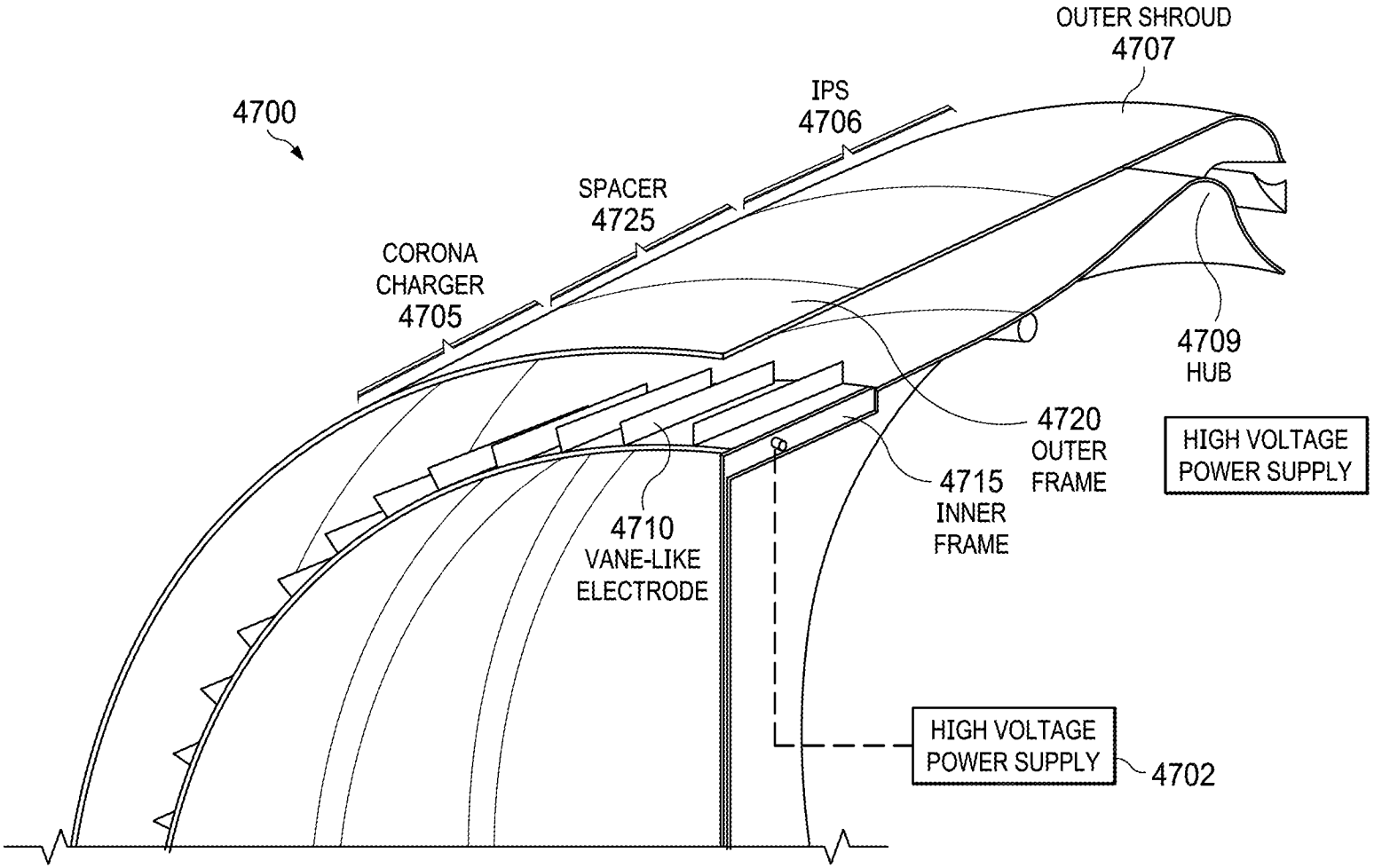
FIG. 47 shows the integration of the Corona Charger with an IPS.

The integration 4700 of one embodiment of the Corona Charger with vane-like electrodes with triangular-shaped tips as in FIG. 25C is shown with an IPS in FIG. 47. The diameter of Corona Charger 4705 is based on the diameters of the IPS 4706—18.74" (outer shroud 4707)×16.17" (inner shroud). The vane-like electrodes 4710 installed on the inner frame 4715 are maintained at negative potential, while the outer frame 4720 is grounded. The vane-like electrode 4710 has a thickness of 0.015". The cross-section of the vane-like electrode 4710 is considered as the sum of the rectangular section (0.015"×0.25") and a triangular section (½×0.05"×0.05"). The length of the vane-like electrode 4710 (3.5") is termed as the active length. The 54 vane-like electrodes 4710 are supplied power by a connector ring (0.124" thick and 8.086" diameter). Overall, the Corona Charger 4705 has the same diameter as the IPS 4706 inlet but will only be 3.5-5.5" long, depending upon the chosen Deflection Field scheme (discussed below). The thickness of the outer frame 4720 and inner frame 4715 is similar to the thickness of the outer shroud 4707 of the IPS (0.044"). The outer frame 4720 and inner frame 4715 material is considered to be aluminum and alumina (representative dielectric), respectively. The material for the vane-like electrodes 4715 and the connector ring is considered to be stainless steel. The densities of aluminum (167 lb/ft$^3$), alumina (230 lb/ft$^3$), and stainless steel (490 lb/ft$^3$) were used for calculating the weight of the Corona Charger 4705. The weight of the Charger 4705, calculated as the sum of the weight of the outer frame 4720, inner frame 4715, 54 vane-like electrodes 4710, and the connector ring was 2.05 lbs.

The Deflection Field can be applied to the IPS 4706 in one of the following two schemes: (i) The outer shroud 4707 (~4.9" long section) of the IPS 4706 is maintained at positive potential by connection to a high voltage power source 4708 and the inner hub 4709 is grounded. In this scheme, a spacer 4725 is required to isolate the positively charged outer shroud 4707 of the IPS 4706 from the Corona Charger 4705. The exact length of the spacer 4725 is to be determined but 2" is an initial approximation, which is twice the electrode-ground gap in the Corona Charger 4705. The spacer 4725 consists of an inner frame 4730 and outer frame 4720 similar to the Charger 4705. The spacer 4725 is to be fabricated from a dielectric material. Assuming a length of 2" and density of alumina, the spacer 4725 weight is about 1.28 lbs. The total weight of the Corona Charger 4705 and the spacer 4725 is about 3.33 lbs. (ii) In the second scheme, the inner hub 4709 is maintained at negative potential. Therefore the negatively charged particles are pushed outwards due to electrostatic repulsion with the inner hub 4709. In this scheme, no spacer 4725 is required and a single power supply may be used for the Charger 4705 and the Deflection Field. It is to be noted that the Deflection Field can be generated within any separation device such as an IPS by maintaining an electric field across the flow path. The electric field is generated by applying a potential difference across the walls defining the flow path. The Deflection Field can be generated within a single IPS, single IPS with adjustable scavenge path (U.S. Pat. No. 7,927,408 B2), or plurality of IPSes attached to a single engine (U.S. Pat. No. 6,508,052 B1), The Deflection Field is applied in the volume of the IPS flowpath and therefore does not require any additional space. The IPS splitter will need to be fabricated from a dielectric material to isolate rest of the engine from the outer shroud of the IPS which is maintained at a high potential. Since no change in volume of the IPS is expected from its electrostatic enhancement, the change in weight due change in material of the IPS splitter is not expected to be significant. The volume, weight and power requirements are summarized in Table 9.

TABLE 9

Space, Weight, and Power Requirements for the Corona Charger and the Deflection Field

| | Corona Charger (CC) | Deflection Field (DF) | Power Supply |
|---|---|---|---|
| Volume | φ18.7" × 3.5-5.5" | No additional volume | 4.75" H × 12" W × 12" D (CC)<br>4.75" H × 6" W × 12" D (DF) |
| Weight | <3.5 lbs | Negligible change in IPS weight | 26 lbs (CC)-40 lbs (CC + DF) |
| Gross Power | 3.84-4.32 kW = 5.15-5.79 hp <0.2% of 3000 shp engine | | |

The Corona Charger is powered by a high voltage DC power supply capable of providing 52 kV and 66.42 mA (1.23 mA/electrode×54 electrodes). Therefore the net power for the Charger is 3,454 W. The Deflection Field requires very low power (40 kV×0.1 mA=4 W). Commercially available power supplies of similar capability are about 80-90% efficient and therefore the gross power is expected to be 3.84-4.32 kW. As shown in Table 9, the power requirement is a small fraction of the rated engine power. Depending on the Deflection Field, scheme the weight and volume of the power supply will vary. If the first scheme is used, two separate power supplies are needed to power the Corona Charger and the Deflection Field. If the second scheme is used, only the power supply for the Corona Charger is needed. The weights listed in Table 9 are for commercially available power supplies of similar output. These supplies include electronics for local operation and monitoring, which are not required for the IPS application since these power supplies will be integrated with the aircraft electronics. Therefore, the volume and weight of the power supplies are expected to be lower than the listed values.

Figure 48A:
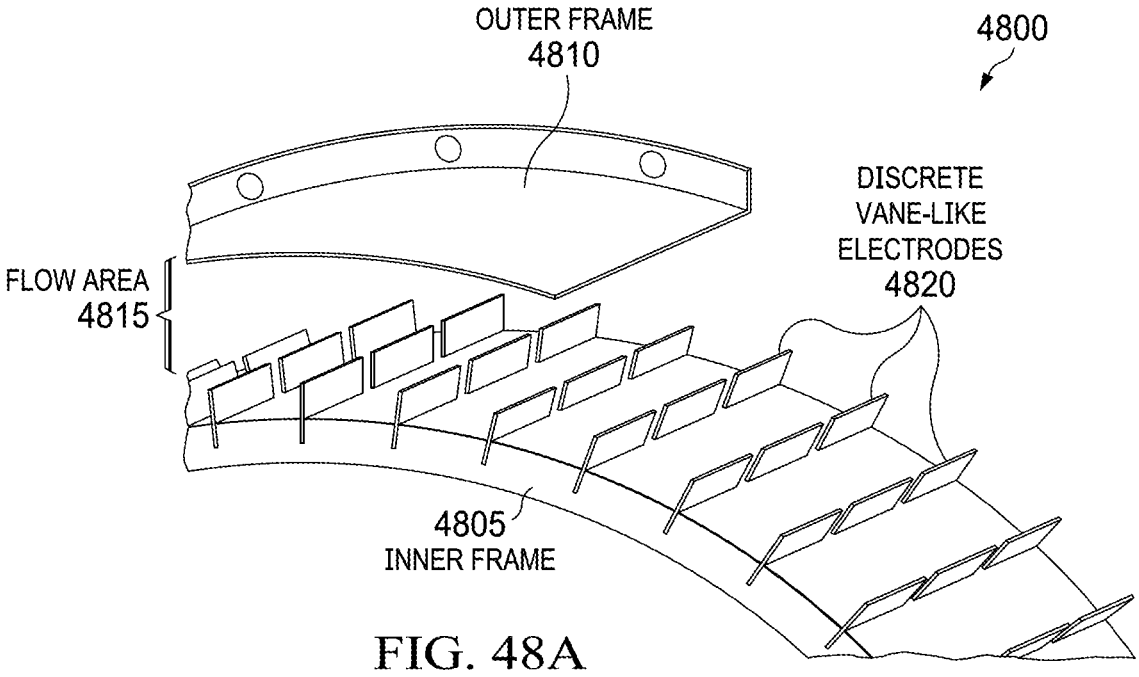
FIGS. 48A and 48B show a sectional view of Corona Chargers with discrete vane-like electrodes and offset discrete vane-like electrodes, respectively.
Figure 48B:
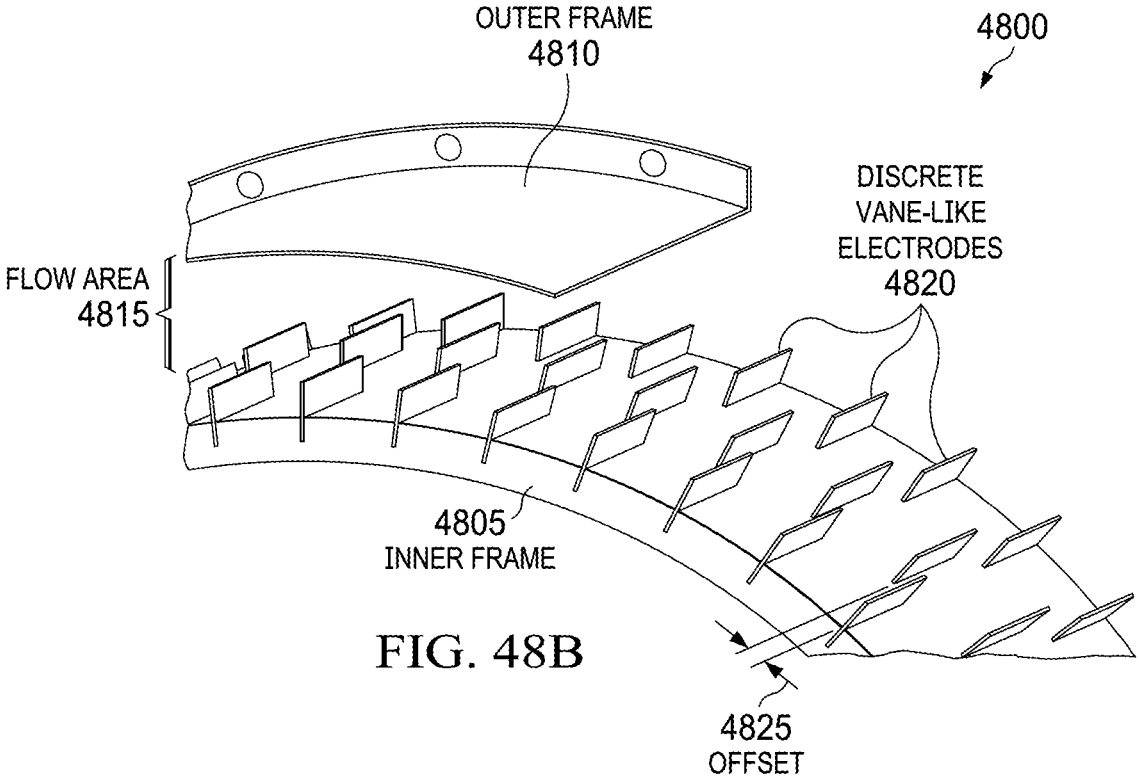

FIG. 47 shows one embodiment of the Corona Charger with vane-like electrodes with triangular-shaped tips. However, a variety of geometry and sizes of the vanes or protrusions could serve the purpose of achieving the required field strength (14-16 kV/cm) while achieving low pressure drop (0.25% or less). The following shapes of electrode tip could be used: semi-circular, curved, square, rectangular, etc. The vane-like electrodes can be discontinuous or attached to discrete points on the inner frame but not necessarily extending along the longitudinal length of the Corona Charger. The discrete protrusions may be in line with each other, as shown in FIG. 48 A, or offset, as shown in FIG. 48B. These variations may increase pressure loss due to increased flow obstruction but may be acceptable in certain applications. FIG. 48A shows a portion of Corona Charger 4800, including inner frame 4805, outer frame 4810, flow area 4815, and electrodes 4820 in line with each other. FIG. 48B shows a portion of Corona Charger 4800, including inner frame 4805, outer frame 4810, flow area 4815, and electrodes 4820, with some offset from others by offsets 4825.

Figure 49A:
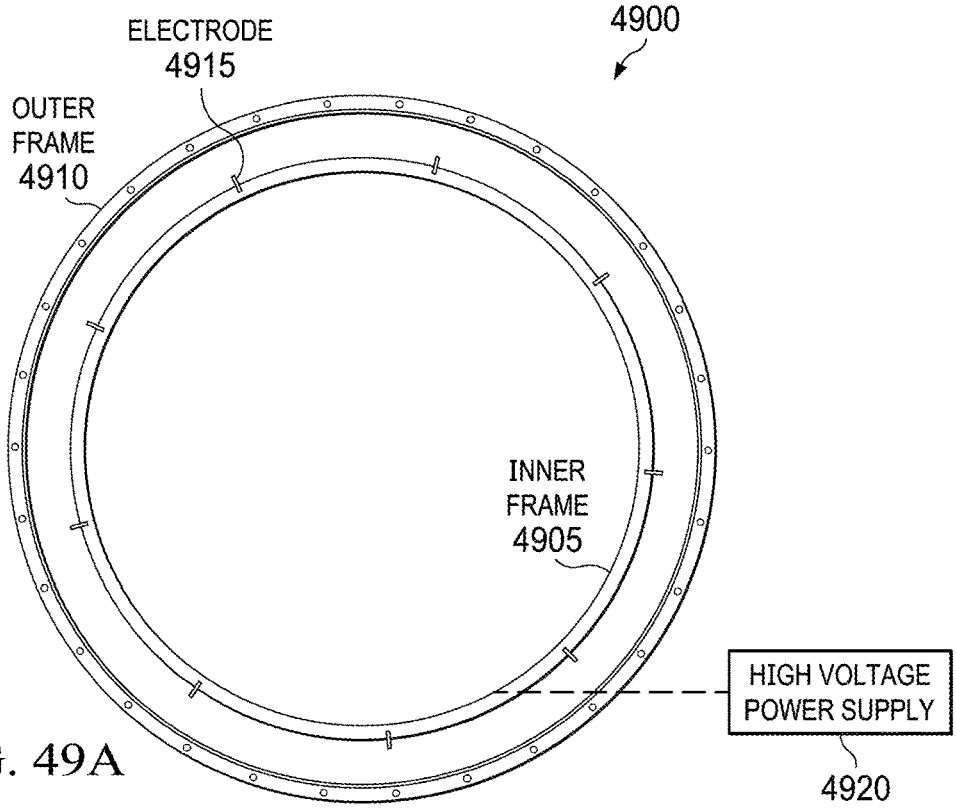
FIGS. 49A and 49B show a front view of Corona Chargers with 9 and 108 vane-like electrodes, respectively.
Figure 49B:
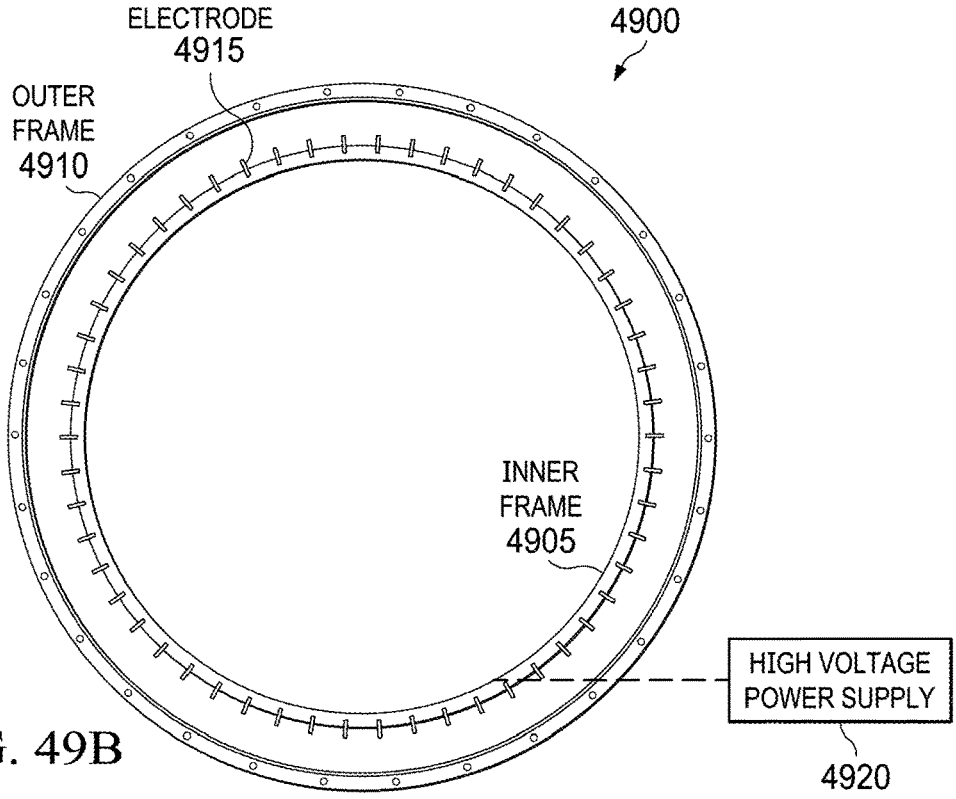

The total number of vane-like electrodes is important because too few electrodes, e.g., nine electrodes, as shown in FIG. 49A, results in a lower average field strength resulting in reduced charging of the particles, while too many electrodes, e.g., 108 electrode, as shown in FIG. 49B, leads to greater obstruction in air flow path resulting in greater pressure loss. FIG. 49A shows Corona Charger 4900 with inner frame 4905, outer frame 4910, nine electrodes 4915, and high voltage power supply 4920. FIG. 49B shows Corona Charger 4900 with inner frame 4905, outer frame 4910, 108 electrodes 4915, and high voltage power supply 4920. In the one embodiment, 54 vane-like electrodes with triangular tip and specified dimensions provide sufficient maximum field strength for corona discharge (>31 kV/cm) and sufficient average field strength (15.53 kV/cm) for charging while causing very low reduction (0.142%) in flow area. Other geometries that provide similar maximum and average electric field strength in the Charger while maintaining low reduction in flow area and low pressure loss are possible.

In summary:

The Corona Chargers can adequately perform electrostatic charging of simulant dust particles (Arizona A2 Fine ISO 12103-1 and AFRL 03). The electric field in the Corona Charger is the most important parameter for electrostatic charging of particles. High electric fields up to 5.2×106 V/m were calculated for the Corona Charger.

Larger particles acquire greater charge, while smaller particles are deflected the most due to their higher charge/mass ratio. Deflection for 0.66-65.02 μm particles ranged from 0.04" to 7.16", thereby improving their probability for separation into the IPS scavenge path.

Among the various constituents of Arizona A2 fine and AFRL03 test dust, silica particles acquire the least charge. Titanium dioxide and dolomite acquire most charge in Arizona A2 fine and AFRL03 test dust, respectively.

Preliminary design of the Corona Charger was developed for a generic IPS. For Arizona A2 fine test dust, 2.6% improvement in IPS separation efficiency was estimated at 8 lb/s air flow. For 1-22 μm particles, 10% improvement was estimated. In general, higher the mass fraction of fine particles, the greater is the improvement due to electrostatic charging and deflection.

The design of the Corona Charger minimizes obstruction in flow path. Therefore a low pressure loss (<0.12%) in intake air flow is estimated.

The space, weight and power penalty due to the Corona Charger is low. The Corona Charger increases the length of the IPS by 3.5-5.5" and increases the weight by 2-3.5 lbs. The power required for operation is less than 0.2% of rated power for a 3000 shp engine.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

REFERENCES

[1] T. N. Hull Jr. and J. L. Nye, "Particle separator with scroll scavenging means," U.S. Pat. No. 3,832,086, 1974.

[2] F. A. Lastrina, L. M. Pommer, and J. C. Mayer, "Particle separator scroll vanes," U.S. Pat. No. 4,527,387, 1985.

[3] D. D. Klassen, R. E. Moyer, F. A. Lastrina, and R. P. Tameo, "Axial flow inlet particle separator," U.S. Pat. No. 4,685,942, 1987.

[4] J. E. Lundquist and A. Thomas, "Inertial Separator," U.S. Pat. No. 7,879,123, 2011.

[5] G. Izzi, R. M. Rogers, B. E. Kahlbaugh, T. O. Winters, and K. Alderson, "Filter media pack, filter assembly, and method," US Patent Application 20130327218, 2013.

[6] R. B. Reif, "Electro-inertial Air Cleaner," U.S. Pat. No. 4,010,011, 1977.

[7] P. H. Snyder and B. Vittal, "Particle separator," U.S. Pat. No. 6,508,052, 2003.

[8] N. Suzuki, "Air Cleaner for Engines," U.S. Pat. No. 4,309,199, 1982.

[9] Y. P. Raizer, Gas Discharge Physics, 1st ed. Berlin, Germany: Springer-Verlag, 345, 1991.

[10] A. Ghanem, C. Habchi, T. Lemenand, D. D. Valle, and H. Peerhossaini, "Energy efficiency in process industry—High-efficiency vortex (HEV) multifunctional heat exchanger," Renewable Energy, 56, 96-104, 2013.

[11] D. Barone, E. Loth, P. Snyder, "Fluid Dynamics of an Inertial Particle Separator," 52nd Aerospace Sciences Meeting. National Harbor, Md., 2014.

[12] J. Warren, J., et al., "Best Practices for the Mitigation and Control of Foreign Object Damage-Induced High Cycle Fatigue in Gas Turbine Engine Compression System Airfoils", in RTO TECHNICAL REPORT, RTO-TR-AVT-094, 2005

[14] T. Watanabe, F. Tochikubo, Y. Koizumi, T. Tsuchida, J. Hautanen, E. I. Kauppinen, "Submicorn particle agglomeration by an electrostatic agglomerator," Journal of Electrostatics, 34, 367-383, 1995.

[13] J. Howe, H. L. Kington, and N. Nolcheff, "Electrostatic Charge Control Inlet Particle Separator System," US Patent 2015/0198090 A1

[14] P. Snyder, "Adaptable Inertial Particle Separator for a Gas Turbine Engine Intake," US Patent 20160265435 A1

[15] J. Meier, D. C. Crites, Y. Y. Sheoran, M. C. Morris, J. Howe, A, Riahi, US Patent 2015/0354461 A1

[17] Specification Development Document—Engines, Aircraft, Turboshaft, Sep. 2, 2014

[18] ISO 12103-1 Arizona Test Dust Contaminants A2 Fine, Powder Technology Inc.

[19] AFRL03, Proposed particle size specification, Powder Technology Inc.

[20] D. Barone, E. Loth, and P. Snyder, "Efficiency of an Inertial Particle Separator," Journal of Propulsion and Power, Vol. 31, No. 4, July-August 2015, 997-1002

[21] D. Barone, E. Loth, and P. Snyder, "Influence of Particle Size on Inertial Particle Separator Efficiency," Powder technology, 318, 2017, 177-185

[22] Army SBIR Solicitation, Electrostatic Methods for Improved Separation in Turbine Engines of Fine Sand/Dust Particles, A14-004, 2014.1

What is claimed is:

1. A method of enhancing separation of particles from a fluid flow, comprising:

imparting predominately unipolar charging on each of a plurality of particles in a fluid stream; wherein the imparting predominately unipolar charging on each of a plurality of particles in a fluid stream is performed using an electric discharge; wherein the electric discharge is generated between one or more protrusions and a curved surface; wherein the curved surface is within an annulus; wherein the annulus is partitioned into a plurality of partial-annulus sections, and each partial-annulus section has at least one protrusion positioned within it; and separating the particles after the particles have been charged from a core fluid flow that is substantially free of particles.

2. The method of claim 1, wherein the electric discharge is generated between a rod or a wire positioned substantially along the longitudinal axis of a tube and the tube.

3. The method of claim 2, wherein the tube has a substantially circular cross section or a non-circular cross-section.

4. The method of claim 1, wherein the electric discharge is generated between a plurality of rods or wires positioned within an annulus.

5. The method of claim 4, wherein the annulus is partitioned into a plurality of partial-annulus sections, and each partial-annulus section has at least one rod or wire positioned within the partial-annulus section.

6. The method of claim 1, wherein the electric discharge is generated between a plurality of protrusions positioned on opposite sides of an annulus.

7. The method of claim 1, wherein the electric discharge is a corona discharge, a dielectric barrier discharge, a radio-frequency-inductively coupled plasma discharge, an arc discharge, or a gliding arc discharge.

8. The method of claim 1, wherein the ionizing radiation device uses ionizing radiation produce by a source of x-rays or a decay of radioactive material.

9. The method of claim 1, further comprising promoting agglomeration of the particles after the particles have been charged.

10. The method of claim 9, wherein the promoting agglomeration of particles after the particles have been charged is performed by a turbulent mixing or an electric field.

11. The method of claim 10, wherein the electric field is a constant electric field, a time-varying electric field, or a pulsed electric field.

12. The method of claim 11, wherein the time-varying electric field is an oscillating electric field.

13. The method of claim 10, wherein the turbulent mixing is performed by one or more structures that protrude into the fluid stream.

14. The method of claim 10, wherein the turbulent mixing uses vortices having rotational axes substantially parallel to a direction of flow of the fluid stream, substantially perpendicular to the direction of flow of the fluid stream, or at varying angles to the direction of flow of the fluid stream.

15. The method of claim 1, wherein the separating the particles after the particles have been charged is performed using a constant electric field, an time-varying electric field, a pulsed electric field, or a constant magnetic field, a time-varying magnetic field, or a pulsed magnetic field.

16. The method of claim 15, wherein the time-varying electric field is an oscillating electric field that is unbiased, biased positively, or biased negatively.

17. The method of claim 1, wherein the separating step is performed by a flow separator to separate the particles charged by the particle charging device and further comprising deflecting the particles charged by the particle charging device into a scavenge flow.

18. The method of claim 17, wherein the flow separator is an inertial particle separator, a centrifugal particle separator, a cyclonic particle separator, or a porous medium.

19. The method of claim 1, further comprising sensing a chemical composition of particles, a particle size, or a particle concentration.

20. The method of claim 19, further comprising informing control of individual components with information from the sensing.

21. The method of claim 19, wherein the sensing comprises identifying at least one of soil particles, particles from sea spray, particles from volcanic eruption, or particles from anthropogenic particulate emission.

22. The method of claim 19, wherein the sensing comprises Raman spectroscopy or laser-induced breakdown spectroscopy.

23. The method of claim 1, wherein the plurality of particles includes particles of at least one of silica, gypsum, silicates, dolomite, salt, carbon, organic compounds, or metal oxides.

24. The method of claim 1, wherein the method is used with an engine that is in a stationary device, is in a vehicle, is in or about an aircraft, is a vehicle for transportation on a land surface, is a vehicle for transportation on the surface of a body of water, is a vehicle for transportation on either a land surface or the surface of a body of water as needed, or is a vehicle for transportation beneath the surface of a body of water.

25. The method of claim 24, wherein the engine is at least one of: a jet engine, a turbine engine, a supercharged engine, a compressor engine, a turbojet engine, a turbofan engine, a turboprop engine, a ramjet engine, a pulse jet engine, a scramjet engine, or an electric motor engine.

* * * * *